US009511592B2

(12) United States Patent
Kobayashi et al.

(10) Patent No.: US 9,511,592 B2
(45) Date of Patent: Dec. 6, 2016

(54) LIQUID STORAGE CONTAINER, LIQUID JET SYSTEM, AND LIQUID JET APPARATUS

(71) Applicant: SEIKO EPSON CORPORATION, Tokyo (JP)

(72) Inventors: Takumi Kobayashi, Nagano (JP); Shoma Kudo, Nagano (JP); Naomi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/595,621

(22) Filed: Jan. 13, 2015

(65) Prior Publication Data

US 2015/0197097 A1 Jul. 16, 2015

(30) Foreign Application Priority Data

Jan. 14, 2014 (JP) ..... 2014-003959

(51) Int. Cl.
*B41J 2/175* (2006.01)
*B41J 29/02* (2006.01)
*B41J 29/13* (2006.01)

(52) U.S. Cl.
CPC ..... *B41J 2/17509* (2013.01); *B41J 29/02* (2013.01); *B41J 29/13* (2013.01)

(58) Field of Classification Search
CPC ..... B41J 2/175; B41J 2/17506; B41J 2/17509; B41J 2/17513; B41J 2/1752; B41J 2/17556; B41J 2/19; B41J 2/1754; B41J 2/17596; B41J 2/17503
USPC ..... 347/84–85, 92
See application file for complete search history.

(56) References Cited

U.S. PATENT DOCUMENTS 7,559,615 B2 * 7/2009 Eve ..... B41J 2/19 347/6
8,336,999 B2 * 12/2012 Matsumoto ..... B41J 2/17509 347/85
2001/0048456 A1 * 12/2001 Higuma ..... B41J 2/17513 347/86
2005/0024423 A1 2/2005 Katayama
2010/0013896 A1 * 1/2010 Ishizawa ..... B41J 2/17566 347/86
2012/0038719 A1 2/2012 Shimizu et al.
(Continued)

FOREIGN PATENT DOCUMENTS

JP 2005-047028 A 2/2005
JP 2011-079247 A 4/2011
(Continued)

OTHER PUBLICATIONS

International Search Report for the counterpart International Patent Application No. PCT/JP2014/006150 mailed Mar. 17, 2015.

*Primary Examiner* — Geoffrey Mruk
*Assistant Examiner* — Scott A Richmond
(74) *Attorney, Agent, or Firm* — Global IP Counselors, LLP

(57) ABSTRACT

A liquid storage container includes a liquid storage section configured to store a liquid, an injection port open to the liquid storage section and configured and arranged to receive the liquid injected into the liquid storage section, an air introduction valve configured and arranged to allow movement of air from an exterior of the liquid storage section to an interior of the liquid storage section and to prevent movement of air from the interior of the liquid storage section to the exterior of the liquid storage section.

9 Claims, 44 Drawing Sheets

(56) References Cited

U.S. PATENT DOCUMENTS

2014/0002552 A1 1/2014 Takeuchi et al.

FOREIGN PATENT DOCUMENTS

| | | | |
|---|---|---|---|
| JP | 2012-020495 | A | 2/2012 |
| JP | 2013-141809 | A | 7/2013 |
| JP | 2013-180542 | A | 9/2013 |

* cited by examiner

LIQUID STORAGE CONTAINER, LIQUID JET SYSTEM, AND LIQUID JET APPARATUS

CROSS-REFERENCE TO RELATED APPLICATIONS

This application claims priority to Japanese Patent Application No. 2014-003959 filed on Jan. 14, 2014. The entire disclosure of Japanese Patent Application No. 2014-003959 is hereby incorporated herein by reference.

BACKGROUND

Technical Field

The present invention relates to a liquid storage container, a liquid jet system, a liquid jet apparatus, and the like.

Related Art

Inkjet printers have conventionally been known as one example of a liquid jet apparatus. In an inkjet printer, printing on a printing medium such as printing paper can be carried out by discharging an ink, which is one example of a liquid, from an ejection head onto the printing medium. With such an inkjet printer, there is a conventionally known configuration where ink that has been collected in a tank, which is one example of a liquid storage container, is supplied to the ejection head. An ink injection port is provided to this tank. A user is able to refill the tank with ink from the ink injection port. In such a tank, there is a conventionally known configuration with which a liquid storage chamber in which the ink is stored and an air storage chamber with which air is introduced are in communication with one another by a communicating section (see JP-A-2012-20495 (patent document 1), for example).

SUMMARY

With the tank disclosed in patent document 1, a liquid storage chamber-side opening of the communicating section can be immersed in the ink that is inside the liquid storage chamber, and therefore the ink inside the liquid storage chamber is likely to flow into the communicating section. Then, when an external force such as vibration acts in a state where the ink has flowed into the communicating section, the ink inside the communicating section becomes more likely to flow into the air storage chamber. When the ink is more likely to flow into the air storage chamber, then there is an increased possibility that ink could leak out of the tank from the air release port. In this manner, a conventional liquid storage container has a problem in that it is difficult to reduce the possibility of leakage of the liquid from occurring.

The present invention has been made in order to solve the above-described problem at least in part, and can be realized in the form of the following modes or application examples.

Application Example 1

A liquid storage container includes a liquid storage section configured to store a liquid; an injection port open to the liquid storage section and configured to receive the liquid injected into the liquid storage section; and an air introduction valve configured and arranged to allow movement of air from an exterior of the liquid storage section to an interior of the liquid storage section and to prevent movement of air from the interior of the liquid storage section to the exterior of the liquid storage section.

In the liquid storage container of this application example, when, for example, the liquid that is stored in the liquid storage section has been consumed and the pressure of the interior of the liquid storage section has become lower than the atmospheric pressure, then air is able to flow into the interior of the liquid storage section from the exterior of the liquid storage section via the air introduction valve, and therefore any drop in pressure in the interior of the liquid storage section can be mitigated. The air introduction valve can hinder the movement of air from the interior of the liquid storage section to the exterior of the liquid storage section. For this reason, the liquid that is stored in the liquid storage section is also hindered from moving from the interior of the liquid storage section to the exterior of the liquid storage section by the air introduction valve. As a result, according to this liquid storage container, the possibility that the liquid stored in the liquid storage container could leak out to the exterior can be reduced.

Application Example 2

The liquid storage container as described above further includes an air release valve configured and arranged to allow the movement of air from the interior of the liquid storage section to the exterior of the liquid storage section and to prevent the movement of air from the exterior of the liquid storage section to the interior of the liquid storage section.

In this application example, when, for example, the pressure in the interior of the liquid storage section has become higher than the atmospheric pressure, then gas of the interior of the liquid storage section is able to flow out to the exterior of the liquid storage section via the air release valve, and therefore any elevation in the pressure of the interior of the liquid storage section can be mitigated.

Application Example 3

The liquid storage container as described above further includes an air introduction opening, a first air communication section configured and arranged to allow movement of air between the air introduction opening and the liquid storage section, and a second air communication section configured and arranged to introduce air to the liquid storage section from the first air communication section, the air introduction valve being located between the first air communication section and the second air communication section, and the air release valve being located between the first air communication section and the second air communication section.

In this application example, the air introduction valve is located between the first air communication section and the second air communication section, as is the air release valve, and therefore air can be introduced from the exterior of the liquid storage section to the interior or gas can be discharged from the interior of the liquid storage section to the exterior, both via the first air communication section and the second air communication section.

Application Example 4

The liquid storage container as described above further includes an air communication section configured and arranged to allow movement of air between the exterior of the liquid storage section and the interior of the liquid storage section, the air introduction valve being provided to move air to the air communication section from the exterior of the liquid storage section, and the air release valve being provided to move air from the air communication section to the exterior of the liquid storage section.

In this application example, air can be introduced from the exterior of the liquid storage section to the interior or gas can be discharged from the interior of the liquid storage section to the exterior, both via the air communication section.

Application Example 5

The liquid storage container as described above further includes a first compartmentalizing wall compartmentalizing the first air communication section and the second air communication section from one another, a second compartmentalizing wall formed on a first surface of the first compartmentalizing wall and compartmentalizing the first air communication section and the second air communication section from one another, and a third compartmentalizing wall formed on a second surface of the first compartmentalizing wall opposite to the first surface and compartmentalizing the first air communication section and the second air communication section from one another, the air introduction valve and the air release valve being provided to the first compartmentalizing wall to move air from the second surface side toward the first surface side.

In this application example, the directions in which the air is able to move can be aligned with the air introduction valve and the air release valve.

Application Example 6

The liquid storage container as described above further includes a housing having a recess in which the air communication section and the liquid storage section are formed, and a sealing member sealing off the recess, the air introduction valve and the air release valve being provided to a wall that faces the sealing member out of walls inside the recess.

In this application example, the air introduction valve and the air release valve can be arranged at a position that faces the sealing member.

Application Example 7

A liquid jet system comprising a first case, a mechanism unit including a mechanism portion that is covered by the first case and is configured to execute a print operation, a second case coupled to the first case, and a plurality of aforementioned liquid storage containers, the plurality of liquid storage containers being covered by the second case and being configured and arranged to supply a liquid to a print section of the mechanism unit via a supply tube.

In the liquid jet system of this application example, the possibility that the liquid stored in the liquid storage container could leak out to the exterior can be reduced.

Application Example 8

A liquid jet apparatus comprising a case, a mechanism unit including a mechanism portion that is covered by the case and is configured to execute a print operation, and a plurality of aforementioned liquid storage containers, the plurality of liquid storage containers being covered by the case and being configured and arranged to supply a liquid to a print section of the mechanism unit via a supply tube.

In the liquid jet apparatus of this application example, the possibility that the liquid stored in the liquid storage container could leak out to the exterior can be reduced.

BRIEF DESCRIPTION OF THE DRAWINGS

Referring now to the attached drawings which form a part of this original disclosure.

DETAILED DESCRIPTION OF EMBODIMENTS

A liquid jet system comprising an inkjet printer (called a printer hereinbelow), which is one example of a liquid jet apparatus, shall be described by way of example, with reference to the accompanying drawings, in terms of embodiments. In each of the drawings, there may be instances where the scales of the configurations and members have been altered in order to make the respective configurations large enough to be recognizable.

First Embodiment

Figure 1:
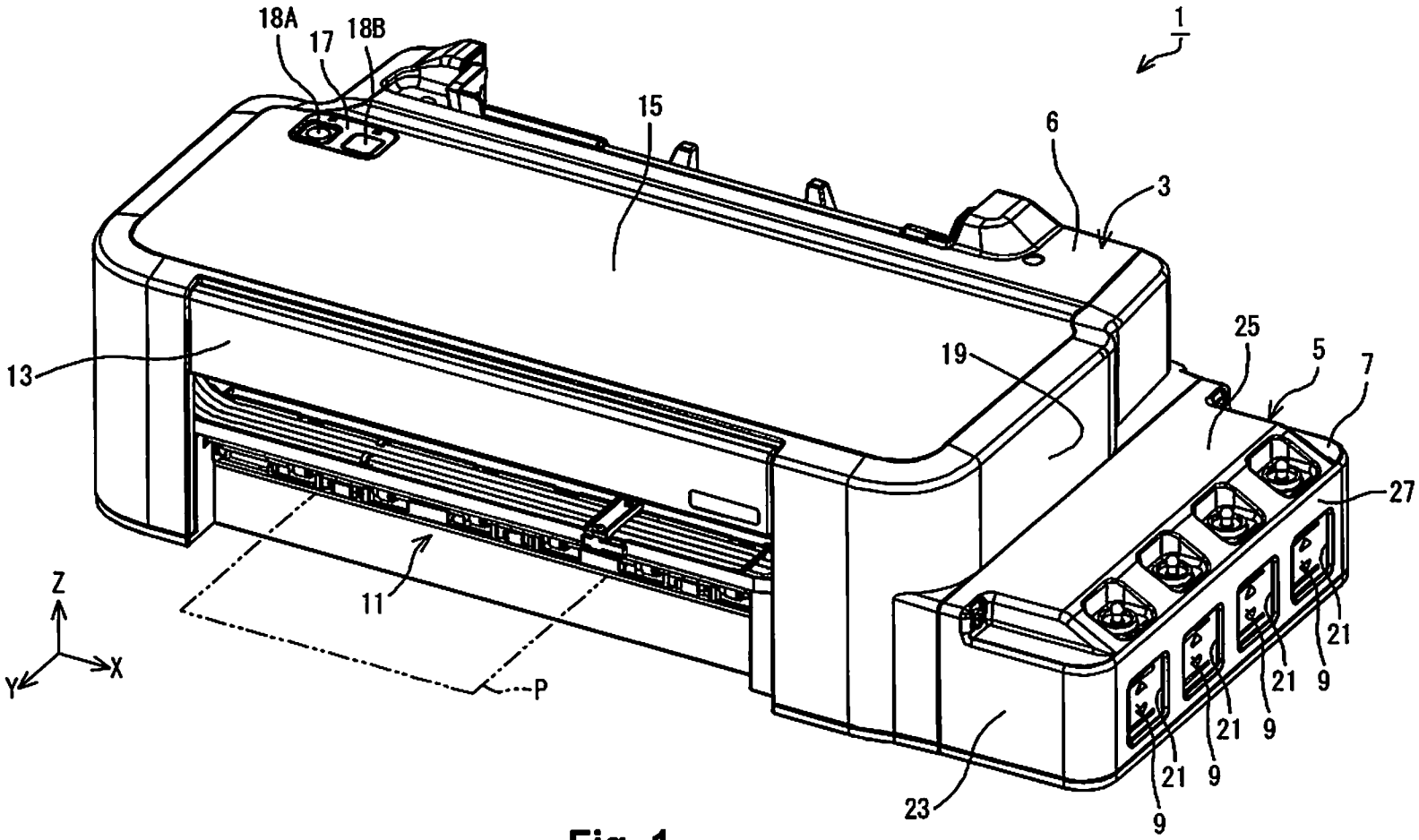
FIG. 1 is a perspective view illustrating a liquid jet system in a first embodiment.

A liquid jet system 1 in the first embodiment as a printer 3, which is one example of a liquid jet apparatus, and a tank unit 5, as illustrated in FIG. 1. The printer 3 has a first case 6. The first case 6 constitutes an outer shell of the printer 3. The tank unit 5 has a second case 7 and a plurality (two or more) of tanks 9. The first case 6 and the second case 7 constitute an outer shell of the liquid jet system 1. The tanks 9 are one example of a liquid storage container. Using ink, which is one example of a liquid, the liquid jet system 1 is able to print onto a printing medium P such as printing paper.

Here, in FIG. 1, XYZ axes have been assigned, which are coordinate axes that are orthogonal to one another. XYZ axes have been assigned where necessary in the subsequently illustrated drawings, as well. In each of the XYZ axes, the orientation of the arrow illustrates the plus direction (forward direction), and the opposite orientation to the orientation of the arrow illustrates the minus direction (negative direction). In a state where the liquid jet system 1 is used, the liquid jet system 1 is arranged on a horizontal plane defined by the X-axis and the Y-axis. In the state of use of the liquid jet system 1, the Z-axis is the axis orthogonal to the horizontal plane, and the −Z axis direction is vertically downward.

Stored in the first case 6 is a mechanism unit 10 (FIG. 4) of the printer 3. The mechanism unit 10 is a mechanism portion for executing the operation of printing in the printer 3. A more detailed description of the mechanism unit 10 shall be provided below. The plurality of tanks 9 are stored inside the second case 7, as illustrated in FIG. 1, and each of the plurality of tanks 9 stores ink that is supplied for printing. In the present embodiment, there are four of the tanks 9 that are provided. In the four tanks 9, there is a different kind of ink for each of the tanks 9. In the present embodiment, the four kinds of ink that are employed are black, yellow, magenta, and cyan. One of each is provided—a tank 9 that stores the black ink, a tank 9 that stores the yellow ink, a tank 9 that stores the magenta ink, and a tank 9 that stores the cyan ink. In the liquid jet system 1, the plurality of tanks 9 are provided on the outside of the first case 6. For this reason, in the liquid jet system 1, the plurality of tanks 9 are not built into the first case 6, which covers the mechanism unit 10.

Also provided to the printer 3 is a paper discharge section 11. In the printer 3, the printing medium P is discharged from the paper discharge section 11. In the printer 3, a surface to which the paper discharge section 11 is provided is understood to be a front surface 13. The printer 3 also has an operation panel 17 at an upper surface 15 that intersects the front surface 13. Provided to the operation panel 17 are a power button 18A, another operation button 18B, and the like. The tank unit 5 is provided to a side section 19 that intersects the front surface 13 and the upper surface 15 in the first case 6. Window sections 21 are provided to the second case 7. The window sections 21 are provided to a side section 27 that intersects with a front surface 23 and an upper surface 25 in the second case 7. The window sections 21 are optically transparent. The four tanks 9 described above are provided to positions overlapping with the window sections 21. For this reason, a worker who is using the liquid jet system 1 is able to view the four tanks 9 via the window sections 21.

Figure 2:
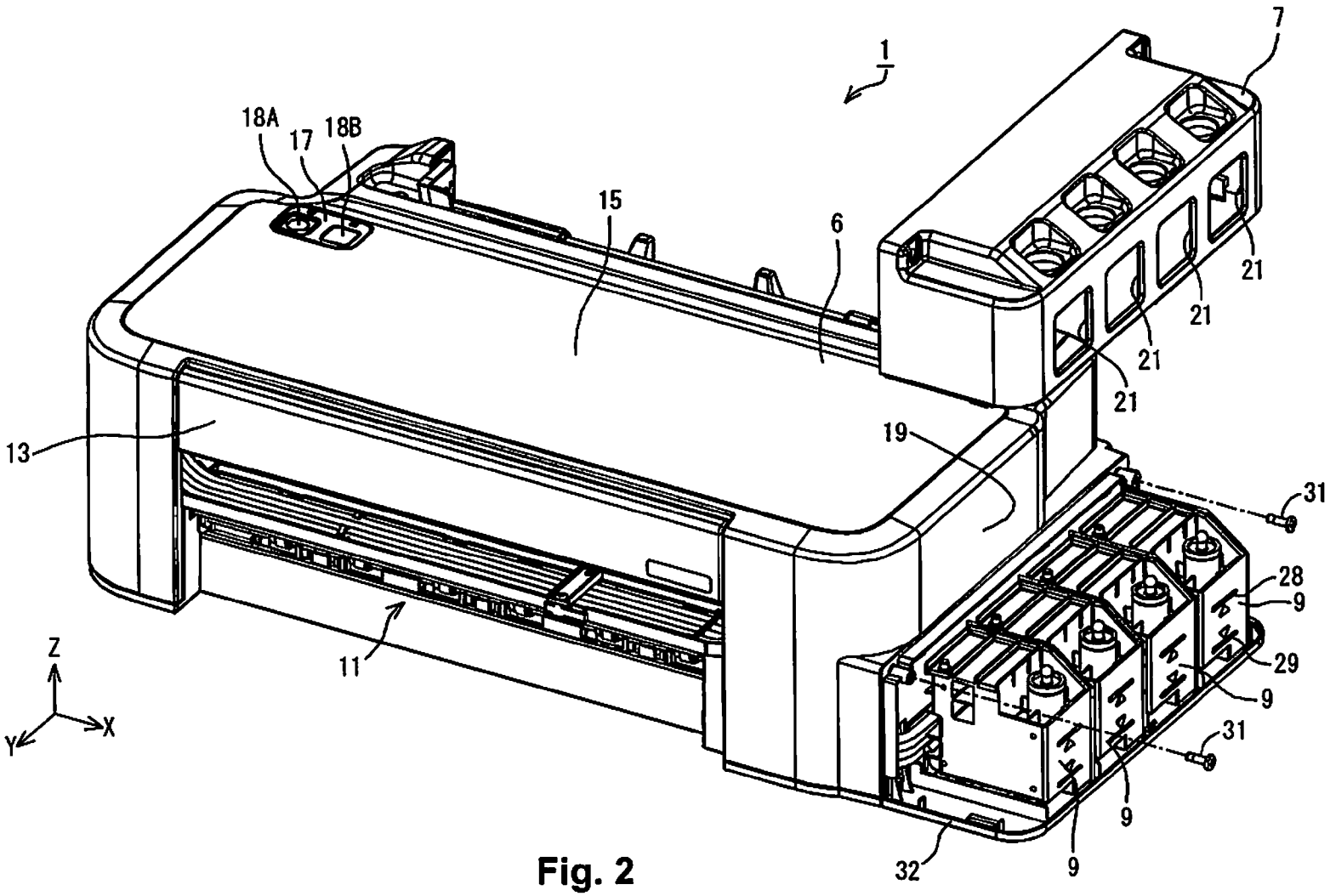
FIG. 2 is a perspective view illustrating a liquid jet system in a first embodiment.

In the present embodiment, at least a part of the sites of each of the tanks 9 that face the window sections 21 is optically transparent. The inks inside the tanks 9 can be viewed from the optically transparent sites of each of the tanks 9. As such, viewing the four tanks 9 via the window sections 21 allows the worker to view the amount of ink that is in each of the tanks 9. In other words, with the tanks 9, at least a part of the sites facing the window sections 21 can be put to use as a viewing section making it possible to view the amount of ink. The first case 6 and the second case 7 are configured as separate members from one another. For this reason, in the present embodiment, the second case 7 can be separated from the first case 6, as illustrated in FIG. 2. The second case 7 is coupled to the first case 6 by mounting screws 31. Also, as illustrated in FIG. 2, the second case 7 at least partially covers the four tanks 9, e.g., the front surfaces, upper surfaces, and side surfaces thereof. Provided to each of the tanks 9, at the sites facing the window sections 21, are an upper limit mark 28 indicative of an upper limit for the amount of ink and a lower limit mark 29 indicative of a lower limit for the amount of ink. The worker can use the upper limit marks 28 and the lower limit marks 29 as benchmarks to ascertain the amount of ink that is in each of the tanks 9.

Figure 3:
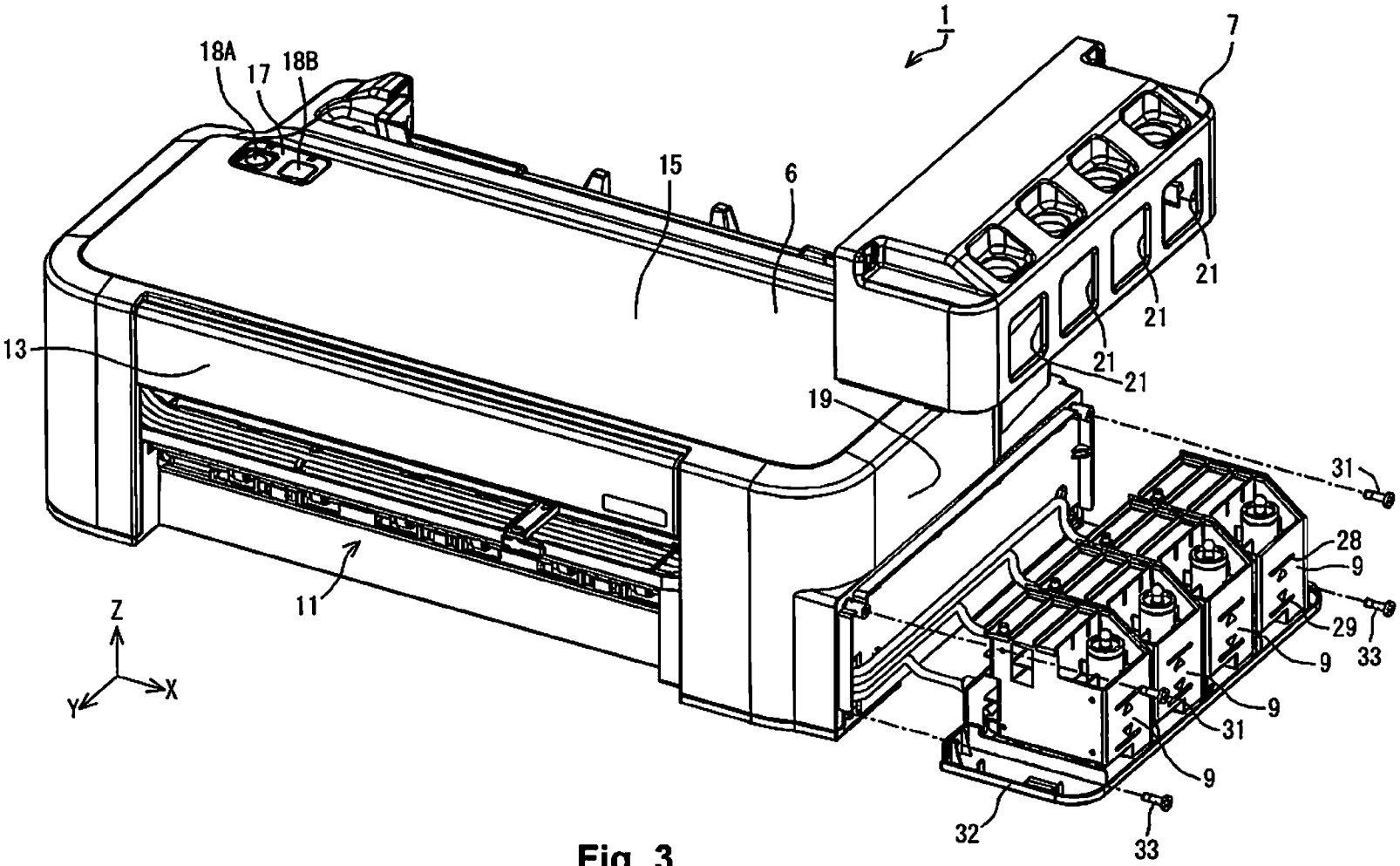
FIG. 3 is a perspective view illustrating a liquid jet system in a first embodiment.

The tank unit 5 also has a support frame 32. The four tanks 9 are supported by the support frame 32. The support frame 32 is configured as a separate member from the first case 6. For this reason, in the present embodiment, as illustrated in FIG. 3, the support frame 32 can be separated from the first case 6. The support frame 32 is coupled to the first case 6 by mounting screws 33. In this manner, in the present embodiment, the tank unit 5 (FIG. 1) is mounted onto the outside of the first case 6.

Figure 4:
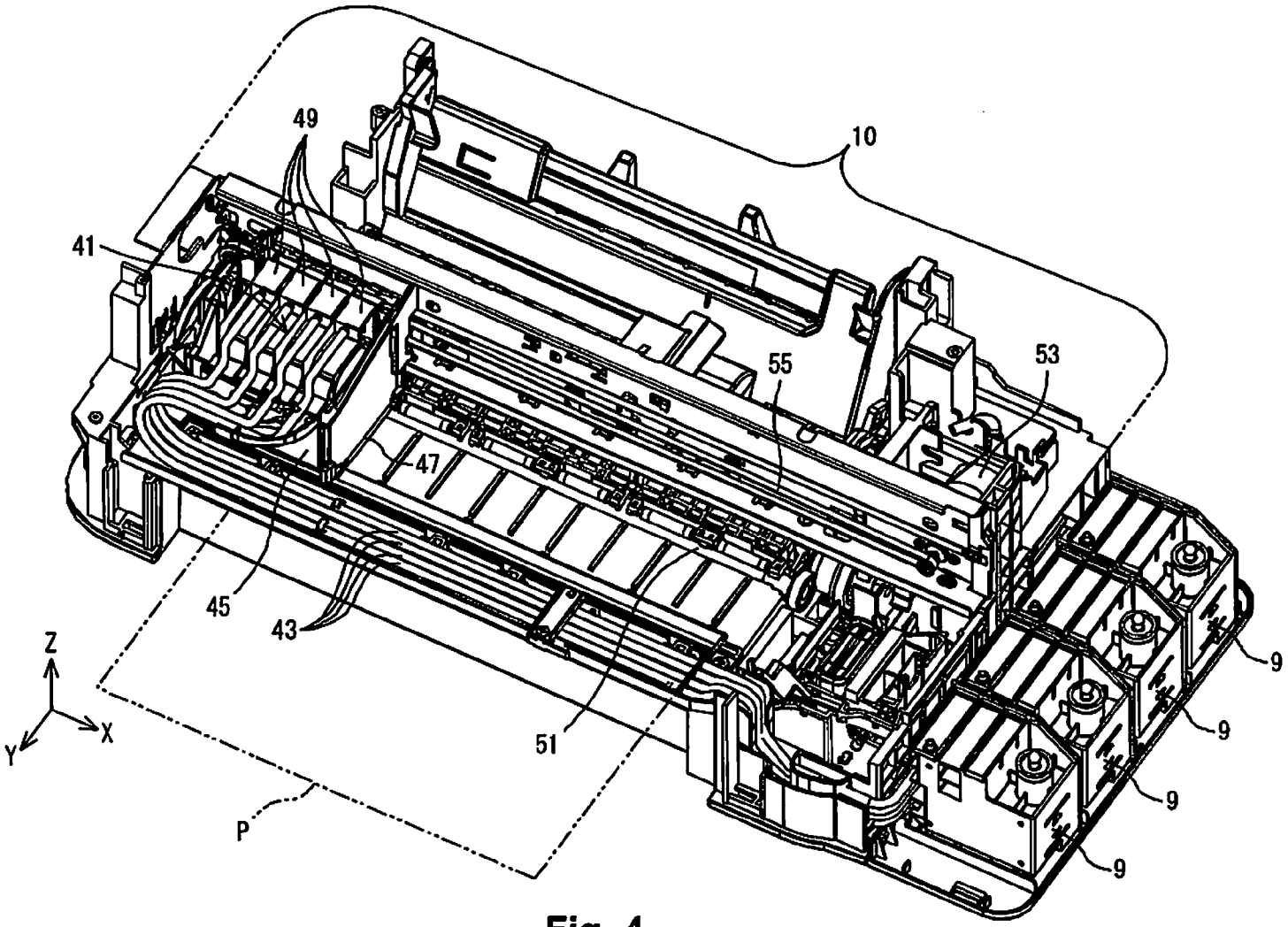
FIG. 4 is a perspective view illustrating a mechanism unit of a printer in a first embodiment.

The printer 3 has a print section 41 and supply tubes 43, as illustrated in FIG. 4, which is a perspective view illustrating the mechanism unit 10. The print section 41 has a carriage 45, a print head 47, and four relay units 49. The print head 47 is mounted onto the carriage 45, as are the relay units 49. The supply tubes 43 are flexible and are provided between the tanks 9 and the relay units 49. The inks inside the tanks 9 are sent to the relay units 49 via the supply tubes 43. The relay units 49 relay to the print head 47 the inks that are supplied from the tanks 9 via the supply tubes 43. The print head 47 discharges the supplied inks as ink droplets.

The printer 3 also has a medium conveyance mechanism (not shown) and a head conveyance mechanism (not shown). The medium conveyance mechanism conveys the printing medium P along the Y-axis direction by driving a conveyance roller 51 using power coming from a motor (not shown). The head conveyance mechanism conveys the carriage 45 along the X-axis direction by transmitting power coming from a motor 53 to the carriage 45 via a timing belt 55. The print head 47 is mounted onto the carriage 45. For this reason, the print head 47 can be conveyed in the X-axis direction via the carriage 45, by the head conveyance mechanism. The print head 47 is supported by the carriage 45 in a state of facing the printing medium P. The inks are discharged from the print head 47 while the relative position of the print head 47 with respect to the printing medium P is being changed by the medium conveyance mechanism and the head conveyance mechanism, whereby printing is performed on the printing medium P.

Various working examples of the tanks 9 shall now be described. For the purpose of identifying the different tanks by the respective working examples below, a letter of the alphabet that is different for each working example is appended to the reference signs of the tanks 9.

Working Example 1

Figure 5:
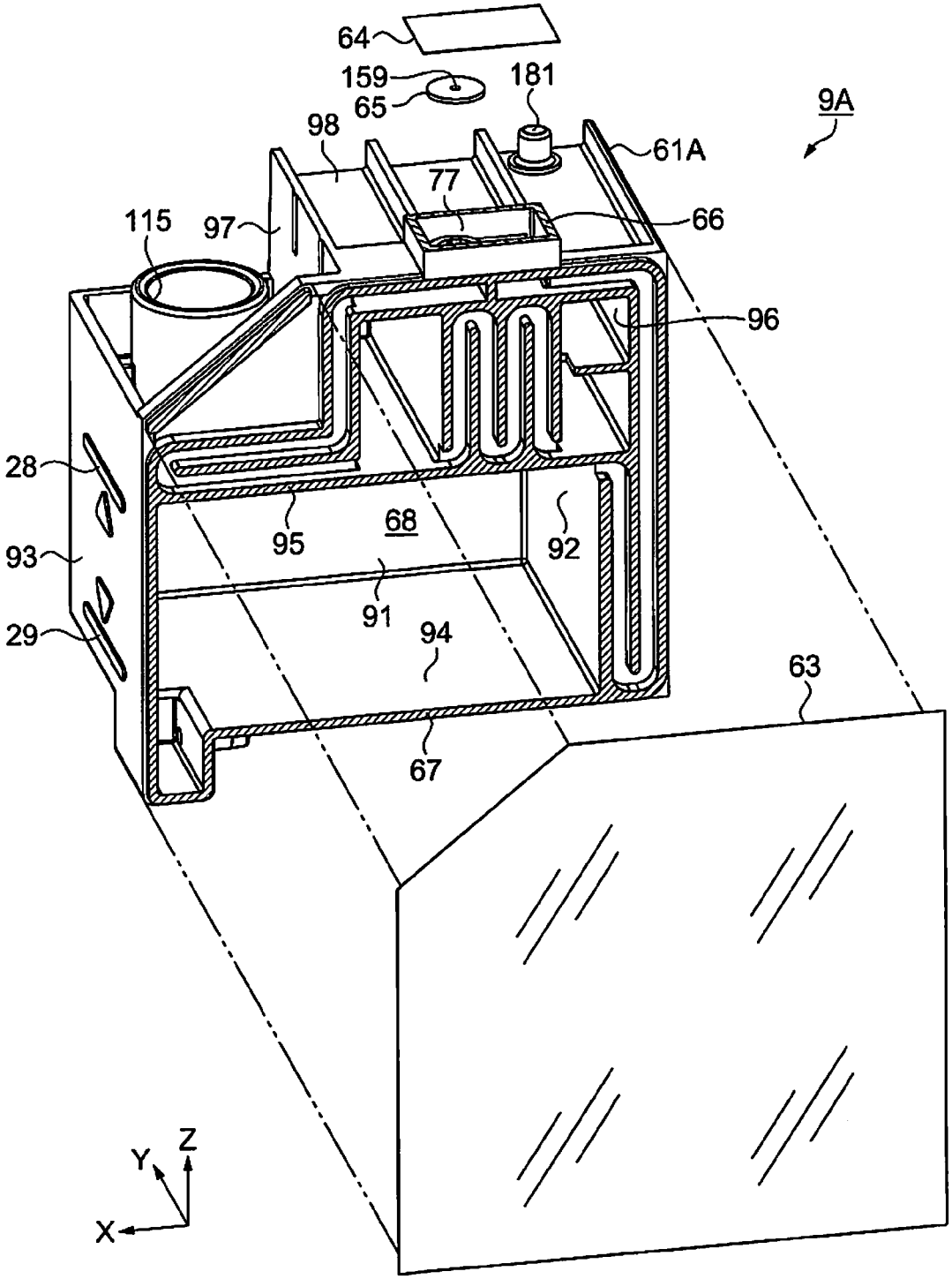
FIG. 5 is an exploded perspective view illustrating a tank in a working example 1.

A tank 9A as in a working example 1 shall now be described. The tank 9A, as illustrated in FIG. 5, has a case 61A that is one example of a tank main body, as well as a sheet member 63, a sheet member 64, and an air introduction valve 65. The case 61A is constituted of, for example, a synthetic resin such as nylon or polypropylene. The sheet member 63 is formed of a synthetic resin (for example, nylon, polypropylene, or the like) in the shape of a film, and is flexible. In the present embodiment, the sheet member 63 is optically transparent. The sheet member 64 is also is formed of a synthetic resin (for example, nylon, polypropylene, or the like) in the shape of a film. The air introduction valve 65 is constituted of a material that is elastic, such as, for example, a rubber or elastomer, and presents with a planar shape. The air introduction valve 65 is provided to inside a communicating chamber 77 (described below).

Provided to inside the case 61A are a bonded section 67 and a bonded section 66. FIG. 5 depicts the bonded section 67 and the bonded section 66 with hatching in order to illustrate the configuration in a manner that is easy to understand. The sheet member 63 is bonded to the bonded section 67. The sheet member 64 is bonded to the bonded section 66. In the present embodiment, the case 61A and the sheet member 63 are bonded together by welding. Similarly, the case 61A and the sheet member 64 are bonded together by welding. The tank 9A possesses a configuration where the case 61A and the sheet member 63 are bonded together and the case 61A and the sheet member 64 are also bonded together.

Figure 6:
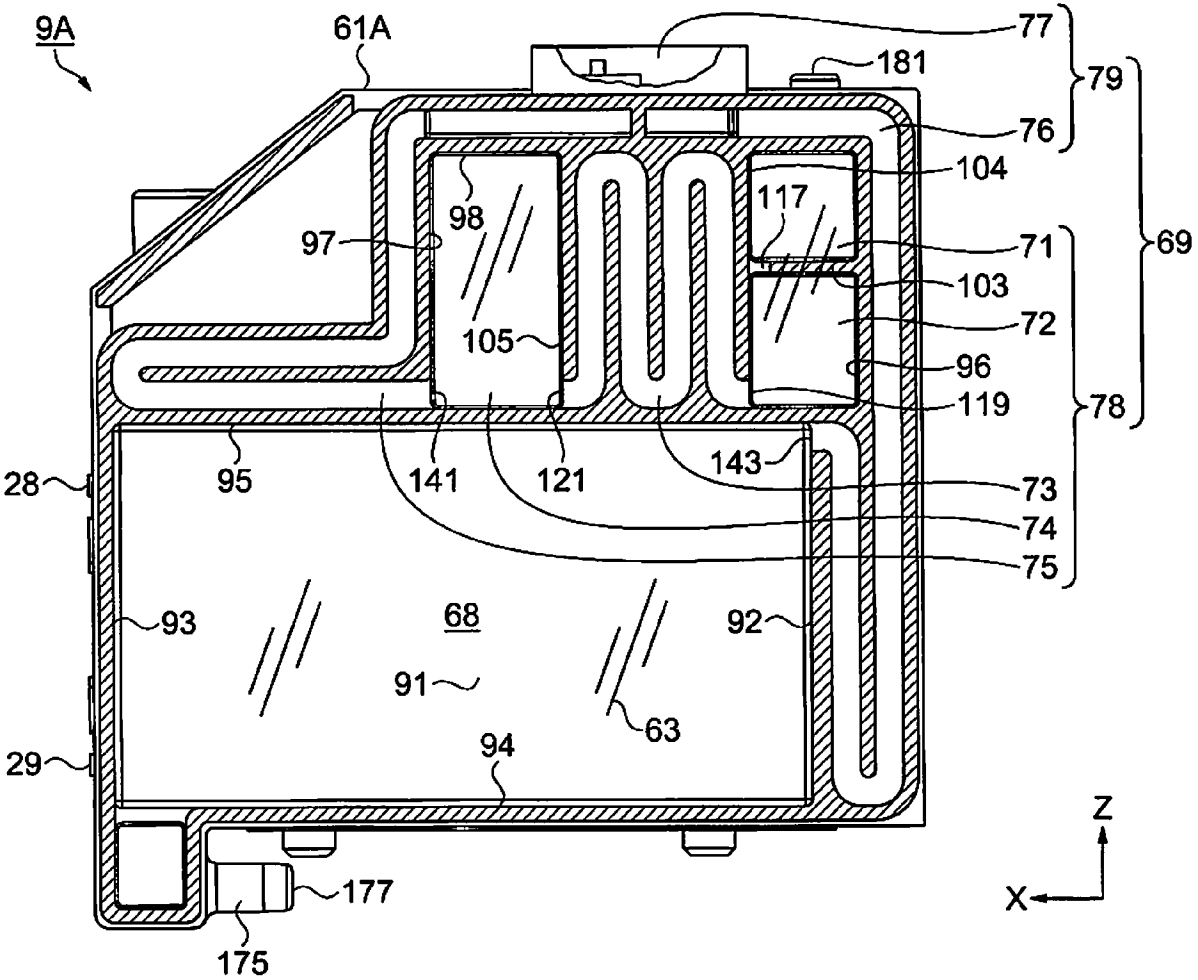
FIG. 6 is a side view of when a tank in a working example 1 is seen from a sheet member side.

The tank 9A, as illustrated in FIG. 6, has a storage section 68 and a communicating section 69. The communicating section 69 has a first air chamber 71, a second air chamber 72, a first communicating passage 73, a third air chamber 74, a second communicating passage 75, a third communicating passage 76, and the communicating chamber 77. In the tank 9A, the communicating section 69 can be demarcated into a first communicating section 78 and a second communicating section 79, for which the boundary is the air introduction valve 65. The first communicating section 78 includes the first air chamber 71, the second air chamber 72, the first communicating passage 73, the third air chamber 74, and the second communicating passage 75. The second communicating section 79 includes the communicating chamber 77 and the third communicating passage 76. In the tank 9A, the ink is stored inside the storage section 68. FIG. 6 illustrates a state where the tank 9A is viewed from the sheet member 63 side, and depicts the case 61A with the sheet member 63 therebetween. The storage section 68, the first air chamber 71, the second air chamber 72, the first communicating passage 73, the third air chamber 74, the second communicating passage 75, and the third communicating passage 76 are partitioned from one another by the bonded section 67.

The case 61A has a first wall 91, a second wall 92, a third wall 93, a fourth wall 94, a fifth wall 95, a sixth wall 96, a seventh wall 97, and an eighth wall 98. Arranged on the opposite side to the storage section 68 side of the fifth wall 95 are the first air chamber 71, the second air chamber 72, the first communicating passage 73, the third air chamber 74, and the second communicating passage 75. The communicating chamber 77 is arranged on the opposite side to the fifth wall 95 side of the eighth wall 98. The third communicating passage 76 is arranged on the opposite side to the storage section 68 side of the second wall 92. When the first wall 91 is seen in plan view from the sheet member 63 side, then the storage section 68 is surrounded by the second wall 92, the third wall 93, the fourth wall 94, and the fifth wall 95.

When the first wall 91 is seen in plan view from the sheet member 63 side, then the first air chamber 71, the second air chamber 72, the first communicating passage 73, and the third air chamber 74 are surrounded by the fifth wall 95, the sixth wall 96, the seventh wall 97, and the eighth wall 98. The first wall 91 of the storage section 68 and the first wall 91 of the first air chamber 71, the second air chamber 72, and the third air chamber 74 are the same wall as one another. In other words, in the tank 9A, the storage section 68, the first air chamber 71, the second air chamber 72, and the third air chamber 74 share the first wall 91 with one another.

Figure 7:
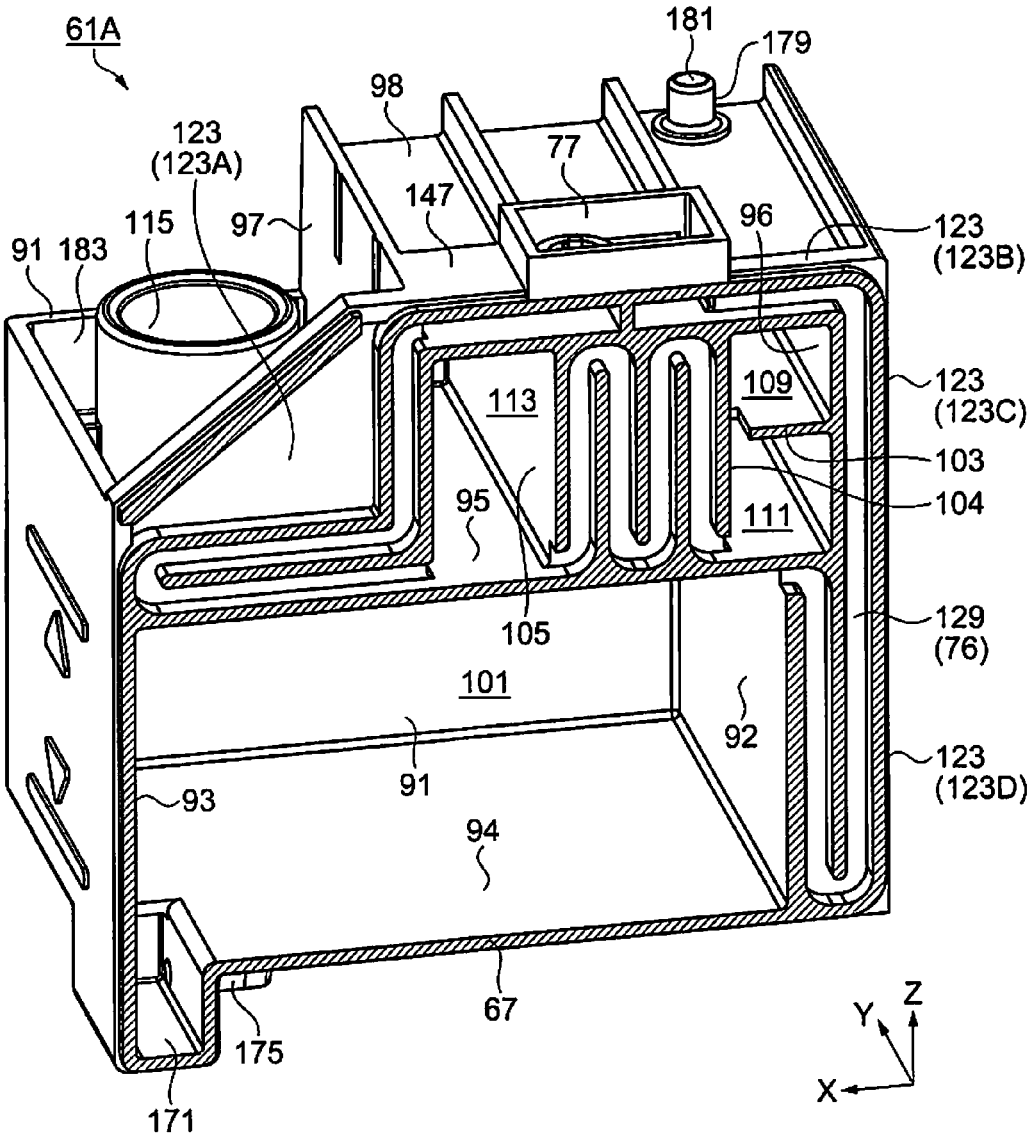
FIG. 7 is a perspective view illustrating a case in a working example 1.

The second wall 92, the third wall 93, the fourth wall 94, and the fifth wall 95 each intersect the first wall 91, as illustrated in FIG. 7. The second wall 92 and the third wall 93 are provided to positions that face one another across the first wall 91 along the X-axis. The fourth wall 94 and the fifth wall 95 are provided to positions that face one another across the first wall 91 along the Z-axis. The second wall 92 intersects with each of the fourth wall 94 and the fifth wall 95. The third wall 93 also intersects with each of the fourth wall 94 and the fifth wall 95.

The second wall 92, the third wall 93, the fourth wall 94, and the fifth wall 95 project out in the −Y-axis direction from the first wall 91. Due to this, the second wall 92, the third wall 93, the fourth wall 94, and the fifth wall 95 extending in the −Y-axis direction from a main wall together constitute a recess 101, the main wall being the first wall 91. The recess 101 is configured with an orientation so as to be concave going toward the Y-axis direction. The recess 101 forms an opening going toward the −Y-axis direction side, i.e., the sheet member 63 (FIG. 5) side. In other words, the recess 101 is provided at an orientation so as to be concave going toward the Y-axis direction, i.e., going toward the opposite side to the sheet member 63 (FIG. 5) side. When the sheet member 63 is bonded to the case 61A, the recess 101 is closed off by the sheet member 63, thus constituting the storage section 68. The first wall 91 through eighth wall 98 are not limited to being flat walls, and may instead comprise irregularities.

The sixth wall 96, as illustrated in FIG. 6, projects out toward the opposite side to the fourth wall 94 side of the fifth wall 95, i.e., the Z-axis direction side of the fifth wall 95 from the fifth wall 95. The seventh wall 97 projects out toward the opposite side to the fourth wall 94 side of the fifth wall 95, i.e., the Z-axis direction side of the fifth wall 95 from the fifth wall 95. The sixth wall 96 and the seventh wall 97 are provided to positions that face one another across the first air chamber 71, the second air chamber 72, the first communicating passage 73, and the third air chamber 74 along the X-axis. The eighth wall 98 is provided to a position that faces the fifth wall 95 across the first air chamber 71, the second air chamber 72, the first communicating passage 73, and the third air chamber 74 along the Z-axis. The sixth wall 96 intersects with each of the fifth wall 95 and the eighth wall 98. The seventh wall 97 also intersects with each of the fifth wall 95 and the eighth wall 98.

A ninth wall 103 for partitioning the first air chamber 71 and the second air chamber 72 is provided between the fifth wall 95 and the eighth wall 98. A tenth wall 104 and an eleventh wall 105 are provided between the sixth wall 96 and the seventh wall 97. Separations are formed between the first air chamber 71 and second air chamber 72 and the third air chamber 74 by the tenth wall 104 and the eleventh wall 105 along the X-axis. The tenth wall 104 is provided closer to the seventh wall 97 side than the sixth wall 96, and faces the sixth wall 96. The eleventh wall 105 is provided closer to the sixth wall 96 side than the seventh wall 97, and faces the seventh wall 97. The eleventh wall 105 is provided closer to the seventh wall 97 side than the tenth wall 104.

The sixth wall 96, the seventh wall 97, the eighth wall 98, the ninth wall 103, the tenth wall 104, and the eleventh wall 105 each project out in the −Y-axis direction from the first wall 91, as illustrated in FIG. 7. The sixth wall 96, the ninth wall 103, the tenth wall 104, and the eighth wall 98 extending in the −Y-axis direction from the first wall 91 together constitute a recess 109. The sixth wall 96, the fifth wall 95, the tenth wall 104, and the ninth wall 103 extending in the −Y-axis direction from the first wall 91 together constitute a recess 111. The fifth wall 95, the seventh wall 97, the eighth wall 98, and the eleventh wall 105 extending in the −Y-axis direction from the first wall 91 together constitute a recess 113.

The recess 109, the recess 111, and the recess 113 each form an opening going toward the −Y-axis direction, i.e., going toward the sheet member 63 (FIG. 5) side. In other words, the recess 109, the recess 111, and the recess 113 each are provided at an orientation so as to be concave going toward the Y-axis direction, i.e., going toward the opposite side to the sheet member 63 (FIG. 5) side. When the sheet member 63 is bonded to the case 61A, then the recess 109 is closed off by the sheet member 63, thus constituting the first air chamber 71. Similarly, when the sheet member 63 is bonded to the case 61, the recess 111 is closed off by the sheet member 63, thus constituting the second air chamber 72, and the recess 113 is closed off by the sheet member 63, thus constituting the third air chamber 74. The amounts by which the second wall 92 through eighth wall 98 and the ninth wall 103 through eleventh wall 105 project out from the first wall 91 are set so as to be the same amount of projection to one another.

The second wall 92 and the sixth wall 96 have a stepped difference along the X-axis. The second wall 92 is located closer to the third wall 93 side than the sixth wall 96, i.e., closer to the X-axis direction side than the sixth wall 96. The third wall 93 and the seventh wall 97 also have a stepped difference along the X-axis. The seventh wall 97 is located closer to the second wall 92 side than the third wall 93, i.e., closer to the −X-axis direction side than the third wall 93. An ink injection section 115 is provided between the third wall 93 and the seventh wall 97 in the state where the first wall 91 is seen in plan view from the sheet member 63 side. The ink injection section 115 is provided to the fifth wall 95.

The first communicating passage 73 is provided between the tenth wall 104 and the eleventh wall 105, as illustrated in FIG. 6, and forms communication between the second air chamber 72 and the third air chamber 74. The second communicating passage 75 is provided to the outside of the storage section 68 and of the third air chamber 74. The third communicating passage 76 is provided to the outside of the storage section 68, the first air chamber 71, the second air chamber 72, and the first communicating passage 73. The third air chamber 74 and the storage section 68 are in communication with one another via the second communicating passage 75, the communicating chamber 77, and the third communicating passage 76. A communication port 117 is provided to the ninth wall 103. The first air chamber 71 and the second air chamber 72 are in communication via the communication port 117. The second air chamber 72 is communicated to the first communicating passage 73 via a communication port 119. The third air chamber 74 is communicated to the first communicating passage 73 via the communication port 121. The first communicating passage 73 meanders. The second air chamber 72 is communicated to the third air chamber 74 after having meandered via the first communicating passage 73.

As illustrated in FIG. 7, an extended section 123 is provided to the case 61A. The second communicating passage 75 and the third communicating passage 76 are provided to the extended section 123. The extended section 123 has a site 123A that is extended out toward the Z-axis direction side from the fifth wall 95 along the edge of the opening of the recess 101, in a region of the fifth wall 95 that is closer to the X-axis direction side than the seventh wall 97. The site 123A is also extended out toward the X-axis direction side from the seventh wall 97 along the edge of the opening of the recess 113 in the seventh wall 97. The extended section 123 furthermore has a site 123B that is extended out toward the Z-axis direction side from the eighth wall 98.

The extended section 123 also has a site 123C that is extended out toward the −X-axis direction side from the sixth wall 96 along the edges of the openings of a recess 171 and the recess 111, in the sixth wall 96. The extended section 123 also has a site 123D that is extended out toward the −X-axis direction side from the second wall 92 along the edge of the opening of the recess 101 in the second wall 92. The second communicating passage 75 is configured as a groove 127 that is provided to the extended section 123 at an orientation so as to be concave going toward the side opposite to the sheet member 63 side. The third communicating passage 76 is configured as a groove 129 that is provided to the extended section 123 at an orientation so as to be concave going toward the opposite side to the sheet member 63 side. The groove 127 and the groove 129 are partitioned by a compartmentalizing wall 145 in the site 123B.

The second communicating passage 75 has a communication port 141, as illustrated in FIG. 6. The communication port 141 is an opening section that opens toward the inside of the third air chamber 74. The third air chamber 74 is communicated to the second communicating passage 75 via the communication port 141. The third communicating passage 76 also has a communication port 143. The communication port 143 is an opening section that opens toward the inside of the storage section 68. The third communicating passage 76 is communicated to the storage section 68 via the communication port 143. The second communicating passage 75 and the third communicating passage 76 are in communication with one another via the communicating chamber 77.

Figure 8:
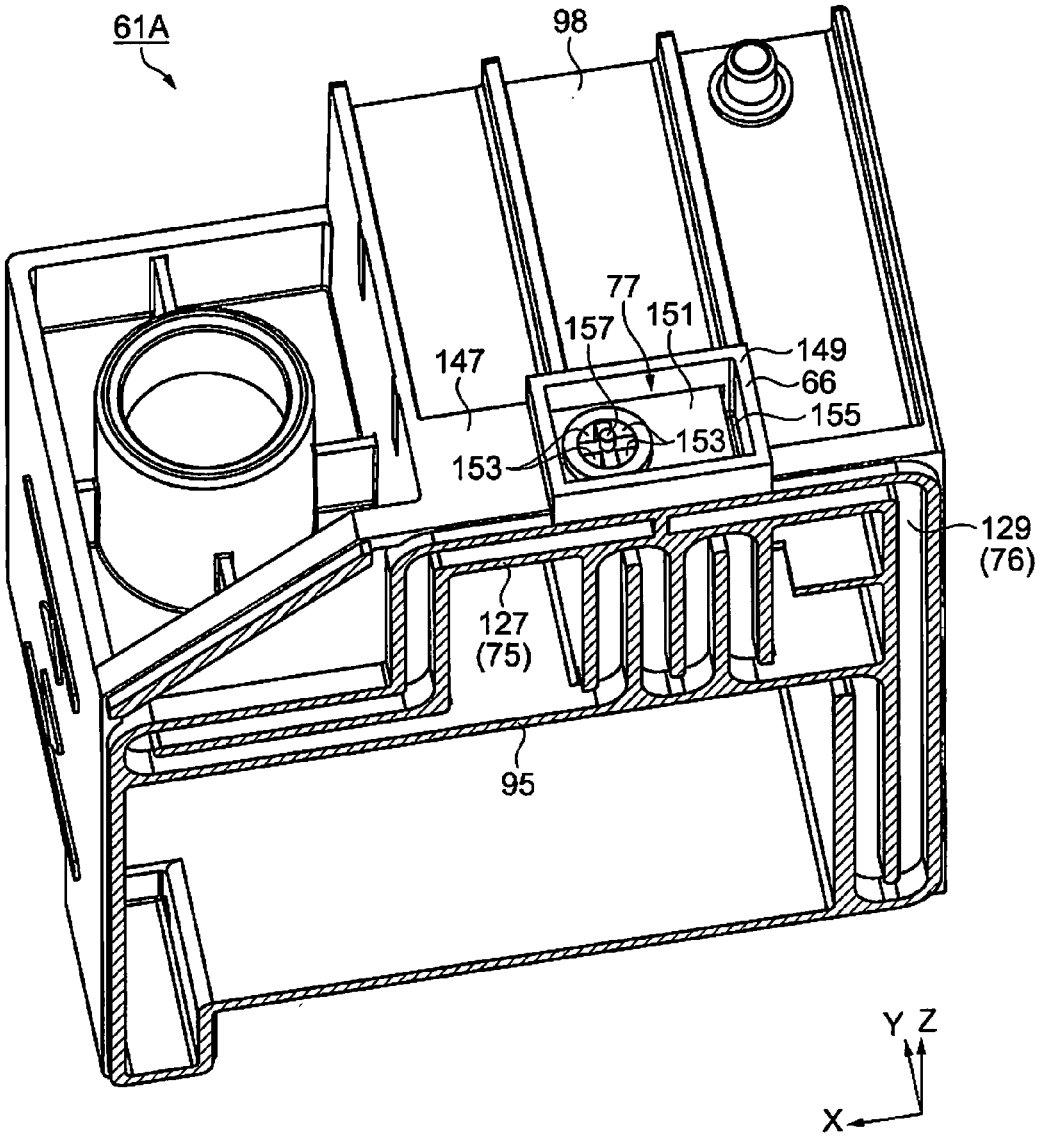
FIG. 8 is a perspective view illustrating a case in a working example 1.

The communicating chamber 77, as illustrated in FIG. 8, is provided to the eighth wall 98. A wall 147 that projects out more to the Z-axis direction than the eighth wall 98 is provided to the eighth wall 98. A surrounding wall 149 surrounding the communicating chamber 77 is provided to the wall 147. The surrounding wall 149 is projected out to the Z-axis direction from the wall 147. A recess 151 is formed by the surrounding wall 149 and the wall 147. The recess 151 opens toward the Z-axis direction. In other words, the recess 151 is formed at an orientation so as to be concave going toward the −Z-axis direction, i.e., toward the fifth wall 95 side. A Z-axis direction-side end of the surrounding wall 149 is set so as to be the previously described bonded section 66. Provided within the recess 151 (the communicating chamber 77) are a through hole 153 and a through hole 155 that perforate through the wall 147. The through hole 153 is communicated to the groove 127 (the second communicating passage 75). The through hole 155 is communicated to the groove 129 (the third communicating passage 76). This causes the second communicating passage 75 and the third communicating passage 76 to be communicated to one another via the communicating chamber 77.

Herein, as illustrated in FIG. 7, the recess 171 is provided to within the recess 101. The recess 171 is provided at an orientation so as to be concave going toward the opposite side to the fifth wall 95 side more than the fourth wall 94, i.e., going toward the −Z-axis direction side more than the fourth wall 94. A connecting section 175 is provided to a wall 173 facing the third wall 93 and the second wall 92, in the recess 171. For this reason, in a state where the first wall 91 is seen in plan view, the connecting section is provided between the third wall 93 and the second wall 92. The supply tube 43 is inserted into the connecting section 175. The connecting section 175 is provided to the wall 173. The connecting section 175 projects out in the −X-axis direction from the wall 173. A supply port 177 (FIG. 6) is formed at the −X-axis direction-side end of the connecting section 175. The supply port 177 is an opening formed in the connecting section 175, and opens toward the outside of the tank 9A from the connecting section 175. The ink injection section 115 and the supply port 177 each form communication between the outside of the case 61A and the inside of the recess 101.

Also, as illustrated in FIG. 7, an air communication section 179 is provided to the eighth wall 98. An air communication port 181 is formed in the air communication section 179. The air communication port 181 is an opening formed in the air communication section 179, and opens toward the outside of the tank 9A from the air communication section 179. The air communication section 179 projects out from the eighth wall 98 to the opposite side to the fifth wall 95 side of the eighth wall 98, i.e., to the Z-axis direction side of the eighth wall 98. The air communication port 181 is provided to a position overlapping with the recess 171 when the eighth wall 98 is seen in plan view, i.e., when the eighth wall 98 is seen in plan view in the XY plane. The air communication port 181 forms communication between the outside of the case 61 and the recess 171. The air communication port 181 and the air communication section 179 are air passages for introducing air outside of the case 61A into the inside of the recess 171. In the case 61A, the bonded section 67 is provided along the respective contours of the recess 101, the recess 109, the recess 111, the recess 113, the recess 171, the first communicating passage 73, the second communicating passage 75, and the third communicating passage 76.

The sheet member 63 faces the first wall 91 across the second wall 92 through eighth wall 98, as illustrated in FIG. 5. The sheet member 63 has a size that covers the recess 101, the recess 109, the recess 111, the recess 113, the recess 171, and the extended section 123 as seen in plan view. The sheet member 63 is welded to the bonded section 67 in a state where there is a gap with the first wall 91 on the other side. This causes the recess 101, the recess 109, the recess 111, the recess 113, the recess 171, the first communicating passage 73, the second communicating passage 75, and the third communicating passage 76 to be sealed by the sheet member 63. For this reason, the sheet member 63 can also be regarded as a covering for the case 61A.

As stated above, the storage section 68 illustrated in FIG. 6 is communicated to the exterior of the tank 9A via the third communicating passage 76, the communicating chamber 77, the second communicating passage 75, the third air chamber 74, the first communicating passage 73, the second air chamber 72, the first air chamber 71, and the air communication port 181. This means that the communicating section 69 forms communication between the air communication port 181 and the storage section 68. Air that has flowed into the first air chamber 71 from the air communication port 181 then flows into the second air chamber 72 via the communication port 117. Air that has flowed into the second air chamber 72 then flows into the first air chamber 74 via the first communicating passage 73. Air that has flowed into the third air chamber 74 then flows into the communicating chamber 77 via the second communicating passage 75. Then, air that has flowed into the communicating chamber 77 flows into the storage section 68 via the third communicating passage 76.

Herein, a shaft section 157 is provided to within the communicating chamber 77 (the recess 151), as illustrated in FIG. 8. The shaft section 157 projects out in the Z-axis direction from the wall 147. The amount by which the shaft section 157 projects out from the wall 147 is less than the amount by which the surrounding wall 149 projects out from the wall 147. For this reason, the shaft section 157 fits inside the recess 151. In the present embodiment, the through hole 153 is provided to the periphery of the shaft section 157. Also, a through hole 159 is formed in the air introduction valve 65, as illustrated in FIG. 5. The shaft section 157 inside the recess 151 (FIG. 8) is inserted into the through hole 159 of the air introduction valve 65 (FIG. 5). The air introduction valve 65 has a size that covers the through hole 153. For this reason, when the shaft section 157 is inserted into the through hole 159 of the air introduction valve 65, the through hole 153 is closed off by the air introduction valve 65.

The air introduction valve 65 interrupts the communicating state between the air communication port 181 and the storage section 68. In the tank 9A, the air introduction valve 65 is provided between the second communicating passage 75 and the communicating chamber 77. For this reason, in the tank 9A, the communicating section 69 is closed between the first communicating section 78 (FIG. 6) and the second communicating section 79 by the air introduction valve 65. The air introduction valve 65 is provided inside the communicating chamber 77. The communicating chamber 77 is included the first communicating section 78. For this reason, the area between the first communicating section 78 (FIG. 6) and the second communicating section 79 is closed from the first communicating section 78 side by the air introduction valve 65.

The ink injection section 115 is provided to the fifth wall 95. The ink injection section 115, as illustrated in FIG. 7, is provided in a recess 183 that is surrounded by the seventh wall 97, the extended section 123, the third wall 93, and the first wall 91. As stated earlier, the extended section 123 projects out closer to the eighth wall 98 side than the fifth wall 95. The seventh wall 97 also projects out closer to the eighth wall 98 side than the fifth wall 95. Similarly, in the case 61A, the first wall 91 and the third wall 93 also each project out closer to the eighth wall 98 side than the fifth wall 95. The extended section 123 intersects with both the seventh wall 97 and the third wall 93. The first wall 91 also intersects with both the third wall 93 and the seventh wall 97. For this reason, a region of the fifth wall 95 that is closer to the third wall 93 side than the seventh wall 97 constitutes the recess 183, which is surrounded by the seventh wall 97, the extended section 123, the third wall 93, and the first wall 91. The recess 183 is provided at an orientation so as to be concave going toward the fourth wall 94 side from the fifth wall 95 side.

Due to the configuration described above, the ink injection section 115 is surrounded by the seventh wall 97, the extended section 123, the third wall 93, and the first wall 91. In other words, the ink injection section 115 is provided to a region of the fifth wall 95 that is surrounded by the seventh wall 97, the extended section 123, the third wall 93, and the first wall 91. The recess 183 then has the function of an ink receiving section. The ink receiving section can receive, for example, ink that overflows from the ink injection section 115, or ink that has dripped down during injection. In this manner, the recess 183 has a function as an ink receiving section for receiving the ink.

Figure 9:
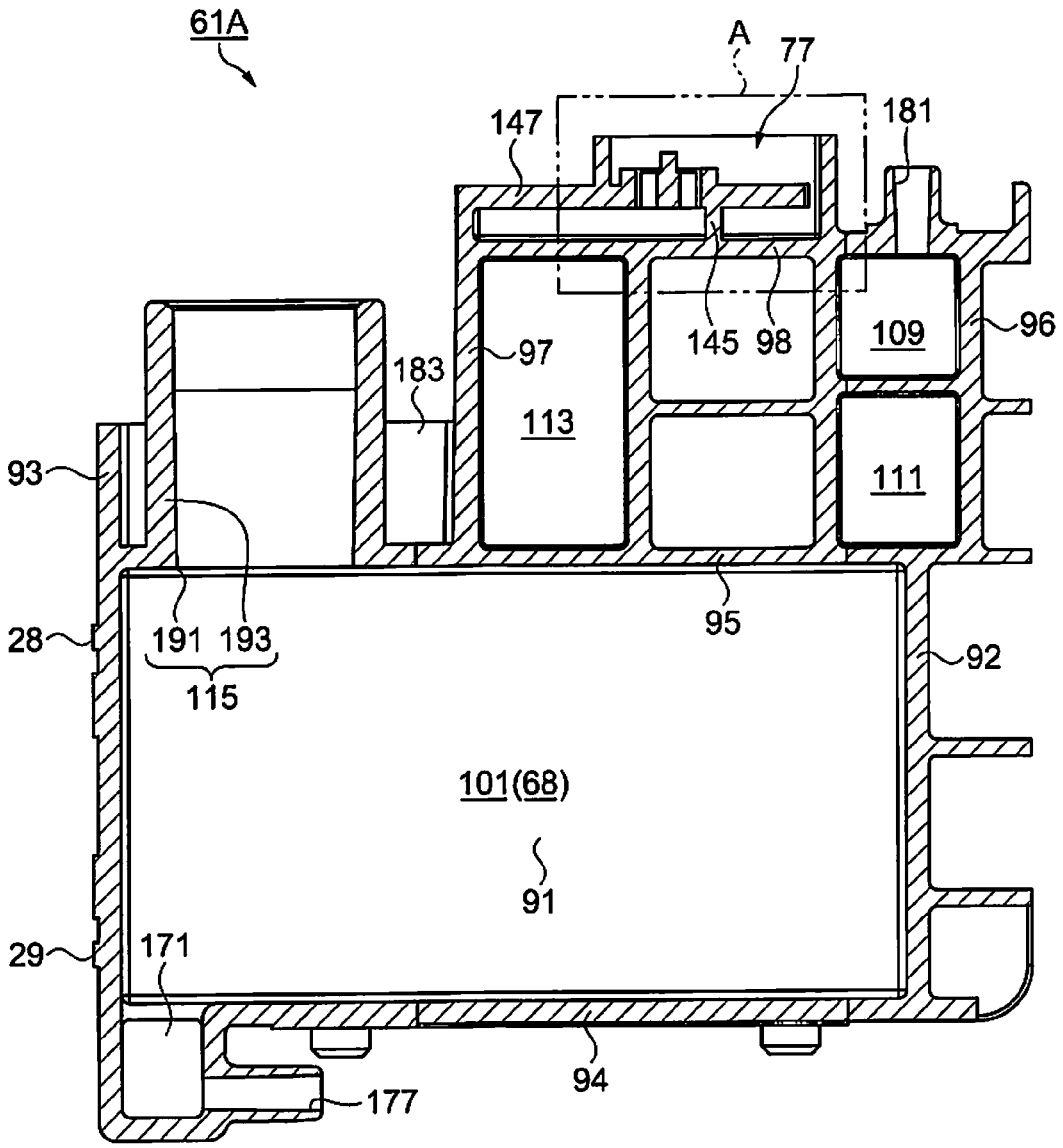
FIG. 9 is a cross-sectional view of when an ink injection section, a supply port, an air communication port, and a communicating chamber in a working example 1 are cut in the XZ plane.

The ink injection section 115 has an opening 191 and a side wall 193, as illustrated in FIG. 9, which is a cross-sectional view of when the ink injection section 115, the supply port 177, the air communication port 181, and the communicating chamber 77 are cut in the XZ plane. The opening 191 is a through hole provided to the fifth wall 95. The opening 191 is also a site of intersection where the ink injection section 115 and the recess 101 (the storage section 68) intersect. A configuration with which the side wall 193 projects out to the inside of the storage section 68 could also be employed as the configuration of the ink injection section 115. In a configuration with which the side wall 193 projects out to the inside of the storage section 68, as well, the site of intersection at which the ink injection section 115 and the storage section 68 intersect together would be defined as being the opening 191. The recess 101 is communicated to the outside of the recess 101 via the opening 191, which is a through hole. The side wall 193 is provided to the opposite side to the fourth wall 94 side of the fifth wall 95, and surrounds the periphery of the opening 191, thus forming an ink injection path. The side wall 193 projects out toward the opposite side to the fourth wall 94 side from the fifth wall 95. In the case 61A, the side wall 193 projects out to opposite sides to the fourth wall 94 side more than each of the first wall 91 and the third wall 93. The side wall 193 makes it possible to prevent ink that has collected in the recess 183 from flowing into the opening 191.

Figure 10:
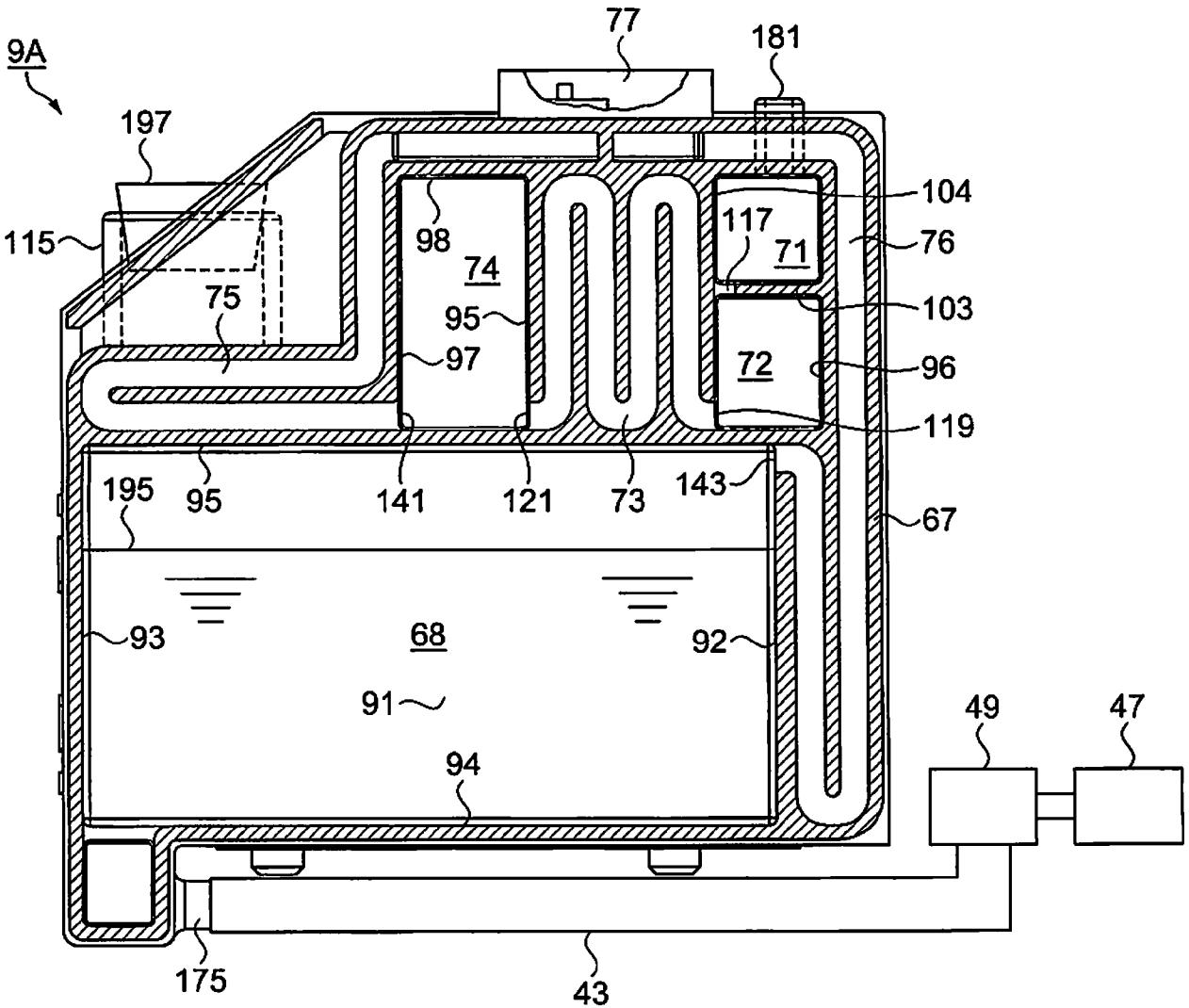
FIG. 10 is a side view of when a tank in a working example 1 is seen from a sheet member side.

In the tank 9A, an ink 195 is stored in the interior of the storage section 68, as illustrated in FIG. 10, which is a side view of when the tank 9A is seen from the sheet member 63 side. FIG. 10 omits any depiction of the sheet member 63 and depicts the bonded section 67 with hatching in order to illustrate the configuration in a manner that is easy to understand. The ink 195 inside the storage section 68 is supplied to the print head 47 from the supply port 177. In the present embodiment, in the state where the printer 3 is used for printing, the supply tube 43 is connected to the connecting section 175, and the ink injection section 115 receives a cap 197. The ink 195 inside the recess 101 (the storage section 68) is suctioned through inside the supply tube 43 via the relay unit 49, and thereby reaches the print head 47 from the supply port 177.

Figure 11:
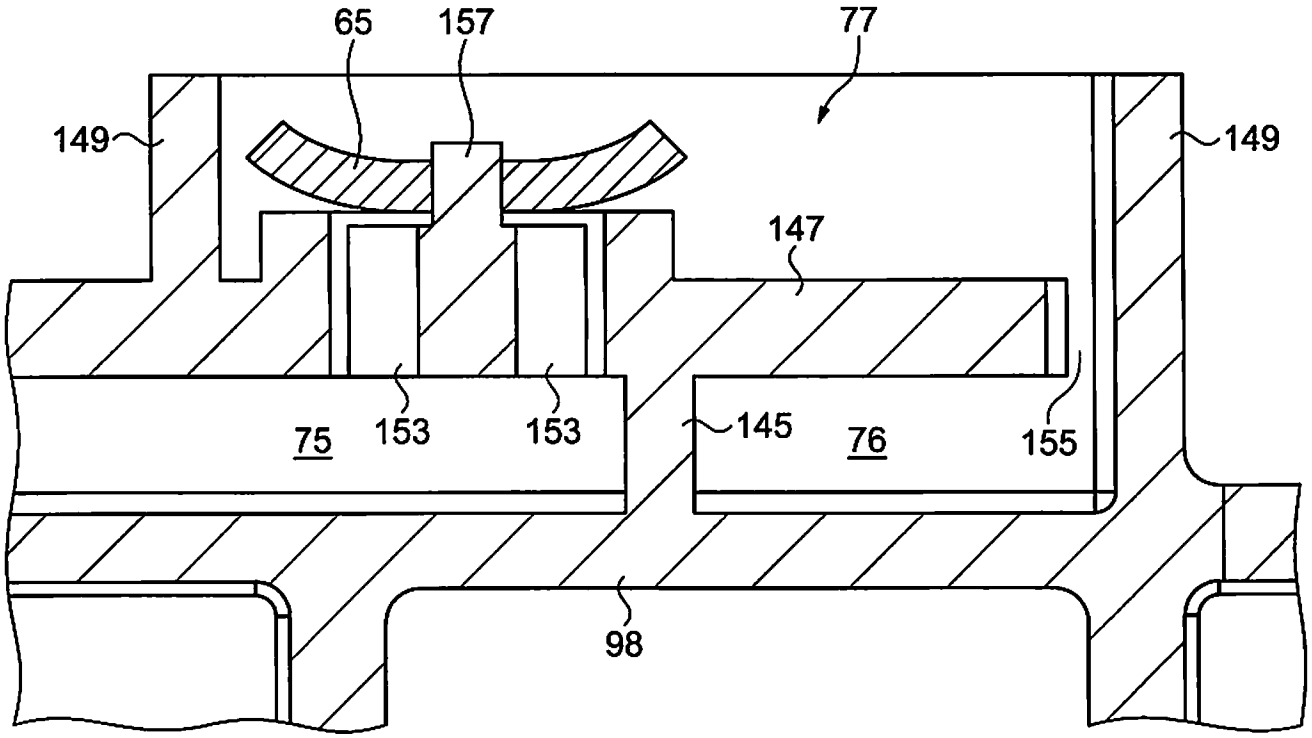
FIG. 11 is an enlarged view of an A section in FIG. 9.

In association with the printing by the print head 47, the ink 195 inside the storage section 68 is sent to the print head 47 side. For this reason, the pressure inside the storage section 68 becomes lower than the atmospheric pressure in association with the printing by the print head 47. When the pressure inside the storage section 68 becomes lower than the atmospheric pressure, then the pressure difference between the second communicating passage 75 and the third communicating passage 76 causes the air introduction valve 65 to bend from the second communicating passage 75 side toward the third communicating passage 76 side, as illustrated in FIG. 11, which is enlarged view of the A section in FIG. 9. This causes the through hole 153 to be opened and forms communication between the second communicating passage 75 and the communicating chamber 77. As a result, there is opening between the second communicating section 79 and the first communicating section 78.

This causes the air inside the third air chamber 75 to be sent into the storage section 68 by way of the second communicating passage 75, the communicating chamber 77, and the third communicating passage 76. This makes it easy for the pressure inside the storage section 68 to be kept at atmospheric pressure. When the pressure inside the storage section 68 is close to the atmospheric pressure, the deformation of the air introduction valve 65 is reverted due to the elasticity. This creates a closure between the second communicating section 79 and the first communicating section 78 when the pressure inside the storage section 68 is close to the atmospheric pressure. The air flows into the third air chamber 74 from the air communication port 181 by way of the first air chamber 71, the second air chamber 72, and the first communicating passage 73, in the stated order. By the above, the ink 195 inside the tank 9A is supplied to the print head 47. When the ink 195 inside the storage section 68 in the tank 9A is consumed and little of the ink 195 remains, then the worker can refill the inside of the storage section 68 with new ink from the ink injection section 115.

Figure 12:
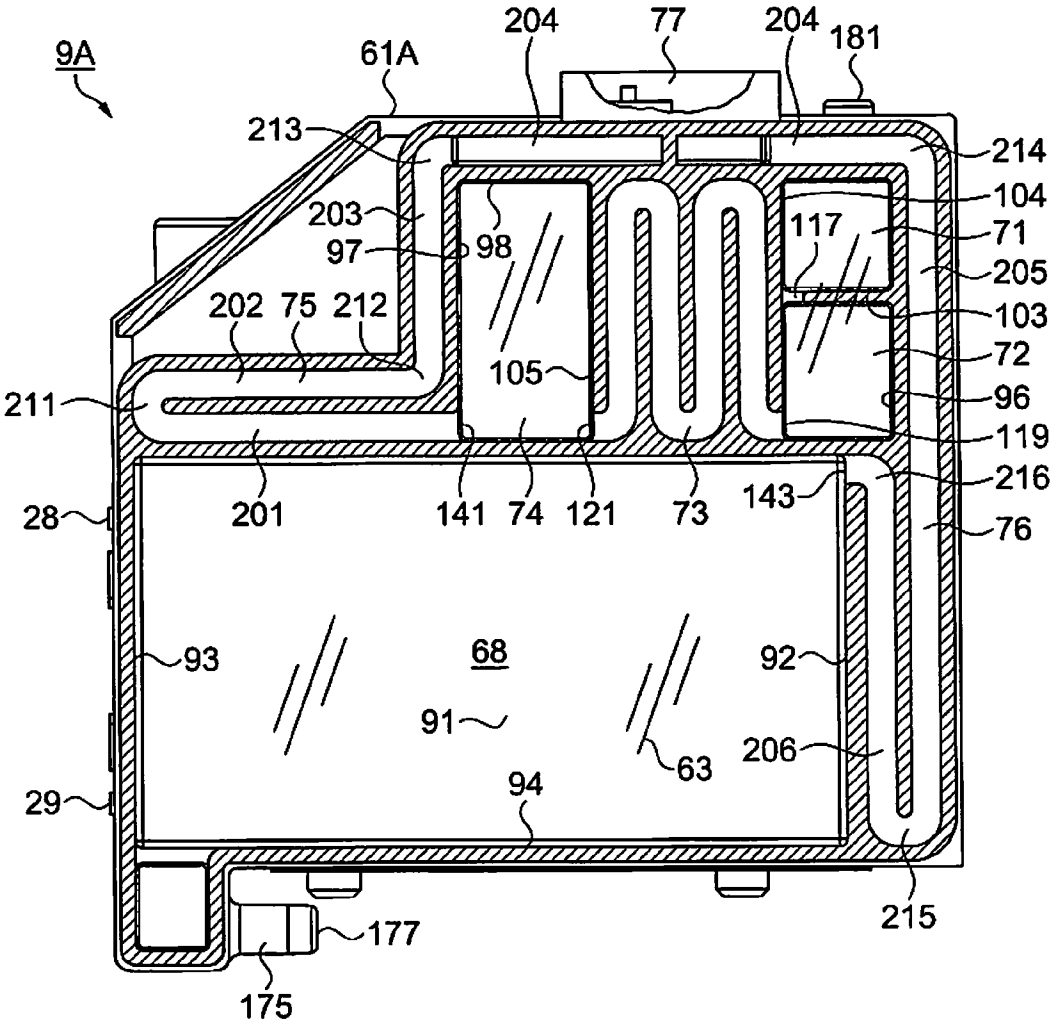
FIG. 12 is a side view of when a tank in a working example 1 is seen from a sheet member side.

The second communicating passage 75 and the third communicating passage 76 can be demarcated, as illustrated in FIG. 12, into a first passage 201, a second passage 202, a third passage 203, a fourth passage 204, a fifth passage 205, and a sixth passage 206. The first passage 201 originates at the communication port 141 and goes toward the third wall 93 along the fifth wall 95, i.e., along the X-axis. The first passage 201 leads from the communication port 141 to a reversal section 211. The reversal section 211 is a site at which the orientation of the flow path in the second communicating passage 75 is reversed. At the reversal section 211, the orientation of the flow path is reversed from the X-axis direction to the −X-axis direction. In the route taken by the air from the air communication port 181 leading to the storage section 68, the air communication port 181 side is understood to be an upstream side and the communication port 143 side is understood to be a downstream side.

The second passage 202 goes toward the seventh wall 97 from the reversal section 211 along the direction of extension of the first passage 201, i.e., along the X-axis. The second passage 202 leads to a bend section 212 from the reversal section 211. The bend section 212 is a site at which the orientation of the flow path in the second communicating passage 75 is bent. At the bend section 212, the orientation of the flow path is bent from the −X-axis direction to the Z-axis direction. The third passage 203 goes from the bend section 212 toward the eighth wall 98 along the seventh wall 97, i.e., along the Z-axis. The third passage 203 leads from the bend section 212 to a bend section 213. The bend section 213 is a site at which the orientation of the flow path in the second communicating passage 75 is bent. At the bend section 213, the orientation of the flow path is bent from the Z-axis direction to the −X-axis direction.

The fourth passage 204 goes from the bend section 213 toward the sixth wall 96 along the eighth wall 98, i.e., along the X-axis. In the Z-axis direction, the fourth passage 204 is located above the third air chamber 74. The fourth passage 204 leads from the bend section 213 to a bend section 214. In the tank 9A, the fourth passage 204 leads from the bend section 213 to the bend section 214 by way of the communicating chamber 77. The bend section 214 is a site at which the orientation of the flow path in the third communicating passage 76 is bent. At the bend section 214, the orientation of the flow path is bent from the X-axis direction to the −Z-axis direction. The fifth passage 205 goes from the bend section 214 toward the fourth wall 94 along the sixth wall 96, i.e., along the Z-axis. The fifth passage 205 leads from the bend section 214 to a reversal section 215. The reversal section 215 is a site at which the orientation of the flow path in the third communicating passage 76 is reversed. At the reversal section 215, the orientation of the flow path is reversed from the −Z-axis direction to the Z-axis direction. The sixth passage 206 goes from the reversal section 215 toward the fifth wall 95 along the second wall 92, i.e., along the Z-axis direction. The sixth passage 206 leads from the reversal section 215 to a bend section 216. The bend section 216 is a site at which the orientation of the flow path in the third communicating passage 76 is bent. At the bend section 216, the orientation of the flow path is bent from the Z-axis direction to the X-axis direction. The third communicating passage 76 is communicated to the storage section 68 via the communication port 143 after having bent at the bend section 216.

As stated above, in the Z-axis direction, the fourth passage 204 is located above the third air chamber 74. In other words, a part of the third communicating passage 76 is located above the third air chamber 74. According to this configuration, the ink that has flowed into the third communicating passage 76 from the storage section 68 will less readily rise above the third air chamber 74, due to the action of gravity. For this reason, the ink that has flowed into the third communicating passage 76 from the storage section 68 will less readily reach the third air chamber 74. As a result, it is easier to prevent ink that has flowed from the storage section 68 into the third communicating passage 76 from leaking out from the tank 9A.

In the tank 9A, the third passage 203 and the fifth passage 205 are located at opposite sides to one another across the third air chamber 74 along the X-axis. According to this configuration, the route of the second communicating passage 75 can be lengthened by putting the space surrounding the third air chamber 74 to use and forming the second communicating passage 75 so as to run around the periphery of the third air chamber 74. Lengthening the route of the second communicating passage 75 is preferable in that a liquid component of the ink in the storage section 68 is less readily evaporated, and so forth.

The reversal section 215 is a site at which the orientation of the flow path in the third communicating passage 76 is reversed. At the reversal section 215, the orientation of the flow path is reversed from the −Z-axis direction to the Z-axis direction. The sixth passage 206 goes from the reversal section 215 toward the fifth wall 95 along the second wall 92, i.e., along the Z-axis direction. The sixth passage 206 leads from the reversal section 215 to the communication port 143 by way of the bend section 216. The bend section 216 is a site at which the orientation of the flow path in the third communicating passage 76 is bent. The third communicating passage 76 is communicated to inside the storage section 68 via the communication port 143 after the orientation of the flow path has bent at the bend section 216 from the Z-axis direction to the X-axis direction.

In the working example 1, the case 61A corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section.

In the working example 1, the air introduction valve 65 is provided between the storage section 68 and the air communication port 181. Therefore, even when, for example, the ink inside the storage section 68 flows back toward the air communication port 181 side, the air introduction valve 65 blocks the backflow ink. This makes it easy to prevent the ink inside the storage section 68 from reaching the air communication port 181. As a result, it is easier to avoid an event were the ink inside the storage section 68 leaks out from the air communication port 181 to outside the tank 9A.

Working Example 2

Figure 13:
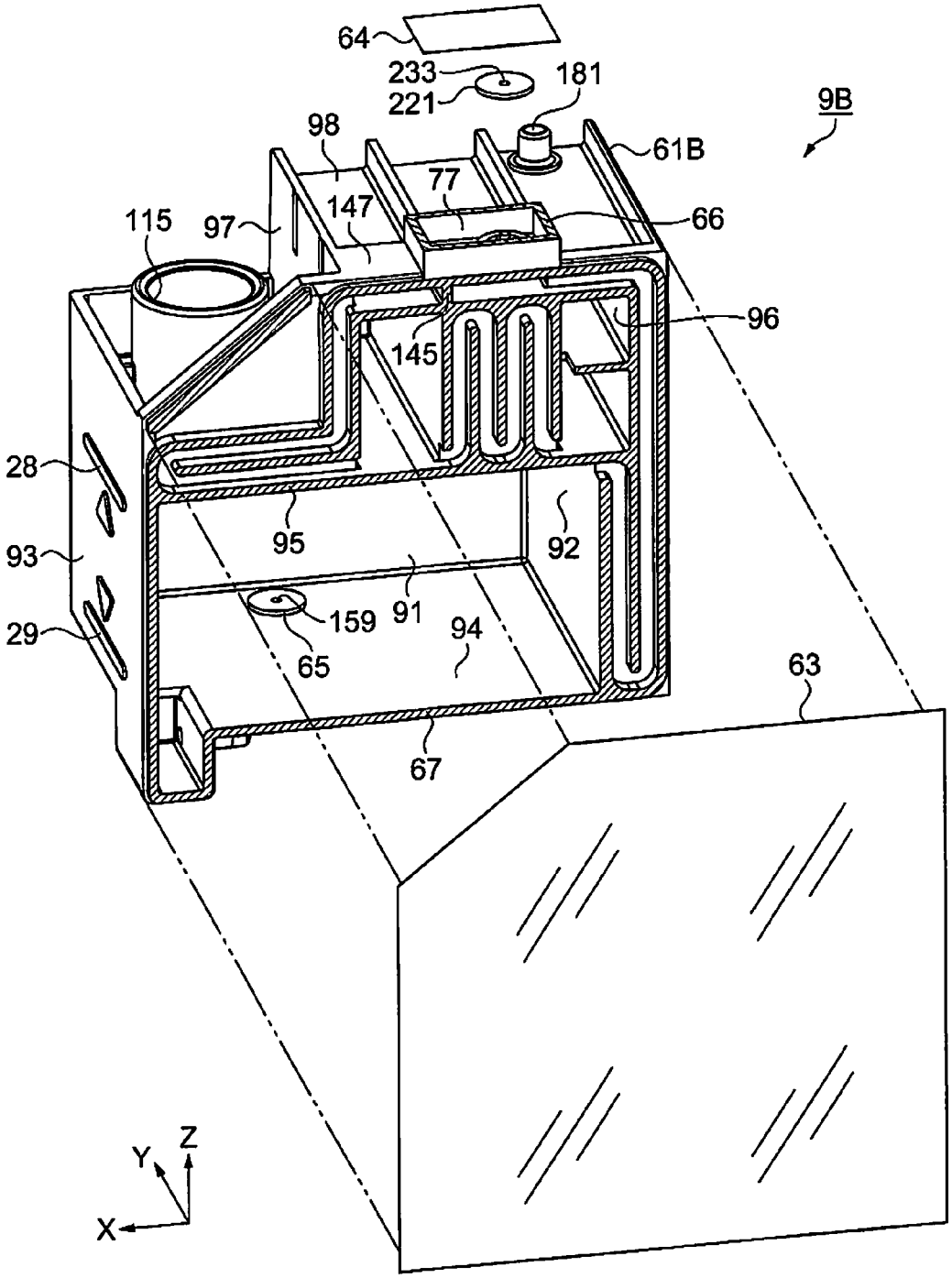
FIG. 13 is an exploded perspective view illustrating a tank in a working example 2.

A tank 9B in a working example 2 shall now be described. The working example 2 omits a detailed description of configurations that are identical to the working example 1, and assigns thereto the same reference signs as in the working example 1. The tank 9B, as illustrated in FIG. 13, has a case 61B that is one example of a tank main body, as well as the sheet member 63, the sheet member 64, the air introduction valve 65, and an air release valve 221. The case 61B is constituted of, for example, a synthetic resin such as nylon or polypropylene. The sheet member 63, the sheet member 64, and the air introduction valve 65 are similar to the working example 1 and a description thereof is accordingly omitted here. The air release valve 221 is constituted of a material that is elastic, such as, for example, a rubber or elastomer, and presents with a planar shape. The air release valve 221 is provided within the communicating chamber 77. In the working example 2, the air introduction valve 65 is provided within the storage section 68.

The bonded section 67 and the bonded section 66 are provided to the case 61B in the same manner as in the working example 1. The sheet member 63 is bonded to the bonded section 67 and the sheet member 64 is bonded to the bonded section 66. The tank 9B possesses a configuration where the case 61B and the sheet member 63 are bonded together and the case 61B and the sheet member 64 are also bonded together.

Figure 14:
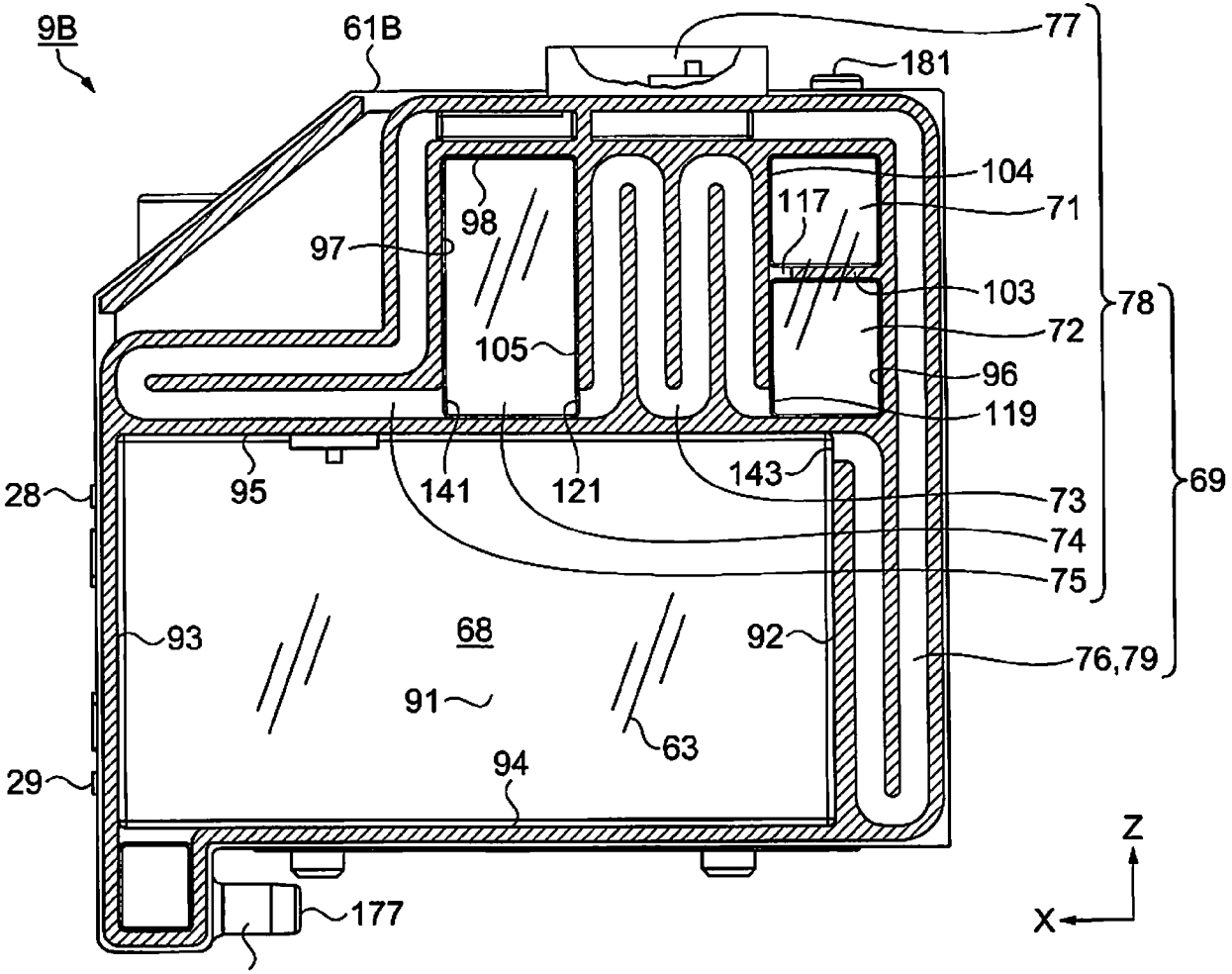
FIG. 14 is a side view of when a tank in a working example 2 is seen from a sheet member side.

Similarly to the working example 1, the tank 9B has the storage section 68 and the communicating section 69, as illustrated in FIG. 14. The communicating section 69 has the first air chamber 71, the second air chamber 72, the first communicating passage 73, the third air chamber 74, the second communicating passage 75, the third communicating passage 76, and the communicating chamber 77. In the tank 9B, as well, the communicating section 69 can be demarcated into the first communicating section 78 and the second communicating section 79. However, the tank 9B differs from the tank 9A of the working example 1 in that the communicating chamber 77 is included in the first communicating section 78. In other words, in the tank 9B, the first communicating section 78 includes the first air chamber 71, the second air chamber 72, the first communicating passage 73, the third air chamber 74, the second communicating passage 75, and the communicating chamber 77. The second communicating section 79 also includes the third communicating passage 76. In the tank 9B, as well, the ink is stored inside the storage section 68. FIG. 14 illustrates a state where the tank 9B is seen from the sheet member 63 side, and depicts the case 61B with the sheet member 63 therebetween. The storage section 68, the first air chamber 71, the second air chamber 72, the first communicating passage 73, the third air chamber 74, the second communicating passage 75, and the third communicating passage 76 are partitioned from one another by the bonded section 67.

Similarly to the working example 1, the case 61B has the first wall 91, the second wall 92, the third wall 93, the fourth wall 94, the fifth wall 95, the sixth wall 96, the seventh wall 97, and the eighth wall 98. In the case 61B, the arrangement of the first wall 91 through eighth wall 98 is similar to in the working example 1. The arrangement of the storage section 68, the first air chamber 71, the second air chamber 72, the first communicating passage 73, the third air chamber 74, the second communicating passage 75, the third communicating passage 76, and the communicating chamber 77 in the tank 9B is also similar to in the working example 1.

Figure 15:
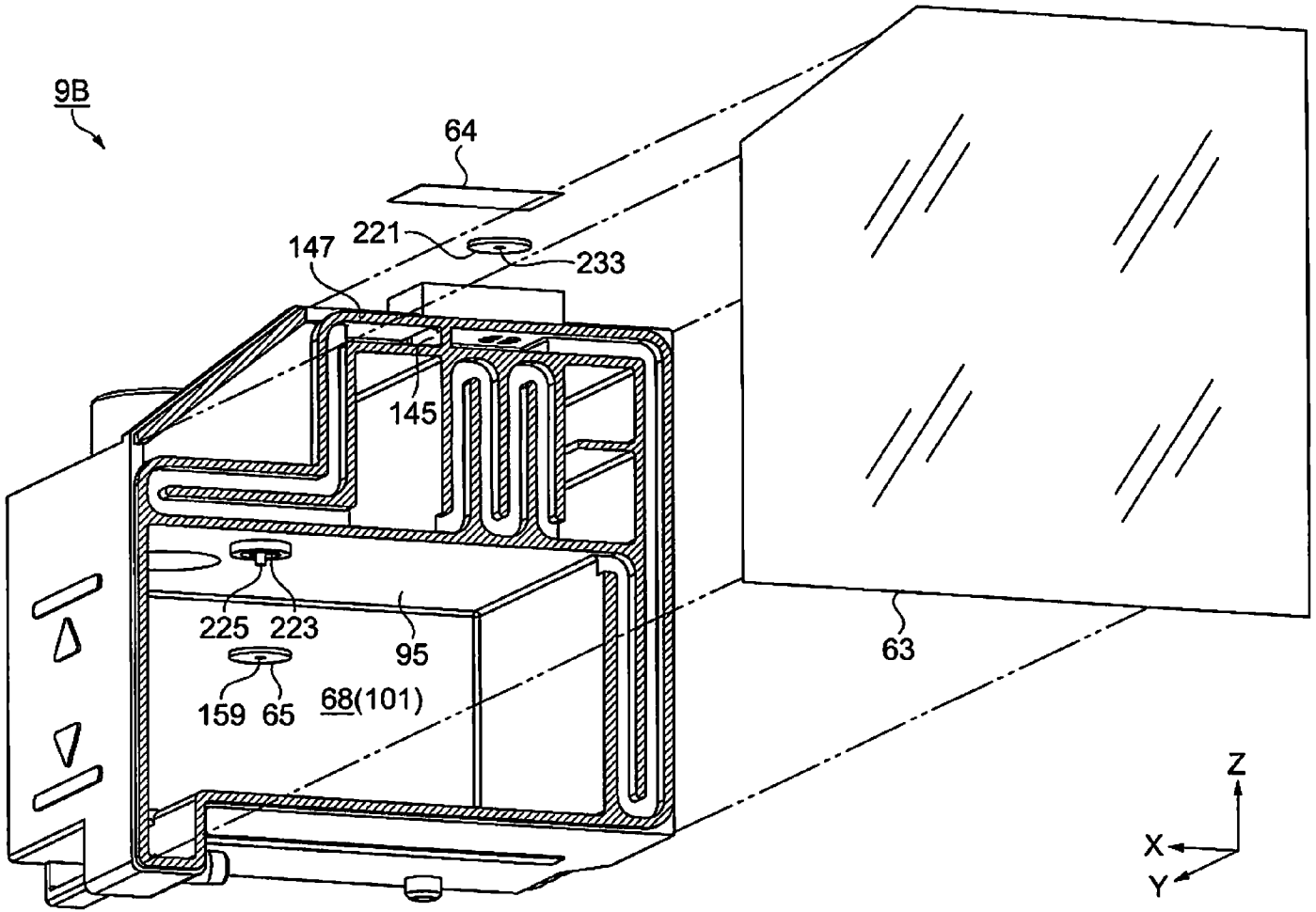
FIG. 15 is an exploded perspective view illustrating a tank in a working example 2.

In the working example 2, the air introduction valve 65 is provided to the fifth wall 95 within the storage section 68 (the recess 101), as illustrated in FIG. 15. A through hole 223 that perforates through the fifth wall 95 is formed in the fifth wall 95. The through hole 223 perforates through the fifth wall 95 and leads from within the storage section 68 (the recess 101) to within the recess 183 (FIG. 13). For this reason, the storage section 68 (the recess 101) is communicated to the recess 183 via the through hole 223. The storage section 68 (the recess 101) is communicated to the outside of the tank 9B via the through hole 223.

A shaft section 225 is provided to the fifth wall 95 within the storage section 68 (the recess 101), as illustrated in FIG. 15. The shaft section 225 projects out in the −Z-axis direction from the fifth wall 95. The through hole 223 is provided to the periphery of the shaft section 225. The through hole 159 of the air introduction valve 65 is inserted onto the shaft section 225. The air introduction valve 65 has a size that covers the through hole 223. For this reason, when the through hole 159 of the air introduction valve 65 is inserted onto the shaft section 225, the through hole 223 is closed off by the air introduction valve 65. The air introduction valve 65 interrupts the communicating state between the exterior of the tank 9B and the storage section 68.

Figure 16:
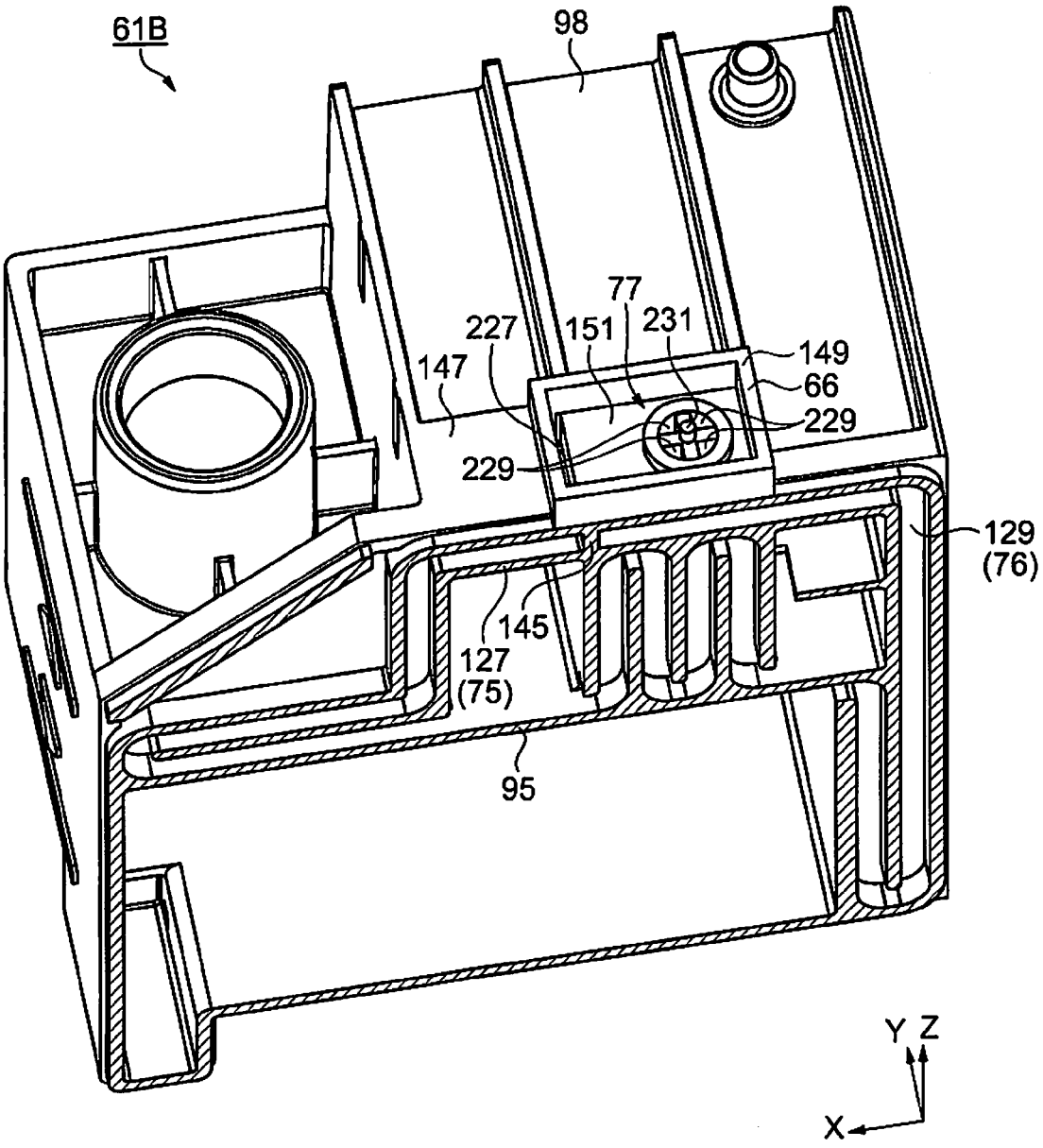
FIG. 16 is a perspective view illustrating a case in a working example 2.

Similarly to the working example 1, the communicating chamber 77 is provided to the eighth wall 98, as illustrated in FIG. 16. The wall 147 that projects out more to the Z-axis direction than the eighth wall 98 is provided to the eighth wall 98. The surrounding wall 149 that surrounds the communicating chamber 77 is provided to the wall 147. The surrounding wall 149 projects out in the Z-axis direction from the wall 147. The recess 151 is formed by the surrounding wall 149 and the wall 147. The Z-axis direction-side end of the surrounding wall 149 is set so as to be the previously described bonded section 66. Provided within the recess 151 (the communicating chamber 77) are a through hole 227 and a through hole 229 that perforate through the wall 147. The through hole 227 is communicated to the groove 127 (the second communicating passage 75). The through hole 229 is communicated to the groove 129 (the third communicating passage 76). This causes the second communicating passage 75 and the third communicating passage 76 to be communicated to one another via the communicating chamber 77.

A shaft section 231 is provided within the communicating chamber 77 (the recess 151). The shaft section 231 projects out in the Z-axis direction from the wall 147. The amount by which the shaft section 231 projects out from the wall 147 is less than the amount by which the surrounding wall 149 projects out from the wall 147. For this reason, the shaft section 231 fits inside the recess 151. In the present embodiment, the through hole 229 is provided to the periphery of the shaft section 231. A through hole 233 is also formed in the air release valve 221, as illustrated in FIG. 13. The through hole 233 of the air release valve 221 (FIG. 13) is inserted onto the shaft section 231 of the recess 151 (FIG. 16). The air release valve 221 has a size that covers the through hole 229. For this reason, when the through hole 233 of the air release valve 221 is inserted onto the shaft section 231, the through hole 229 is closed off by the air release valve 221.

The air release valve 221 interrupts the communicating state between the air communication port 181 and the storage section 68. In the tank 9B, the air release valve 221 is provided between the communicating chamber 77 and the third communicating passage 76. For this reason, in the tank 9B, the communicating section 69 is closed between the first communicating section 78 (FIG. 14) and the second communicating section 79 by the air release valve 221. The air release valve 221 is provided within the communicating chamber 77. In the tank 9B, the communicating chamber 77 is included in the second communicating section 79. For this reason, the area between the first communicating section 78 (FIG. 14) and the second communicating section 79 is closed from the second communicating section 79 side by the air release valve 221.

Figure 17:
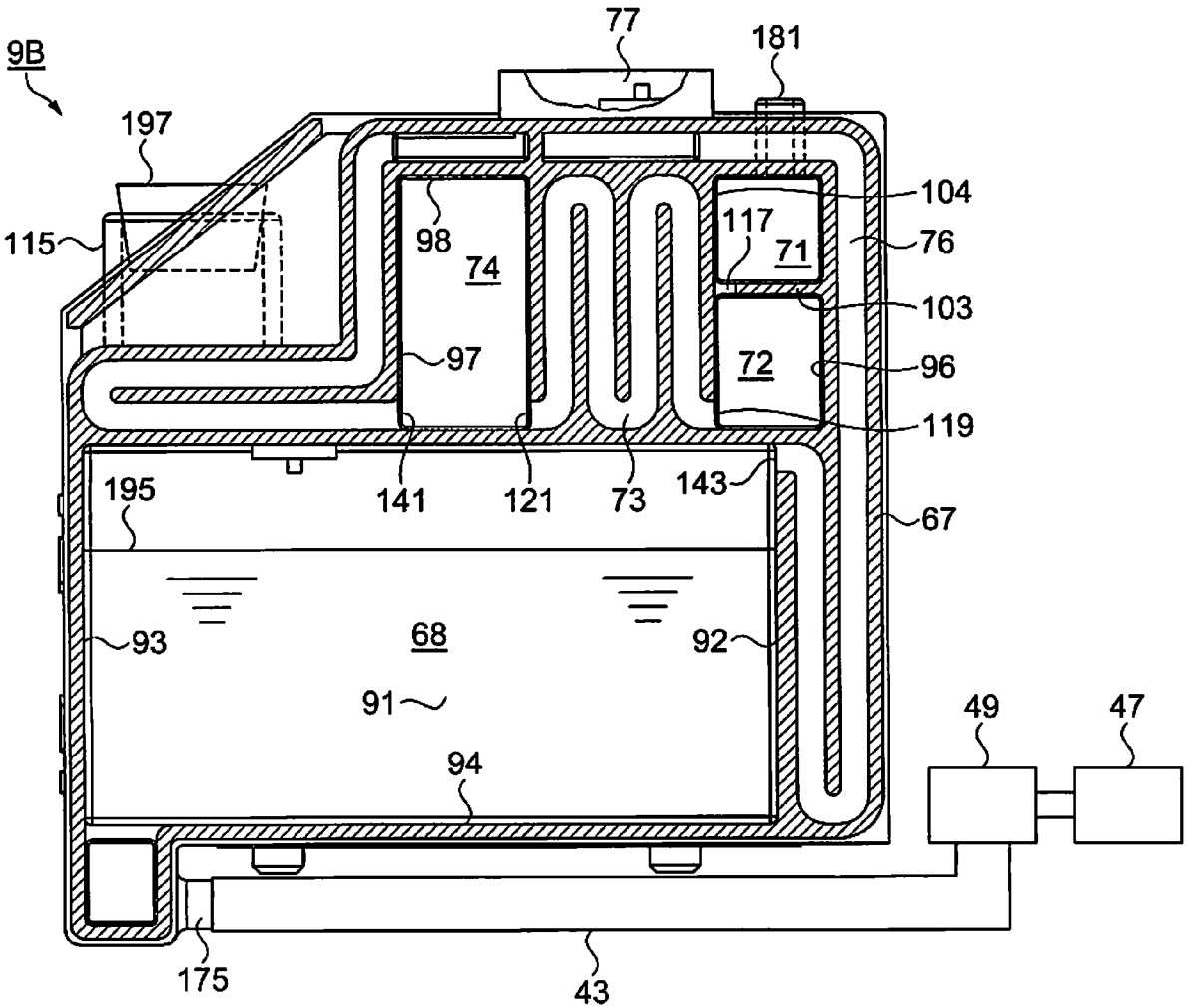
FIG. 17 is a side view of when a tank in a working example 2 is seen from a sheet member side.
Figure 18:
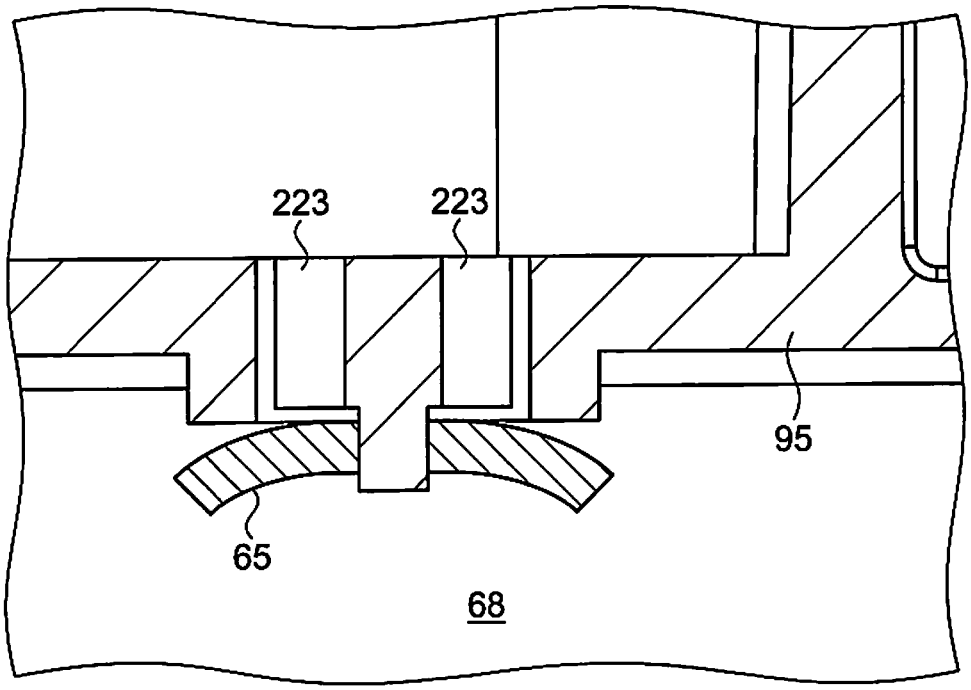
FIG. 18 is a cross-sectional view of when an air introduction valve and a through hole in a working example 2 are cut in the XZ plane.

In the tank 9B, as well, similarly to the working example 1, the ink 195 inside the storage section 68 is supplied to the print head 47 from the supply port 177, as illustrated in FIG. 17, which is a side view of when the tank 9B is viewed from the sheet member 63 side. In association with the printing by the print head 47, the ink 195 inside the storage section 68 is sent to the print head 47 side. For this reason, the pressure inside the storage section 68 becomes lower than the atmospheric pressure in association with the printing by the print head 47. When the pressure inside the storage section 68 becomes lower than the atmospheric pressure, then the pressure difference between the pressure inside the storage section 68 and the atmospheric pressure causes the air introduction valve 65 to bend from the fifth wall 95 side toward the storage section 68 side, as illustrated in FIG. 18, which is a cross-sectional view of when the air introduction valve 65 and the through hole 223 are cut in the XZ plane. This causes the through hole 223 to be opened, and creates communication between the exterior of the tank 9B and the interior of the storage section 68. This causes the air of the exterior of the tank 9B to be sent to inside the storage section 68 through the through hole 223. This makes it easy for the pressure inside the storage section 68 to be kept at atmospheric pressure. When the pressure inside the storage section 68 is close to the atmospheric pressure, the deformation of the air introduction valve 65 is reverted due to the elasticity. This causes the through hole 223 to be closed when the pressure inside the storage section 68 is close to the atmospheric pressure.

In the working example 2, even when the pressure inside the storage section 68 becomes lower than the atmospheric pressure, the pressure inside the communicating chamber 77 (FIG. 16) will still be higher than the pressure inside the third communicating passage 76, and therefore a force that is pressed against (pulled toward) the third communicating passage 76 side, i.e., the wall 147 side acts on the air release valve 221 (FIG. 13). For this reason, in the tank 9B, a state where the through hole 229 is closed by the air release valve 221 is maintained even when the pressure inside the storage section 68 becomes lower than the atmospheric pressure.

Conversely, when the pressure inside the storage section 68 rises above the atmospheric pressure, the pressure inside the communicating chamber 77 is lower than the pressure inside the third communicating passage 76, and therefore the pressure difference between the second communicating passage 75 and the third communicating passage 76 causes the air release valve 221 to bend toward from the third communicating passage 76 side toward the second communicating passage 75 side. This causes the through hole 229 to be opened and forms communication between the third communicating passage 76 and the communicating chamber 77. As a result, there is opening between the second communicating section 79 and the first communicating section 78. This causes the air inside the storage section 68 to be discharged to the exterior of the tank 9B from the through hole 229 by way of the first communicating section 78. This makes it easy for the pressure inside the storage section 68 to be kept at atmospheric pressure. When the pressure inside the storage section 68 is close to the atmospheric pressure, the deformation of the air release valve 221 is reverted due to the elasticity. This causes the through hole 229 to be closed when the pressure inside the storage section 68 is close to the atmospheric pressure. One conceivable example of an instance where the pressure inside the storage section 68 would rise above the atmospheric pressure would be when the ambient temperature rises. When the ambient temperature rises, the air inside the storage section 68 may sometimes swell, as may the ink, and therefore the pressure inside the storage section 68 may sometimes increase.

In the working example 2, the case 61B corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Effects similar to those of the working example 1 are also obtained in the working example 2.

In the working example 2, the air introduction valve 65 is provided between the storage section 68 and the exterior of the tank 9B. The air introduction valve 65 prevents air from moving from inside the storage section 68 to the exterior of the tank 9B via the through hole 223. For this reason, the air introduction valve 65 prevents the ink inside the storage section 68 from moving from inside the storage section 68 to the exterior of the tank 9B via the through hole 223. In other words, even when, for example, the ink inside the storage section 68 seems to be trying to leak out to the exterior of the tank 9B from the through hole 223, the ink attempt to leak out from the through hole 223 to the exterior of the tank 9B is blocked by the air introduction valve 65. This makes it easy to avoid an event where the ink inside the storage section 68 leaks out of the tank 9B.

Also, in the working example 2, the air release valve 221 is provided between the storage section 68 and the air communication port 181. For this reason, in a case where, for example, the pressure inside the storage section 68 rises above the atmospheric pressure, the air inside the storage section 68 can be prevented from being discharged from the air communication port 181 via the communicating section 69. This makes it easy to maintain the pressure inside the storage section 68 at the atmospheric pressure.

Working Example 3

Figure 19:
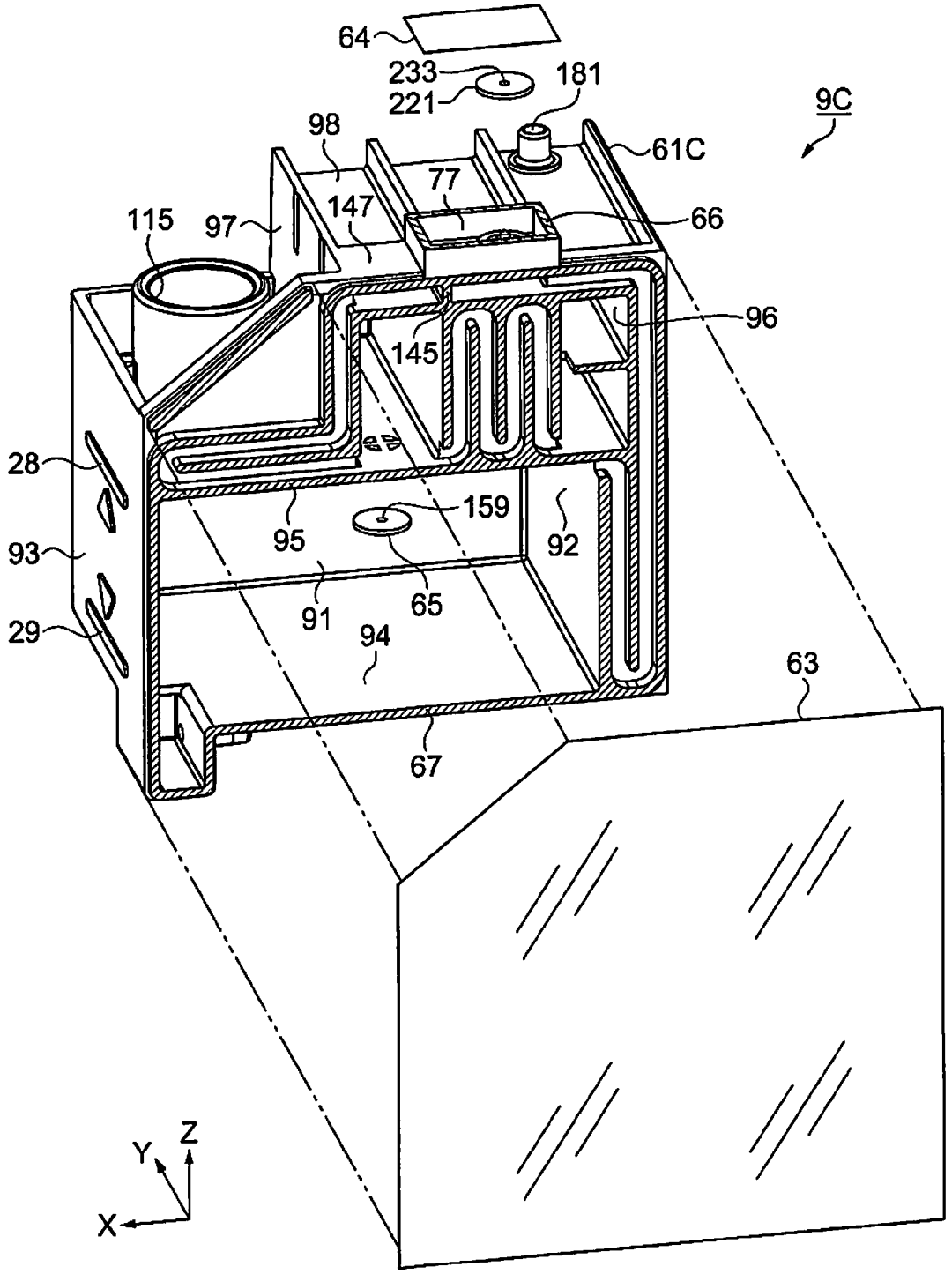
FIG. 19 is an exploded perspective view illustrating a tank in a working example 3.

A tank 9C in a working example 3 shall now be described. The working example 3 has a similar configuration to that of the working example 2, except in that the position of the air introduction valve 65 is different. For this reason, the working example 3 omits a detailed description of configurations that are identical to the working example 1 or the working example 2, and assigns thereto the same reference signs as in the working example 1 or the working example 2. The tank 9C, as illustrated in FIG. 19, has a case 61C that is one example of a tank main body, as well as the sheet member 63, the sheet member 64, the air introduction valve 65, and the air release valve 221.

The case 61C is constituted of, for example, a synthetic resin such as nylon or polypropylene. The sheet member 63, the sheet member 64, the air introduction valve 65, and the air release valve 221 are similar to the working example 1 and the working example 2 and a description thereof is accordingly omitted here. Similarly to the working example 1 and the working example 2, the bonded section 67 and the bonded section 66 are provided to the case 61C. The sheet member 63 is bonded to the bonded section 67 and the sheet member 64 is bonded to the bonded section 66. The air introduction valve 65 is provided within the storage section 68. In the working example 3, the air introduction valve 65 is provided to a region of the fifth wall 95 that overlaps with the third air chamber 74 along the Z-axis.

Figure 20:
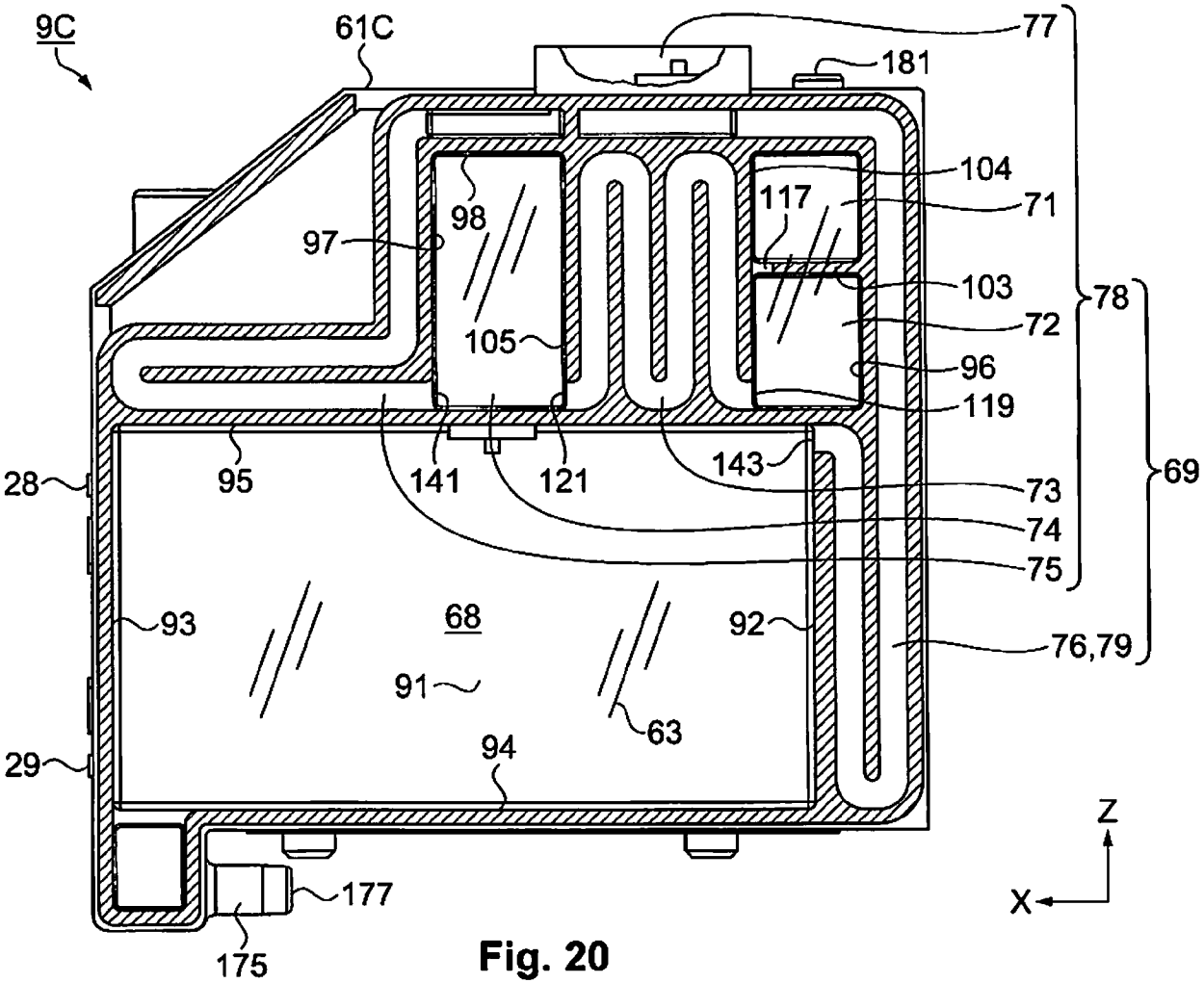
FIG. 20 is a side view of when a tank in a working example 3 is seen from a sheet member side.

Similarly to the working example 1, the tank 9C has the storage section 68 and the communicating section 69, as illustrated in FIG. 20. The communicating section 69 has the first air chamber 71, the second air chamber 72, the first communicating passage 73, the third air chamber 74, the second communicating passage 75, the third communicating passage 76, and the communicating chamber 77. In the tank 9C, as well, the communicating section 69 can be demarcated into the first communicating section 78 and the second communicating section 79. Similarly to the working example 2, in the tank 9C, the first communicating section 78 includes the first air chamber 71, the second air chamber 72, the first communicating passage 73, the third air chamber 74, the second communicating passage 75, and the communicating chamber 77. The second communicating section 79 also includes the third communicating passage 76. In the tank 9C, as well, the ink is stored inside the storage section 68. FIG. 20 depicts a state where the tank 9C is viewed from the sheet member 63 side.

Similarly to the working example 1, the case 61C has the first wall 91, the second wall 92, the third wall 93, the fourth wall 94, the fifth wall 95, the sixth wall 96, the seventh wall 97, and the eighth wall 98. In the case 61C, the arrangement of the first wall 91 through eighth wall 98 is similar to in the working example 1. The arrangement of the storage section 68, the first air chamber 71, the second air chamber 72, the first communicating passage 73, the third air chamber 74, the second communicating passage 75, the third communicating passage 76, and the communicating chamber 77 in the tank 9C is also similar to in the working example 1.

Figure 21:
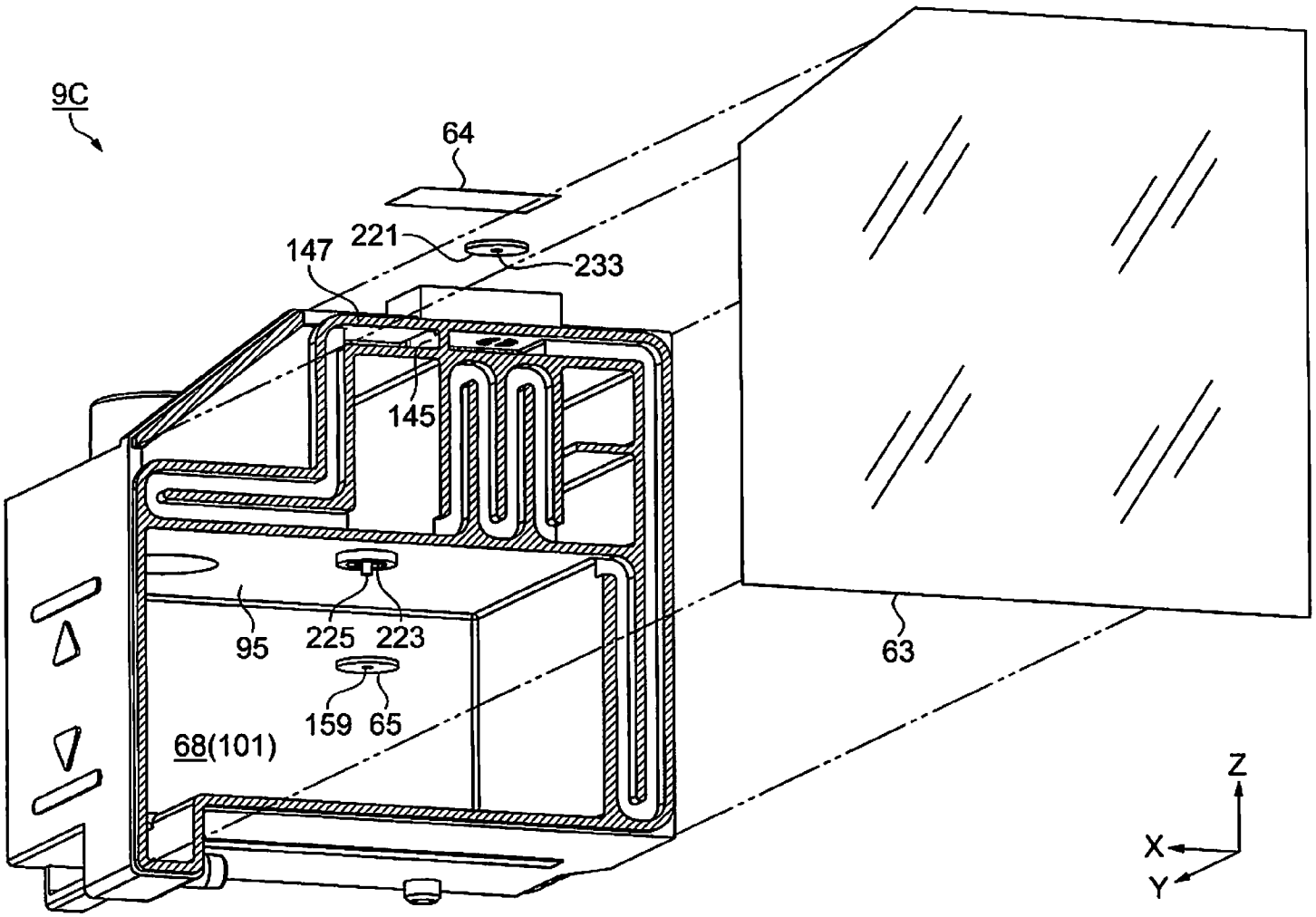
FIG. 21 is an exploded perspective view illustrating a tank in a working example 3.

In the working example 3, the air introduction valve 65 is provided to the fifth wall 95 within the storage section 68 (the recess 101), as illustrated in FIG. 21. The air introduction valve 65 is provided to a region of the fifth wall 95 that overlaps with the third air chamber 74 along the Z-axis. A through hole 235 that perforates through the fifth wall 95 is formed in the region of the fifth wall 95 that overlaps with the third air chamber 74 along the Z-axis. The through hole 235 perforates through the fifth wall 95 and leads from inside the storage section 68 (the recess 101) to inside the third air chamber 74. For this reason, the storage section 68 (the recess 101) is communicated to the third air chamber 74 via the through hole 235. The storage section 68 (the recess 101) is also communicated to the first communicating section 78 (FIG. 20) via the through hole 235. The first communicating section 78 is communicated to the exterior of the tank 9C via the air communication port 181 (FIG. 19). For this reason, the storage section 68 (the recess 101) is communicated to the exterior of the tank 9C from the through hole 235 via the first communicating section 78 and the air communication port 181.

A shaft section 237 is provided to the fifth wall 95 within the storage section 68 (the recess 101), as illustrated in FIG. 21. The shaft section 237 projects out in the −Z-axis direction from the fifth wall 95. The through hole 235 is provided to the periphery of the shaft section 237. The through hole 159 of the air introduction valve 65 is inserted onto the shaft section 237. The air introduction valve 65 has a size that covers the through hole 235. For this reason, when the through hole 159 of the air introduction valve 65 is inserted onto the shaft section 237, the through hole 235 is closed off by the air introduction valve 65. The air introduction valve 65 interrupts the communicating state between the first communicating section 78 and the storage section 68.

The configuration of the communicating chamber 77 is the same as the working example 2, and therefore a more detailed description is omitted here. Similarly to the working example 2, the through hole 227 and the through hole 229 are provided within the communicating chamber 77. For this reason, in the working example 3, as well, the second communicating passage 75 and the third communicating passage 76 are in communication with one another via the communicating chamber 77. Similarly to the working example 2, the shaft section 231 (FIG. 19) is provided within the communicating chamber 77 (the recess 151). The through hole 233 of the air release valve 221 (FIG. 19) is inserted onto the shaft section 231. When the through hole 233 of the air release valve 221 is inserted onto the shaft section 231, the through hole 229 is closed off by the air release valve 221.

The air release valve 221 interrupts the communicating state between the air communication port 181 and the storage section 68. In the tank 9C, the air release valve 221 is provided between the communicating chamber 77 and the third communicating passage 76. For this reason, in the tank 9C, the communicating section 69 is closed between the first communicating section 78 (FIG. 20) and the second communicating section 79 by the air release valve 221. The air release valve 221 is provided within the communicating chamber 77. In the tank 9C, the communicating chamber 77 is included in the second communicating section 79. For this reason, the area between the first communicating section 78 (FIG. 20) and the second communicating section 79 is closed from the second communicating section 79 side by the air release valve 221.

Similarly to the working example 2, when the pressure inside the storage section 68 becomes lower than the atmospheric pressure, then the pressure difference between the pressure inside the storage section 68 and the atmospheric pressure causes the air introduction valve 65 illustrated in FIG. 21 to bend from the fifth wall 95 side toward the storage section 68 side. This causes the through hole 223 to be opened, and creates communication between the third air chamber 74 and the interior of the storage section 68. This causes the air inside the third air chamber 74 to be sent to inside the storage section 68 by way of the through hole 223. This makes it easy for the pressure inside the storage section 68 to be kept at atmospheric pressure. When the pressure inside the storage section 68 is close to the atmospheric pressure, the deformation of the air introduction valve 65 is reverted due to the elasticity. This causes the through hole 223 to be closed when the pressure inside the storage section 68 is close to the atmospheric pressure.

In the working example 3, the case 61C corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Effects similar to those of the working example 1 and the working example 2 are also obtained in the working example 3.

Working Example 4

Figure 22:
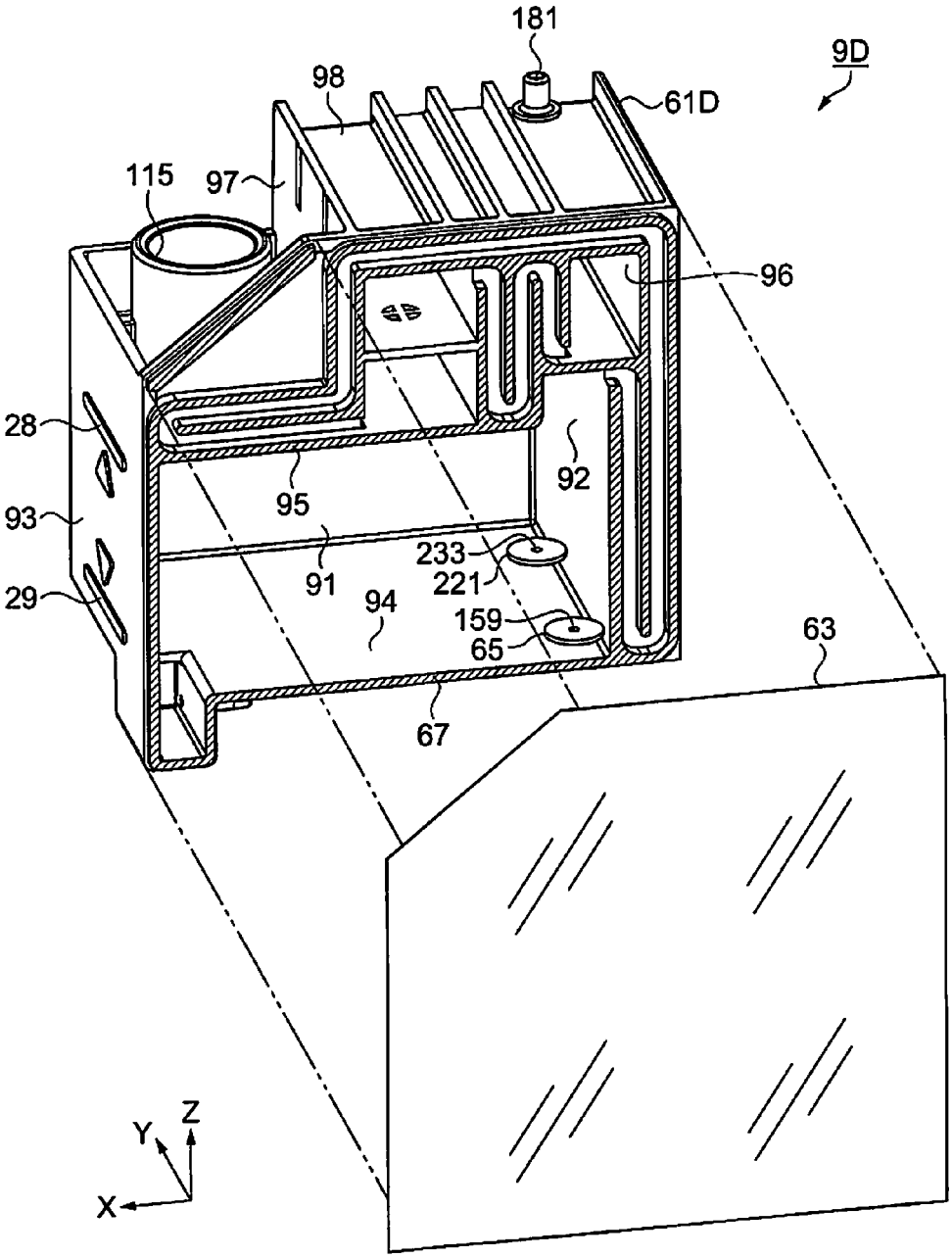
FIG. 22 is an exploded perspective view illustrating a tank in a working example 4.

A tank 9D in a working example 4 shall now be described. The working example 4 omits a detailed description of configurations that are identical to the working example 1 or the working example 2, and assigns thereto the same reference signs as in the working example 1 or the working example 2. The tank 9D has a case 61D, the sheet member 63, the air introduction valve 65, and the air release valve 221, as illustrated in FIG. 22. The case 61D is constituted of, for example, a synthetic resin such as nylon or polypropylene. The tank 9D possesses a configuration where the case 61D and the sheet member 63 are bonded together. The bonded section 67 is provided to the case 61D. FIG. 22 depicts the bonded section 67 with hatching in order to illustrate the configuration in a manner that is easy to understand. The sheet member 63 is bonded to the bonded section 67 of the case 61D. In the present embodiment, the case 61D and the sheet member 63 are bonded together by welding.

Figure 23:
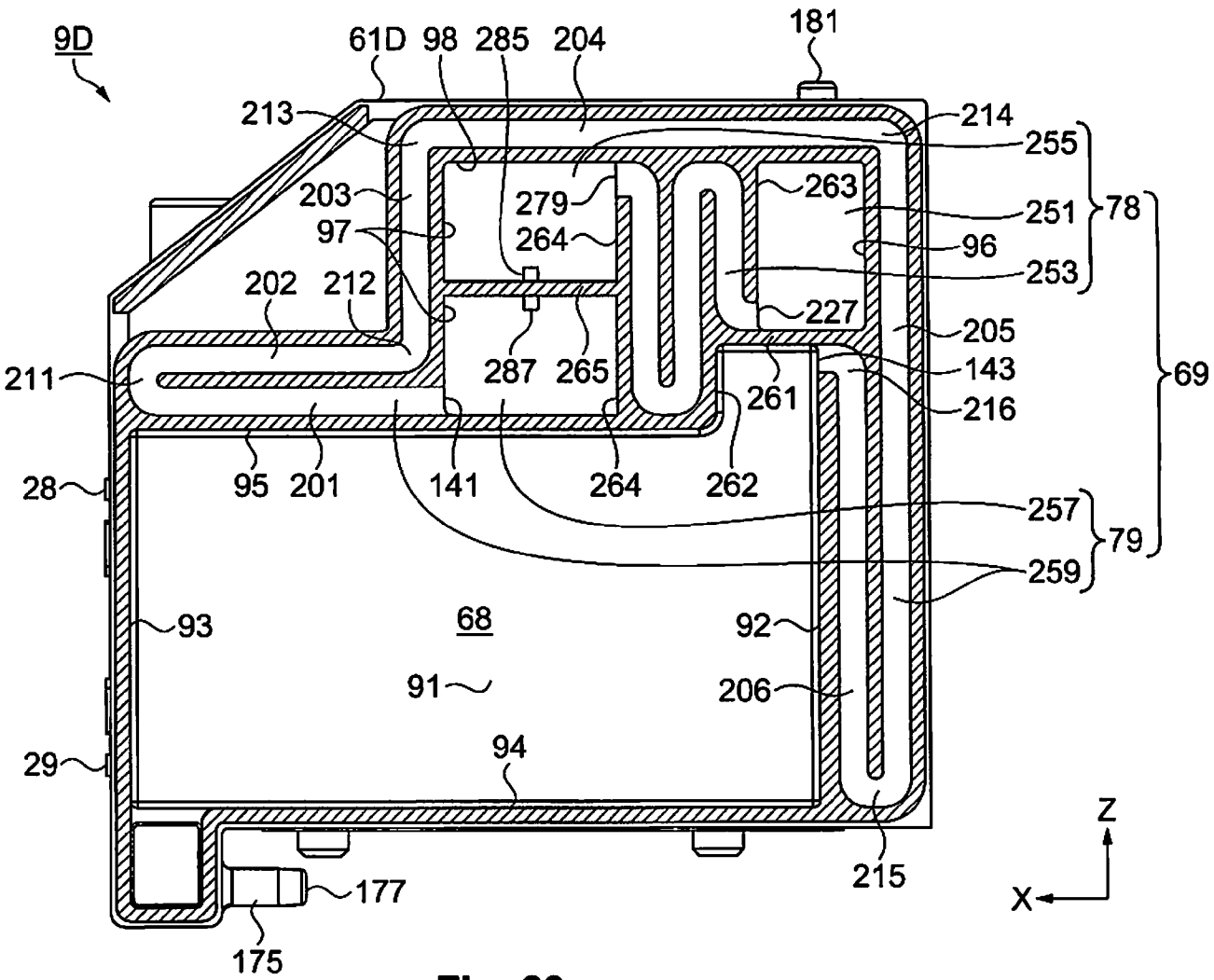
FIG. 23 is a side view of when a tank in a working example 4 is seen from a sheet member side.

The tank 9D has the storage section 68 and the communicating section 69, as illustrated in FIG. 23. The communicating section 69 has a first air chamber 251, a first communicating passage 253, a second air chamber 255, a third air chamber 257, and a second communicating passage 259. FIG. 23 illustrates a state where the tank 9D is seen from the sheet member 63 side, and depicts the case 61D with the sheet member 63 therebetween. The storage section 68, the first air chamber 251, the first communicating passage 253, the second air chamber 255, the third air chamber 257, and the second communicating passage 259 are partitioned from one another by the bonded section 67. In the tank 9D, as well, the communicating section 69 can be demarcated into the first communicating section 78 and the second communicating section 79. In the tank 9D, the first air chamber 251, the first communicating passage 253, and the second air chamber 255 are included in the first communicating section 78. The third air chamber 257 and the second communicating passage 259 are included in the second communicating section 79.

The case 61D has the first wall 91 through eighth wall 98, similarly to the working example 1. The places of arrangement of the first wall 91 through eighth wall 98 are each similar to those in the working example 1 and the working example 2. The case 61D also has a ninth wall 261, a tenth wall 262, an eleventh wall 263, a twelfth wall 264, and a thirteenth wall 265. The first air chamber 251, the first communicating passage 253, the second air chamber 255, and the third air chamber 257 are arranged closer to the opposite side to the storage section 68 side than the fifth wall 95. When the first wall 91 is seen in plan view from the sheet member 63 side, then the storage section 68 is surrounded by the second wall 92, the third wall 93, the fourth wall 94, the fifth wall 95, the ninth wall 261, and the tenth wall 262.

Also, when the first wall 91 is seen in plan view from the sheet member 63 side, then the first air chamber 215, the first communicating passage 253, the second air chamber 255, and the third air chamber 257 are surrounded by the fifth wall 95, the ;w, the seventh wall 97, the eighth wall 98, the ninth wall 261, and the tenth wall 262. The first wall 91 of the storage section 68 and the first wall 91 of the first air chamber 251, the second air chamber 255, and the third air chamber 257 are the same wall as one another. In other words, the storage section 68, the first air chamber 251, the second air chamber 255, and the third air chamber 257 share the first wall 91. The ink injection section 115, the supply port 177, and the air communication port 181 are also provided to the case 61D. The places of arrangement of the ink injection section 115, the supply port 177, and the air communication port 181 are each similar to those in the working example 1 and the working example 2.

Figure 24:
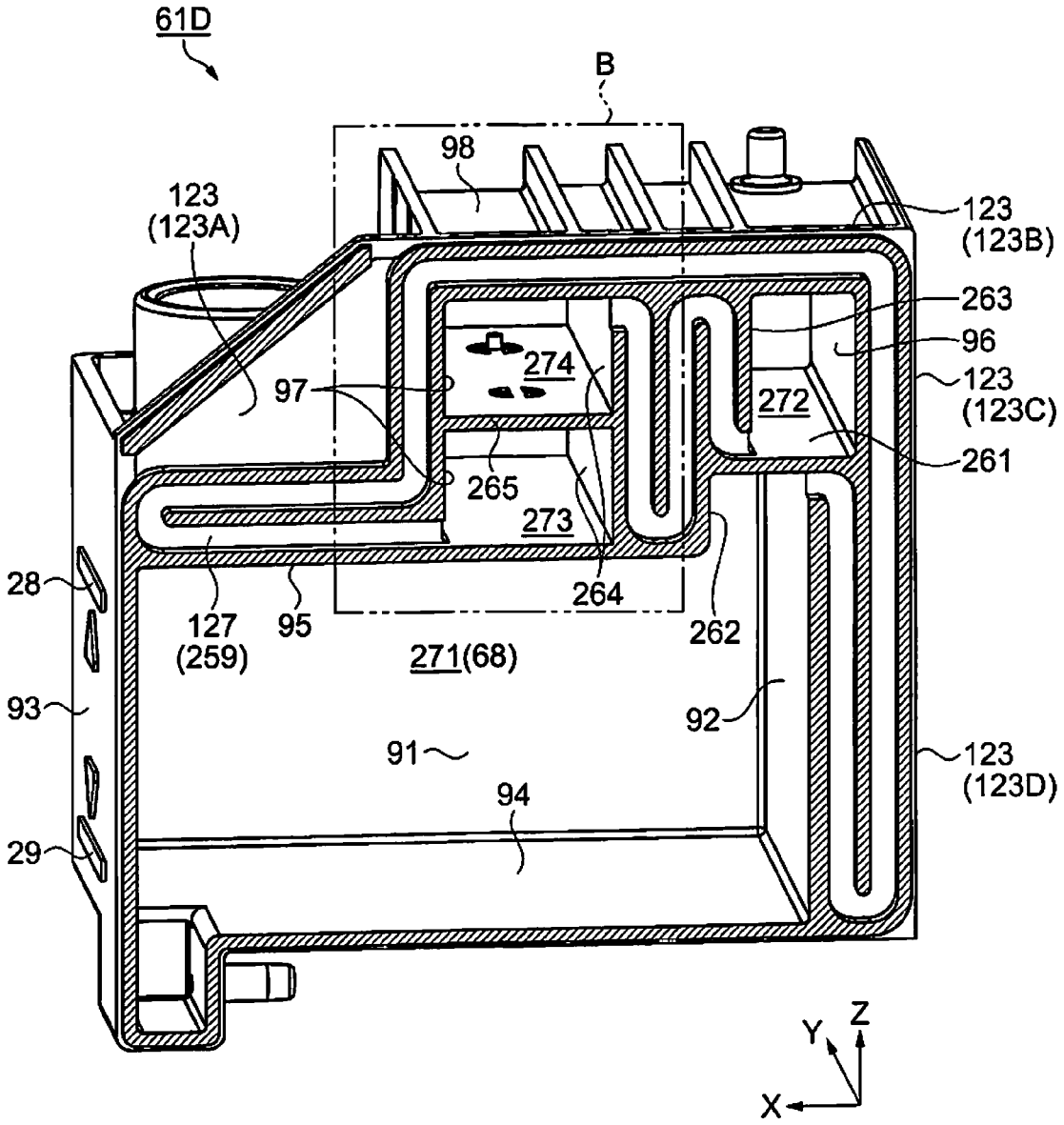
FIG. 24 is a perspective view illustrating a case in a working example 4.

The ninth wall 261, as illustrated in FIG. 24, is provided to the opposite side to the storage section 68 side more than the fifth wall 95. In other words, the ninth wall 261 is located more in the Z-axis direction than the fifth wall 95. The ninth wall 261 faces the fourth wall 94. The second wall 92 intersects with each of the fourth wall 94 and the ninth wall 261. The tenth wall 262 is located between the second wall 92 and the third wall 93. The tenth wall 262 faces the second wall 92. The tenth wall 262 intersects with each of the fifth wall 95 and the ninth wall 261.

The second wall 92, the third wall 93, the fourth wall 94, the fifth wall 95, the ninth wall 261, and the tenth wall 262 project out to the −Y-axis direction from the first wall 91. Due to this, the second wall 92, the third wall 93, the fourth wall 94, the fifth wall 95, the ninth wall 261, and the tenth wall 262 extending in the −Y-axis direction from a main wall together constitute a recess 271, the main wall being the first wall 91. The recess 271 is configured at an orientation so as to be concave going toward the Y-axis direction. The recess 271 opens toward the −Y-axis direction, i.e., toward the sheet member 63 (FIG. 22) side. In other words, the recess 271 is provided at an orientation so as to be concave going toward the Y-axis direction, i.e., going toward the opposite side to the sheet member 63 (FIG. 22) side. When the sheet member 63 is bonded to the case 61D, the recess 271 is closed off by the sheet member 63, thus constituting the storage section 68. The first wall 91 through eighth wall 98, the ninth wall 261, and the tenth wall 262 each are not limited to being flat walls, and may also be ones that comprise irregularities.

The sixth wall 96, as illustrated in FIG. 23, projects out from the ninth wall 261 toward the opposite side to the fourth wall 94 side of the ninth wall 261, i.e., in the Z-axis direction of the ninth wall 261. The seventh wall 97 projects out from the fifth wall 95 toward the opposite side to the fourth wall 94 side of the fifth wall 95, i.e., toward the Z-axis direction of the fifth wall 95. The sixth wall 96 and the seventh wall 97 are provided to positions that face one another across the first air chamber 251, the first communicating passage 253, the second air chamber 255, and the third air chamber 257 along the X-axis. The eighth wall 98 is provided to a position that faces the fifth wall 95 and the ninth wall 261 across the first air chamber 251, the first communicating passage 253, the second air chamber 255, and the third air chamber 257 along the Z-axis. The sixth wall 96 intersects with each of the ninth wall 261 and the eighth wall 98. The seventh wall 97 intersects with each of the fifth wall 95 and the eighth wall 98.

The eleventh wall 263 and the twelfth wall 264 are provided between the sixth wall 96 and the seventh wall 97. Between the first air chamber 251 and the second air chamber 255, a separation is formed in the X-axis direction by the eleventh wall 263 and the twelfth wall 264. The eleventh wall 263 is provided closer to the seventh wall 97 side than the sixth wall 96, and faces the sixth wall 96. The eleventh wall 263 is provided closer to the sixth wall 96 side than the seventh wall 97, and faces the seventh wall 97. The eleventh wall 263 is provided closer to the seventh wall 97 side than the eleventh wall 263. The thirteenth wall 265 is located between the fifth wall 95 and the eighth wall 98, and partitions between the second air chamber 255 and the third air chamber 257. The thirteenth wall 265 is also provided between the eleventh wall 263 and the seventh wall 97, and partitions between the twelfth wall 264 and the seventh wall 97. The thirteenth wall 265 intersects with each of the first wall 91, the twelfth wall 264, and the seventh wall 97.

The sixth wall 96, the seventh wall 97, the eighth wall 98, the eleventh wall 263, and the twelfth wall 264 each project out in the −Y-axis direction from the first wall 91, as illustrated in FIG. 24. The seventh wall 97, the ninth wall 261, the eleventh wall 263, and the eighth wall 98 extending in the −Y-axis direction from the first wall 91 together constitute a recess 272. The fifth wall 95, the seventh wall 97, the thirteenth wall 265, and the twelfth wall 264 extending in the −Y-axis direction from the first wall 91 together constitute a recess 273. The thirteenth wall 265, the seventh wall 97, the eighth wall 98, and the twelfth wall 264 extending in the −Y-axis direction from the first wall 91 together constitute a recess 274.

The recess 272, the recess 273, and the recess 274 each form an opening going toward the −Y-axis direction, i.e., going toward the sheet member 63 (FIG. 22) side. In other words, the recess 272, the recess 273, and the recess 274 each are provided at an orientation so as to be concave going toward the Y-axis direction, i.e., going toward the opposite side to the sheet member 63 (FIG. 22) side. When the sheet member 63 is bonded to the case 61D, the recess 272 is closed off by the sheet member 63, thus constituting the first air chamber 251. When the sheet member 63 is bonded to the case 61D, the recess 274 is closed off by the sheet member 63, thus constituting the second air chamber 255. Likewise, when the sheet member 63 is bonded to the case 61D, the recess 273 is closed off by the sheet member 63, thus constituting the third air chamber 257. The amounts by which the second wall 92 through eighth wall 98 and the ninth wall 261 through thirteenth wall 265 project out from the first wall 91 are set so as to be the same amount of projection to one another.

The first communicating passage 253 is provided between the eleventh wall 263 and the twelfth wall 264, as illustrated in FIG. 23, and forms communication between the first air chamber 251 and the second air chamber 255. The second communicating passage 259 is provided to the outside of the storage section 68, the first air chamber 251, the first communicating passage 253, the second air chamber 255, and the third air chamber 257. The second communicating passage 259 forms communication between the third air chamber 257 and the storage section 68. A communication port 277 is provided to the eleventh wall 263. The first air chamber 251 is communicated to the first communicating passage 253 via the communication port 277. A communication port 279 is also provided to the twelfth wall 264. The second air chamber 255 is communicated to the first communicating passage 253 via the communication port 279. The first communicating passage 253 meanders. The first air chamber 251 is communicated to the second air chamber 255 after having meandered via the first communicating passage 253.

Figure 25:
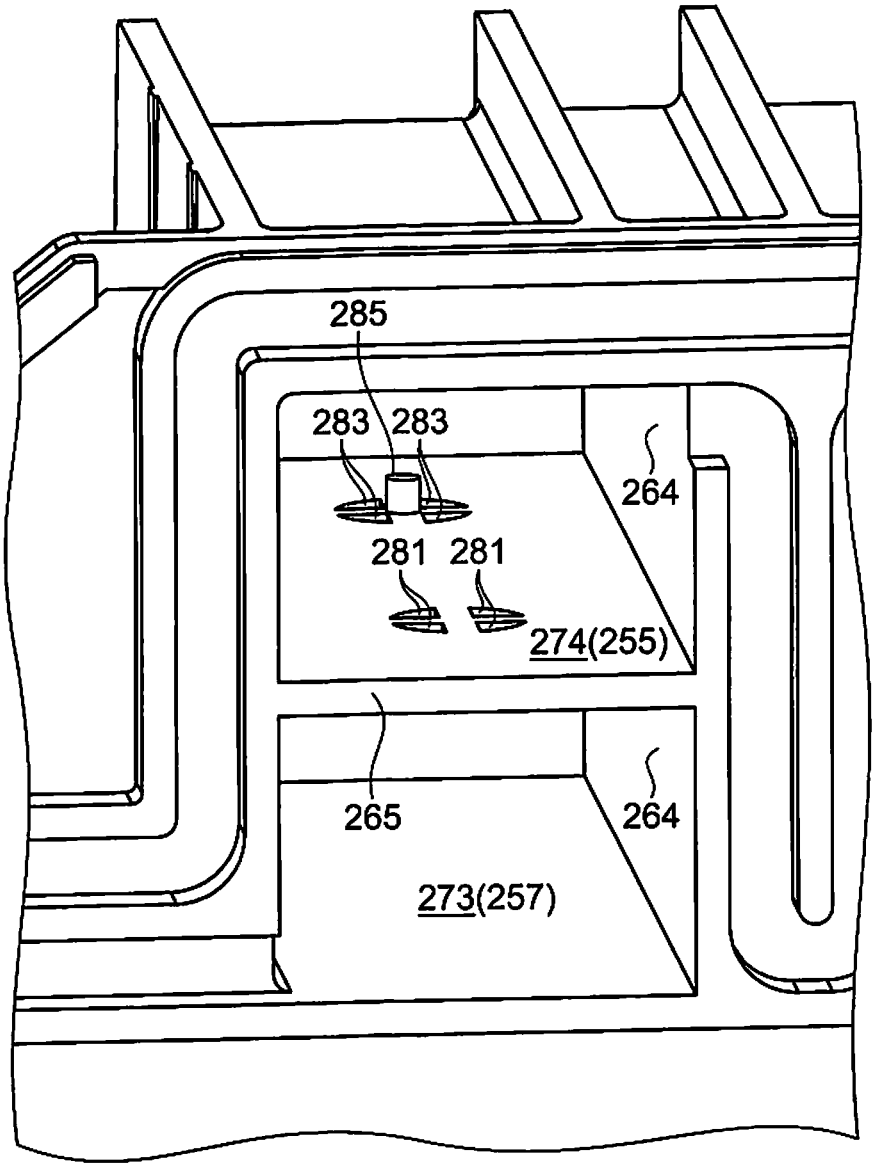
FIG. 25 is an enlarged view of a B section in FIG. 24.

A through hole 281 and a through hole 283 are provided to the thirteenth wall 265, as illustrated in FIG. 25, which is an enlarged view of a B section in FIG. 24. The through hole 281 and the through hole 283 each perforate through the thirteenth wall 265. For this reason, the second air chamber 255 and the third air chamber 257 are communicated together via the through hole 281 and the through hole 283. The extended section 123 is also provide to the case 61D in a similar fashion to the working example 1 through working example 3, as illustrated in FIG. 24. In the case 61D, the second communicating passage 259 is provided to the extended section 123. In the case 61D, as well, the extended section 123 has the site 123A, the site 123B, the site 123C, and the site 123D. The second communicating passage 259 is configured as the groove 127 that is provided to the extended section 123 at an orientation so as to be concave going toward the opposite side to the sheet member 63 side.

The second communicating passage 259, as illustrated in FIG. 23, has the communication port 141 and the communication port 143. The communication port 141 is an opening section that opens toward the inside of the third air chamber 257. The communication port 143 is an opening section that opens toward the inside of the storage section 68. The third air chamber 257 passes from the communication port 141 via the second communicating passage 259 through the communication port 143 to the storage section 68. Due tot he above, the storage section 68 is communicated to the exterior of the tank 9D via the second communicating passage 259, the third air chamber 257, the second air chamber 255, the first communicating passage 253, the first air chamber 251, and the air communication port 181. In the tank 9D, as well, similarly to the working example 1 through working example 3, the second communicating passage 259 can be demarcated into the first passage 201, the second passage 202, the third passage 203, the fourth passage 204, the fifth passage 205, and the sixth passage 206. Also, in the tank 9D, as well, similarly to the working example 1 through working example 3, the orientation of the flow path is reversed in each of the reversal section 211 and the reversal section 215. The orientation of the flow path is bent at each of the bend section 212, the bend section 213, and the bend section 214.

A shaft section 285 is provided to the thirteenth wall 265, as illustrated in FIG. 25. The shaft section 285 is provided to the second air chamber 255, and projects out in the Z-axis direction from the thirteenth wall 265. The through hole 283 is provided to the periphery of the shaft section 285. The through hole 233 (FIG. 22) of the air release valve 221 is inserted onto the shaft section 285. The air release valve 221 has a size that covers the through hole 283. For this reason, when the through hole 233 of the air release valve 221 is inserted onto the shaft section 285, the through hole 283 is closed off by the air release valve 221.

A shaft section 287 is also provided to the thirteenth wall 265, as illustrated in FIG. 23. The shaft section 287 is provided to the third air chamber 257, and projects out in the −Z-axis direction from the thirteenth wall 265. The through hole 281 (FIG. 25) is provided to the periphery of the shaft section 287. The through hole 159 (FIG. 22) of the air introduction valve 65 is inserted onto the shaft section 287. The air introduction valve 65 has a size that covers the through hole 281. For this reason, when the through hole 159 of the air introduction valve 65 is inserted onto the shaft section 287, the through hole 281 is closed off by the air introduction valve 65. The air release valve 221 and the air introduction valve 65 interrupt the communicating state between the second air chamber 255 and the third air chamber 257. In the tank 9D, the air introduction valve 65 and the air release valve 221 are provided between the second air chamber 255 and the third air chamber 257. For this reason, in the tank 9D, the communicating section 69 is closed between the first communicating section 78 (FIG. 23) and the second communicating section 79 by the air introduction valve 65 and the air release valve 221.

The air introduction valve 65 is provided within the third air chamber 257. In the tank 9D, the third air chamber 257 is included in the second communicating section 79. For this reason, the area between the first communicating section 78 (FIG. 23) and the second communicating section 79 is closed from the second communicating section 79 side by the air introduction valve 65. The air release valve 221 is provided within the second air chamber 255. In the tank 9D, the second air chamber 255 is included in the first communicating section 78. For this reason, the area between the first communicating section 78 (FIG. 23) and the second communicating section 79 is closed from the first communicating section 78 side by the air release valve 221. The operations of the air introduction valve 65 and the air release valve 221 are similar to those in the working example 1 through working example 3, and therefore a description thereof is omitted here.

When the pressure inside the storage section 68 becomes lower than the atmospheric pressure, then the air introduction valve 65 is opened and the air of the exterior of the tank 9D flows into the third air chamber 257 via the through hole 281 from inside the second air chamber 255. The air that has flowed into the third air chamber 257 then flows into the storage section 68 via the second communicating passage 259. This makes it easy to maintain the pressure inside the storage section 68 at the atmospheric pressure. When the pressure inside the storage section 68 becomes higher than the atmospheric pressure, then the air release valve 221 is opened and the air inside the storage section 68 flows out to the second air chamber 255 via the through hole 283 from inside the third air chamber 257. The air that has flowed out to the second air chamber 255 then passes through the first communicating passage 253 and the first air chamber 251 and is discharged from the air communication port 181 to the exterior of the tank 9D. This makes it easy to maintain the pressure inside the storage section 68 at the atmospheric pressure.

Similarly to the working example 1 through working example 3, the communication port 143 is located above the upper limit mark 28 in the vertical direction, as illustrated in FIG. 23. The upper limit mark 28 is located below the fifth wall 95 in the vertical direction. For this reason, the upper limit mark 28 is located below the opening 191 of the ink injection section 115 in the vertical direction. This makes it easy to avoid an event where the ink surpasses the upper limit mark 28 and reaches the opening 191 when the worker is injecting the ink from the ink injection section 115 into the tank 9D. It is therefore easy to avoid an event where the ink overflows from the ink injection section 115 when the worker is injecting the ink from the ink injection section 115 into the tank 9D.

As stated above, the ninth wall 261 is located closer to the opposite side to the storage section 68 side more than the fifth wall 95. In other words, the ninth wall 261 is located above the fifth wall 95 in the Z-axis direction. Then, the communication port 143 is located at the site of intersection where the second wall 92 and the ninth wall 261 intersect. For this reason, the communication port 143 is located above the fifth wall 95 in the Z-axis direction. Herein, the opening 191 (FIG. 9) of the ink injection section 115 is provided to the fifth wall 95, similarly to the working example 1 through working example 3. Accordingly, the communication port 143 is located above the opening 191 (FIG. 9) in the Z-axis direction.

In the working example 4, the case 61D corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Effects similar to those of the working example 1 through working example 3 are also obtained in the working example 4.

Figure 26:
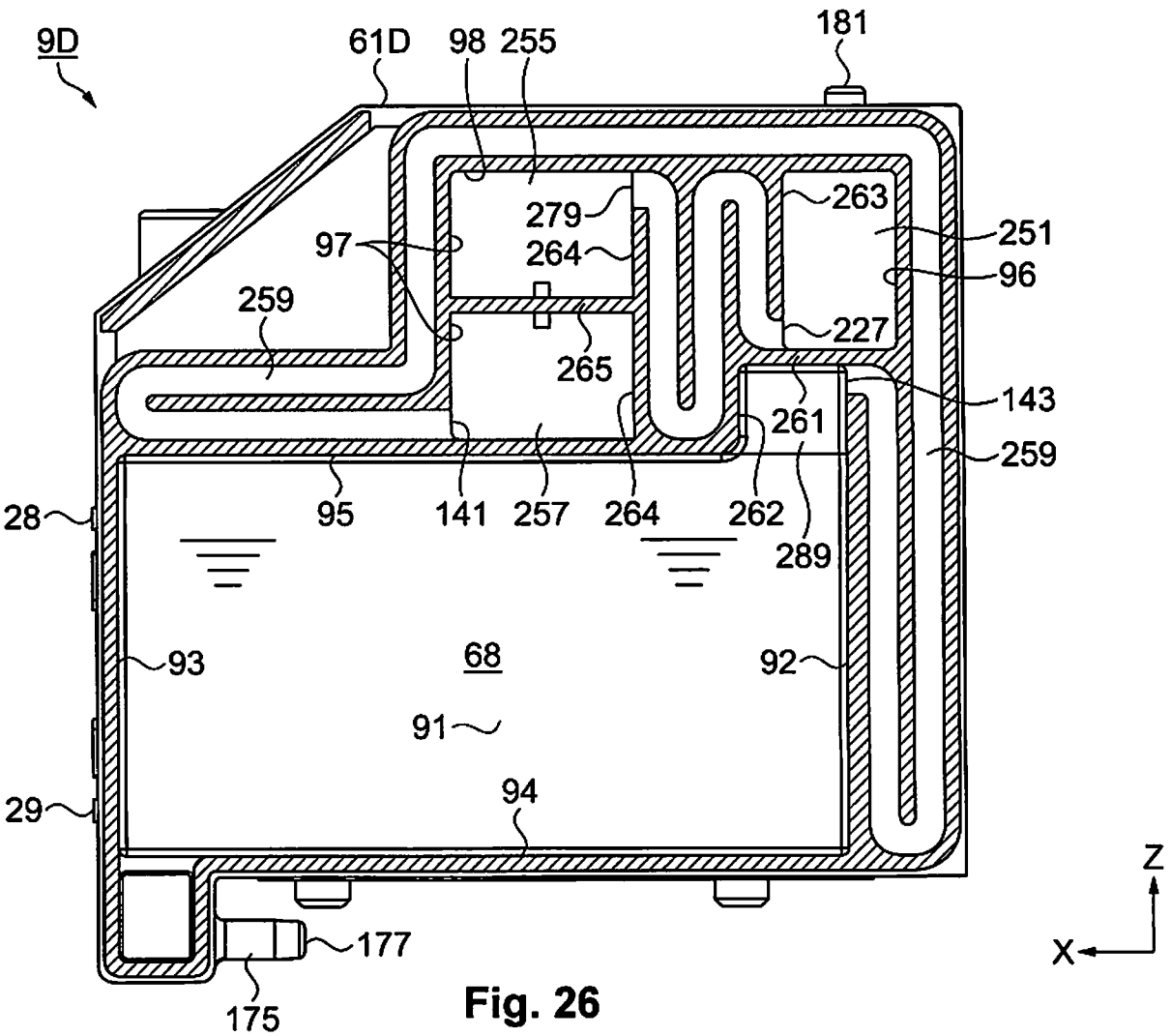
FIG. 26 is a side view of when a tank in a working example 4 is seen from a sheet member side.

In the working example 4, as illustrated in FIG. 26, the ninth wall 261 is located closer to the eighth wall 98 side than the fifth wall 95. In another viewpoint, the ninth wall 261 is located vertically above the fifth wall 95. In other words, the height of the ninth wall 261 from the fourth wall 94 is greater than the height of the fifth wall 95 from the fourth wall 94. The tenth wall 262 is provided between the ninth wall 261 and the fifth wall 95. This configuration causes a recess 289 to be configured in the storage section 68. The recess 289 is provided at an orientation so as to be concave going toward closer to the eighth wall 98 side than the fifth wall 95, i.e., going toward closer in the Z-axis direction than the fifth wall 95. The communication port 143 is provided to a position that faces the tenth wall 262 in the recess 289. For this reason, the communication port 143 is located closer to the ninth wall 261 side than the fifth wall 95. In another viewpoint, the communication port 143 is located vertically above the fifth wall 95.

As stated previously, the opening 191 (FIG. 9) of the ink injection section 115 is provided to the fifth wall 95, similarly to the working example 1 through working example 3. For this reason, the communication port 143 is provided above the opening 191 (FIG. 9) in the Z-axis direction. According to this configuration, the ink inside the storage section 68 will less readily arrive at the communication port 143. For this reason, the possibility that the ink inside the storage section 68 could flow in to inside the second communicating passage 259 is reduced. As a result, the possibility that the ink inside the storage section 68 could arrive at the second air chamber 255 can be reduced, and therefore the possibility that the ink inside the storage section 68 could leak out of the tank 9D via the first communicating passage 253 and the first air chamber 251 from the second air chamber 255 can be reduced.

Further, for example, as illustrated in FIG. 26, the liquid level of the ink inside the tank 9D could conceivably end up reaching the fifth wall 95 when the ink is being injected in from the ink injection section 115. When the liquid level of the ink reaches the fifth wall 95, the ink reaches the opening 191 of the ink injection section 115. In the tank 9D, the space of air is upheld in the recess 289 even in such a case, as well. When the cap 197 is applied after injection, conceivably the pressure inside the storage section 68 will rise and the liquid level of the ink will be elevated in the recess 289. In the tank 9D, even in such an event, the fact that there is the space of air in the recess 289 means that the elevated liquid level is less likely to arrive at the communication port 143. For this reason, compared to the working example 1 through working example 3, it is even easier to prevent the ink inside the storage section 68 from flowing into the second communicating passage 259 from the communication port 143. As a result, it is even easier to avoid an event where the ink inside the storage section 68 leaks out of the tank 9D from the air communication port 181.

In the present embodiment, the volume of the recess 289 is greater than the volume, out of the space surrounded by the side wall 193 of the ink injection section 115, into which the cap 197 is fitted. This makes it possible, even though the cap 147 may be mounted in a state where the space that is surrounded by the side wall 193 is filled to capacity with ink, to use the volume of the recess 289 to capture the amount of ink that is pushed into the storage section 68 by the cap 197. As a result of this, even though the space that is surrounded by the side wall 193 may be filled to capacity with ink, the ink inside the storage section 68 will less readily reach the communication port 143. Accordingly, it is easy to even further prevent the ink inside the storage section 68 from flowing into the second communicating passage 259 from the communication port 143. As a result, it is even easier to avoid an event where the ink inside the storage section 68 leaks out of the tank 9D from the air communication port 181.

Working Example 5

Figure 27:
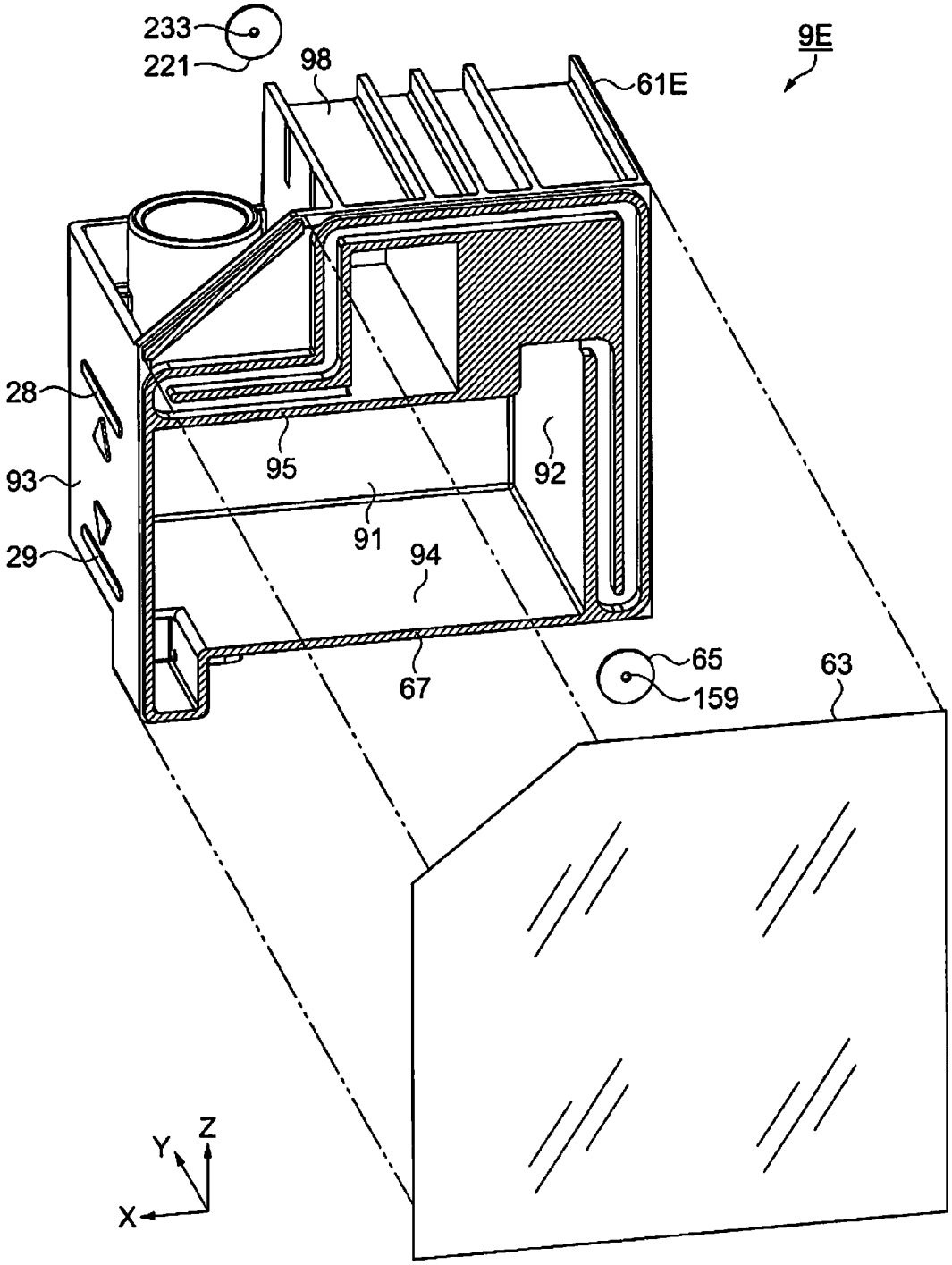
FIG. 27 is an exploded perspective view illustrating a tank in a working example 5.

A tank 9E in a working example 5 shall now be described. The working example 5 omits a detailed description of configurations that are identical to the working example 1 through working example 4, and assigns thereto the same reference signs as in the working example 1 through working example 4. The tank 9E has a case 61E, the sheet member 63, the air introduction valve 65, and the air release valve 221, as illustrated in FIG. 27. The case 61E is constituted of, for example, a synthetic resin such as nylon or polypropylene. The tank 9E possesses a configuration where the case 61E and the sheet member 63 are bonded together. The bonded section 67 is provided to the case 61E. FIG. 27 depicts the bonded section 67 with hatching in order to illustrate the configuration in a manner that is easy to understand. The sheet member 63 is bonded to the bonded section 67 of the case 61E. In the present embodiment, the case 61E and the sheet member 63 are bonded together by welding.

Figure 28:
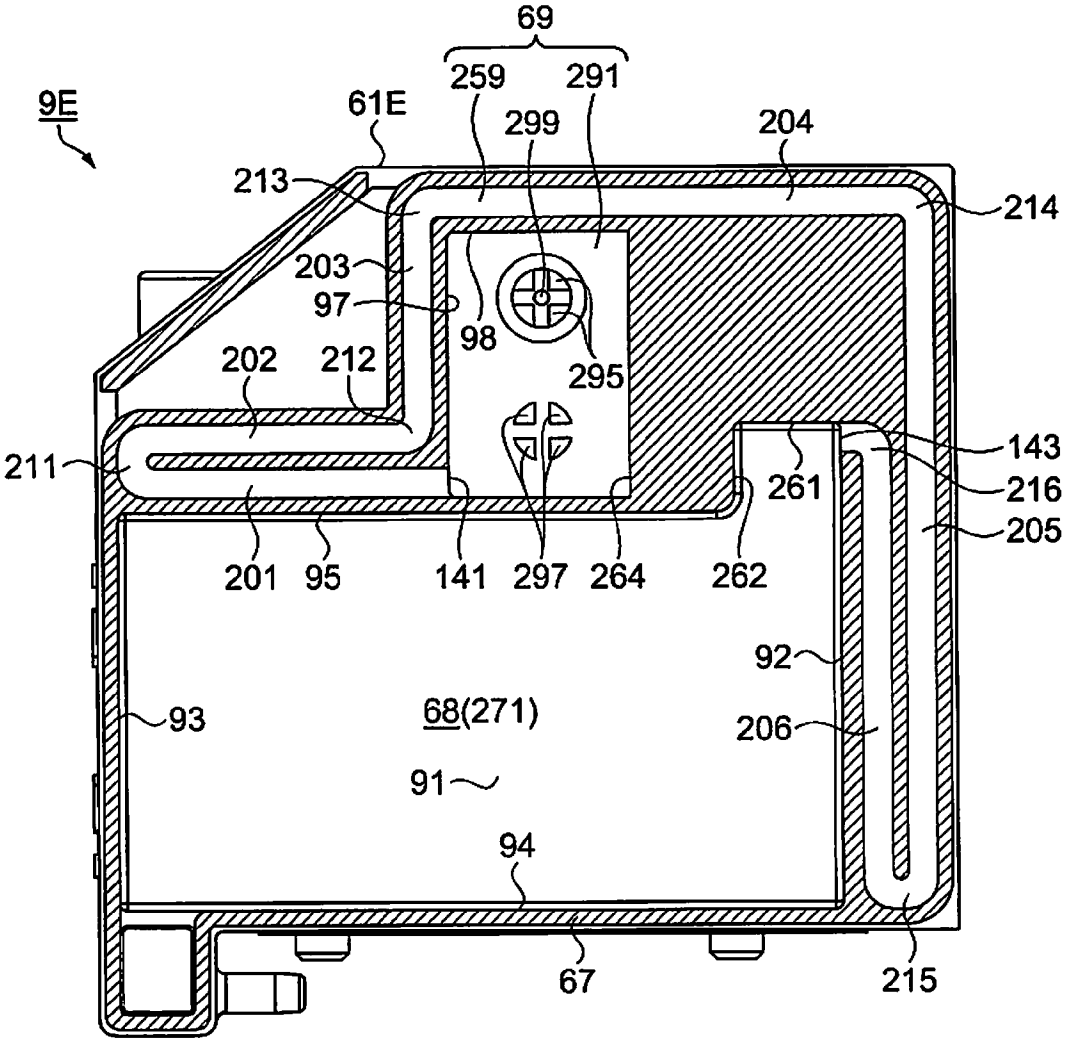
FIG. 28 is a side view of when a tank in a working example 5 is seen from a sheet member side.

The tank 9E has the storage section 68 and the communicating section 69, as illustrated in FIG. 28. The communicating section 69 of the tank 9E omits the air communication section 179, the air communication port 181, the first air chamber 251, the first communicating passage 253, and the thirteenth wall 265 of the tank 9D in the working example 4. In the tank 9E, the communicating section 69 has an air chamber 291 and the second communicating passage 259. FIG. 28 illustrates a state where the tank 9E is seen from the sheet member 63 side, and depicts the case 61E with the sheet member 63 therebetween. The storage section 68, the air chamber 291, and the second communicating passage 259 are partitioned from one another by the bonded section 67.

The air chamber 291 and the second communicating passage 259 are arranged on the opposite side to the storage section 68 side of the fifth wall 95. When the first wall 91 is seen in plan view from the sheet member 63 side, the storage section 68 is surrounded by the second wall 92, the third wall 93, the fourth wall 94, the fifth wall 95, the ninth wall 261, and the tenth wall 262. The second wall 92, the third wall 93, the fourth wall 94, the fifth wall 95, the ninth wall 261, and the tenth wall 262 extending in the −Y-axis direction from a main wall together constitute the recess 271, the main wall being the first wall 91. When the sheet member 63 is bonded to the case 61E, then the recess 271 is closed off by the sheet member 63, thus constituting the storage section 68.

Figure 29:
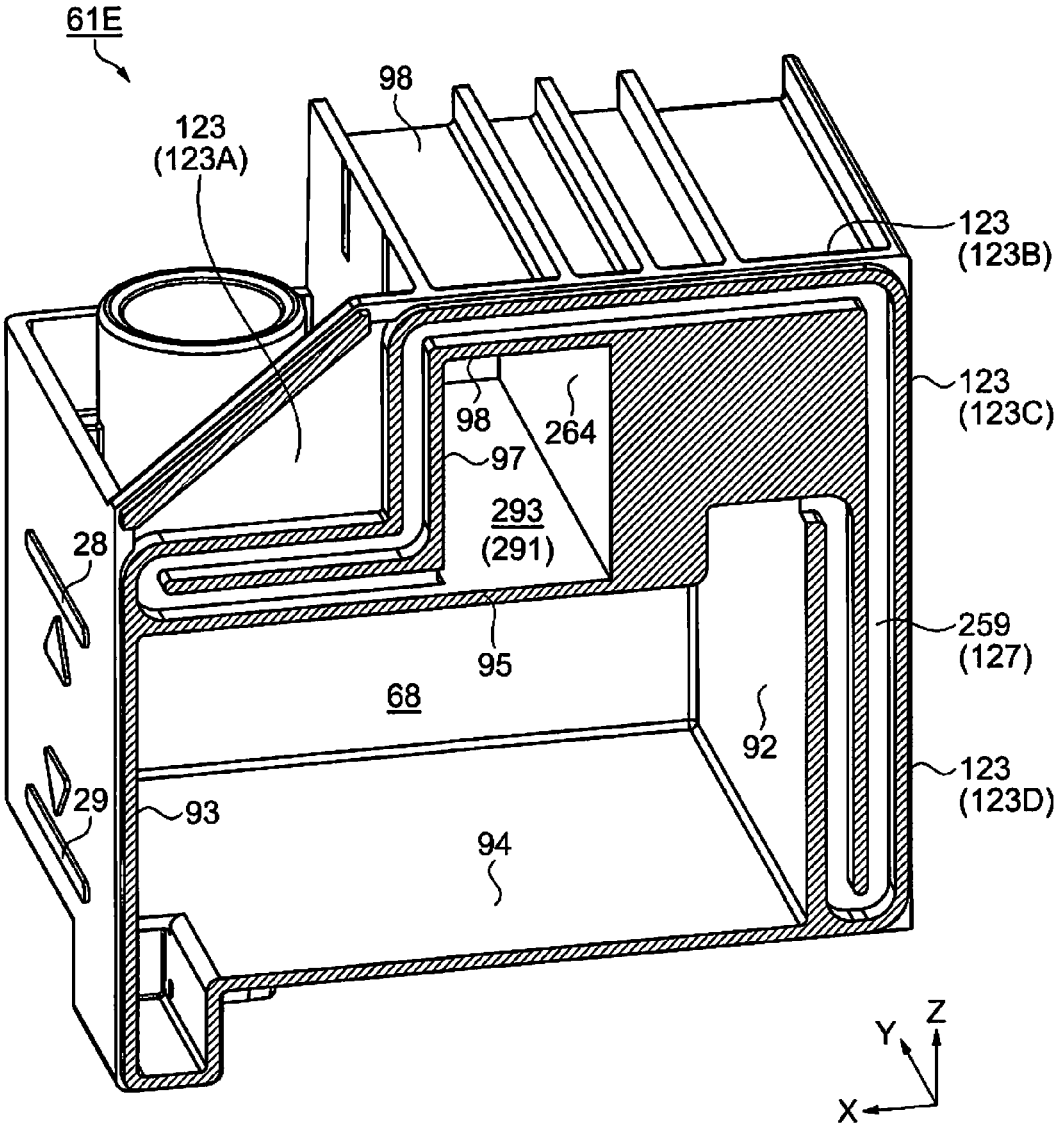
FIG. 29 is a perspective view illustrating a case in a working example 5.

The seventh wall 97, the eighth wall 98, and the twelfth wall 264 each project out in the −Y-axis direction from the first wall 91, as illustrated in FIG. 29. The fifth wall 95, the seventh wall 97, the eighth wall 98, and the twelfth wall 264 extending in the −Y-axis direction from the first wall 91 together constitute a recess 293. The recess 293 forms an opening going toward the −Y-axis direction side, i.e., the sheet member 63 (FIG. 27) side. When the case 61E is bonded to the sheet member 63, then the recess 293 is closed off by the sheet member 63, thus constituting the air chamber 291.

A through hole 295 and a through hole 297 are formed in the first wall 91 within the air chamber 291 (the recess 293), as illustrated in FIG. 28. The through hole 295 and the through hole 297 each perforate through the first wall 91. For this reason, inside the air chamber 291 and the exterior of the tank 9E are communicated to one another via each of the through hole 295 and the through hole 297.

The second communicating passage 259 is provided to the outside of the storage section 68 and the air chamber 291, as illustrated in FIG. 29. The second communicating passage 259 forms communication between the air chamber 291 and the storage section 68. The extended section 123 is provided to the case 61E, as well, similarly to the working example 1 through working example 4. In the case 61E, the second communicating passage 259 is provided to the extended section 123. In the case 61E, as well, the extended section 123 has the site 123A, the site 123B, the site 123C, and the site 123D. The second communicating passage 259 is configured as the groove 127 that is provided to the extended section 123 at an orientation so as to be concave going toward the opposite side to the sheet member 63 side.

The second communicating passage 259, as illustrated in FIG. 28, has the communication port 141 and the communication port 143. The communication port 141 is an opening section that opens toward the inside of the air chamber 291. The communication port 143 is an opening section that opens toward the inside of the storage section 68. The air chamber 291 passes from the communication port 141 via the second communicating passage 259 through the communication port 143 to the storage section 68. Due to the above, the storage section 68 is communicated to the exterior of the tank 9E via the second communicating passage 259 and the air chamber 291. In the tank 9E, as well, similarly to the working example 1 to working example 4, the second communicating passage 259 can be demarcated into the first passage 201, the second passage 202, the third passage 203, the fourth passage 204, the fifth passage 205, and the sixth passage 206. Also, in the tank 9E, as well, similarly to the working example 1 through working example 4, the orientation of the flow path is reversed at each of the reversal section 211 and reversal section 215. The orientation of the flow path is bent at each of the bend section 212, the bend section 213, and the bend section 214.

A shaft section 299 is provided to a region of the first wall 91 that overlaps with the air chamber 291, as illustrated in FIG. 28. The shaft section 299 is provided within the air chamber 291, and projects out from the first wall 91 toward the −Y-axis direction, i.e., from the first wall 91 toward the sheet member 63 (FIG. 27) side. The through hole 295 is provided to the periphery of the shaft section 299. The through hole 295 perforates through the first wall 91. The through hole 159 (FIG. 27) of the air introduction valve 65 is inserted onto the shaft section 299. The air introduction valve 65 has a size that covers the through hole 295. For this reason, when the through hole 159 of the air introduction valve 65 is inserted onto the shaft section 299, the through hole 295 is closed off by the air introduction valve 65.

Figure 30:
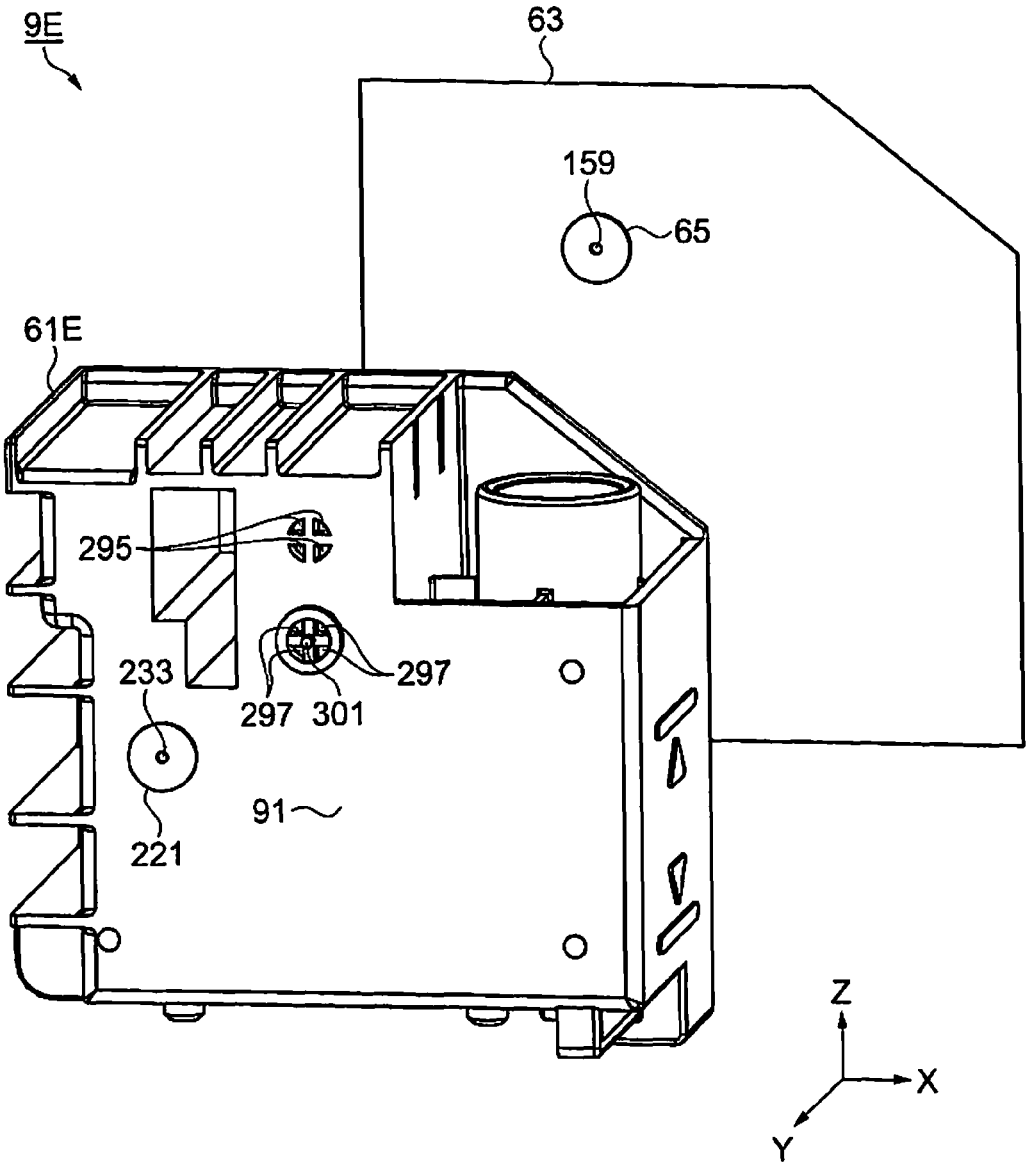
FIG. 30 is an exploded perspective view illustrating a tank in a working example 5.

A shaft section 302 is provided to a region of the first wall 91 that overlaps with the air chamber 291 on the opposite side to the air chamber 291 side of the first wall 91, as illustrated in FIG. 30. The shaft section 301 projects out from the first wall 91 toward the Y-axis direction, i.e., from the first wall 91 toward the opposite side to the sheet member 63 side. The through hole 297 is provided to the periphery of the shaft section 301. The through hole 297 perforates through the first wall 91. The through hole 297 perforating through the first wall 91 is communicated to inside the air chamber 291 (FIG. 28). The through hole 295 perforating through the first wall 91 is also communicated to inside the air chamber 291 (FIG. 28). The through hole 233 of the air release valve 221 is inserted onto the shaft section 301. The air release valve 221 has a size that covers the through hole 297. For this reason, when the through hole 233 of the air release valve 221 is inserted onto the shaft section 301, the through hole 297 is closed off by the air release valve 221. The air release valve 221 and the air introduction valve 65 interrupt the communicating state between the exterior of the tank 9E and the air chamber 291 (FIG. 28). The first wall 91 is a wall that faces the sheet member 63, which seals off the recess 271 and the recess 293. For this reason, the air release valve 221 and the air introduction valve 65 are provided to the first wall 91, which faces the sheet member 63.

The air introduction valve 65 is provided within the air chamber 291. For this reason, a closure between the exterior of the tank 9E and the air chamber 291 is formed from the air chamber 291 side by the air introduction valve 65. The air release valve 221 is provided to the exterior of the tank 9E. For this reason, a closure between the exterior of the tank 9E and the air chamber 291 is formed from the outside of the tank 9E by the air release valve 221. The operations of the air introduction valve 65 and the air release valve 221 are similar to those in the working example 1 through working example 4, and therefore a description thereof is omitted here.

When the pressure inside the storage section 68 becomes lower than the atmospheric pressure, then the air introduction valve 65 is opened and the air of the exterior of the tank 9E flows in to inside the air chamber 291. The air that has flowed into the air chamber 291 then flows into the storage section 68 via the second communicating passage 259. This makes it easy to maintain the pressure inside the storage section 68 at the atmospheric pressure. When the pressure inside the storage section 68 becomes higher than the atmospheric pressure, then the air release valve 221 is opened and the air inside the storage section 68 is discharged to the exterior of the tank 9E from the air chamber 291 via the through hole 297. This makes it easy to maintain the pressure inside the storage section 68 at the atmospheric pressure.

In the working example 5, the case 61E corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Effects similar to those of the working example 1 through working example 4 are also obtained in the working example 5.

Furthermore, in the working example 5, the air release valve 221 and the air introduction valve 65 are provided to the first wall 91, which faces the sheet member 63. In a case where, for example, the case 61E is formed by injection molding of a resin, then the recess 293 and the recess 271 can be formed by moving the mold along the Y-axis in a manner relative to the case 61E. For this reason, the direction of extension of the through hole 295 and the through hole 297 preferably runs along the direction of movement of the mold, in terms of the ease of molding. In the working example 5, the direction of extension of the through hole 295 and the through hole 297 runs along the direction of movement of the mold, and therefore the case 61E can be made easier to mold.

Working Example 6

Figure 31:
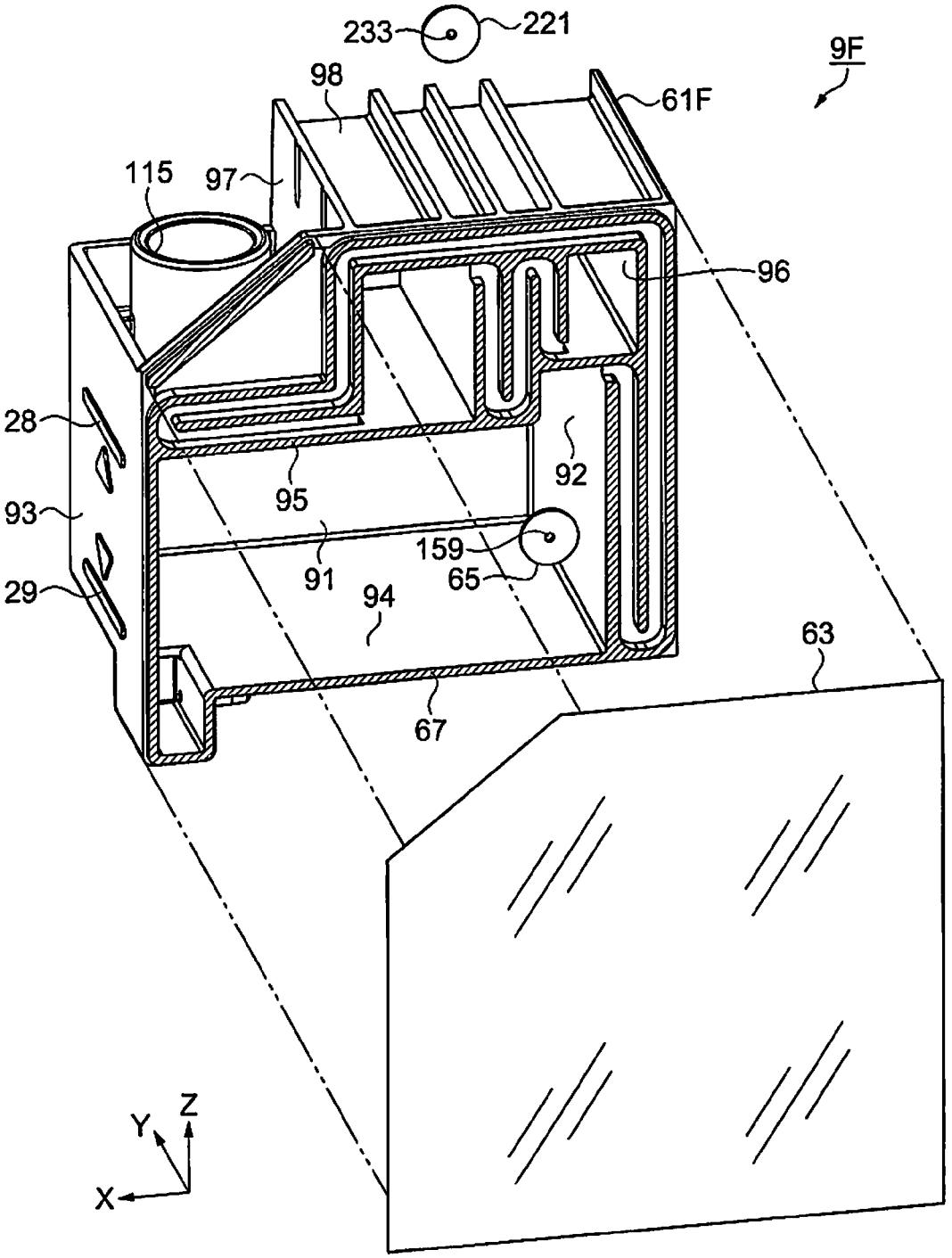
FIG. 31 is an exploded perspective view illustrating a tank in a working example 6.

A tank 9F in a working example 6 shall now be described. The working example 6 omits a detailed description of configurations that are identical to the working example 1 through working example 5, and assigns thereto the same reference signs as in the working example 1 through working example 5. The tank 9F has a case 61F, the sheet member 63, the air introduction valve 65, and the air release valve 221, as illustrated in FIG. 31. The case 61F is constituted of, for example, a synthetic resin such as nylon or polypropylene. The tank 9F possesses a configuration where the case 61F and the sheet member 63 are bonded together. The bonded section 67 is provided to the case 61F. FIG. 31 depicts the bonded section 67 with hatching in order to illustrate the configuration in a manner that is easy to understand. The sheet member 63 is bonded to the bonded section 67 of the case 61F. In the present embodiment, the case 61F and the sheet member 63 are bonded together by welding.

Figure 32:
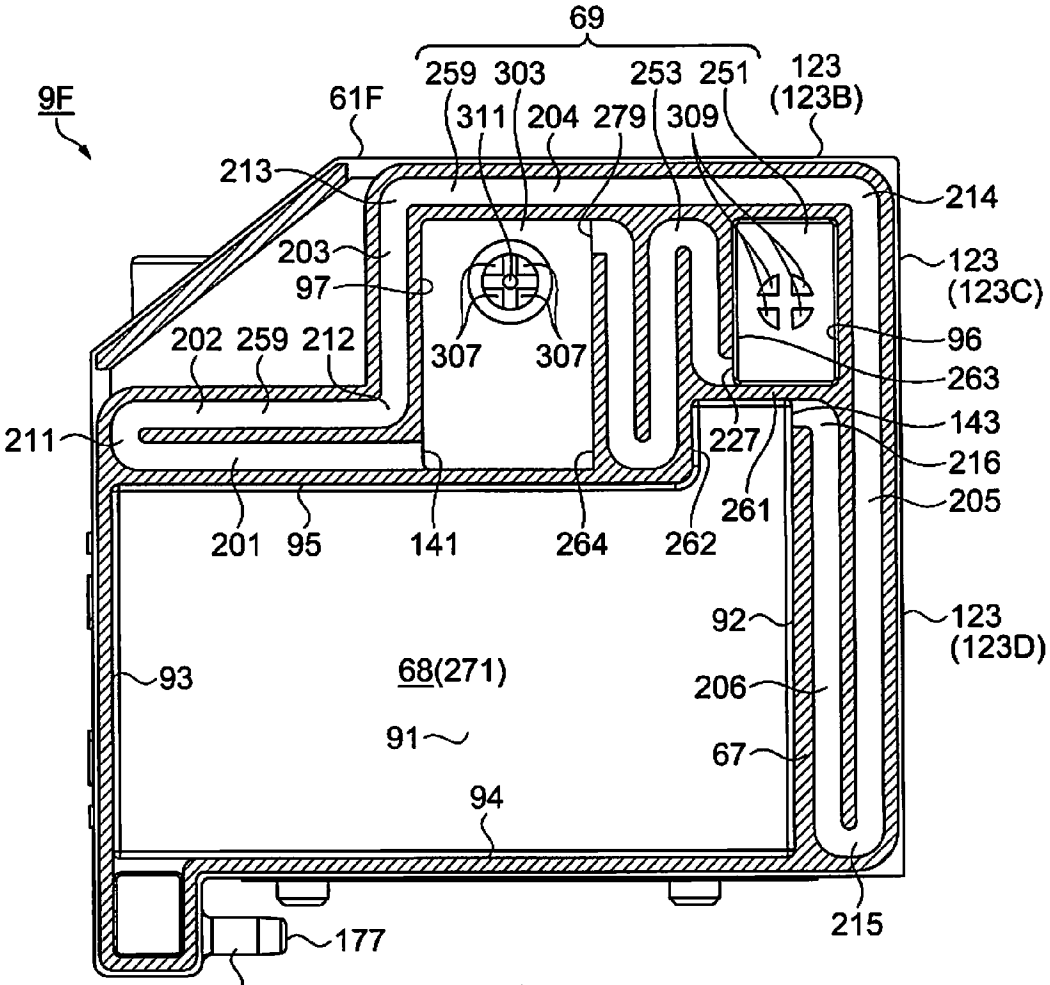
FIG. 32 is a side view of when a tank in a working example 6 is seen from a sheet member side.

The tank 9F has the storage section 68 and the communicating section 69, as illustrated in FIG. 32. The communicating section 69 of the tank 9F omits the air communication section 179, the air communication port 181, and the thirteenth wall 265 of the tank 9D in the working example 4. In the tank 9F, the communicating section 69 has the first air chamber 251, the first communicating passage 253, a second air chamber 303, and the second communicating passage 259. FIG. 32 illustrates a state where the tank 9F is seen from the sheet member 63 side, and depicts the case 61F with the sheet member 63 therebetween. The storage section 68, the first air chamber 251, the first communicating passage 253, the second air chamber 303, and the second communicating passage 259 are partitioned from one another by the bonded section 67.

Arranged on the opposite side to the storage section 68 side of the fifth wall 95 are the first air chamber 251, the first communicating passage 253, the second air chamber 303, and the second communicating passage 259. When the first wall 91 is seen in plan view from the sheet member 63 side, the storage section 68 is surrounded by the second wall 92, the third wall 93, the fourth wall 94, the fifth wall 95, the ninth wall 261, and the tenth wall 262. The second wall 92, the third wall 93, the fourth wall 94, the fifth wall 95, the ninth wall 261, and the tenth wall 262 extending in the −Y-axis direction from a main wall together constitute the recess 271, the main wall being the first wall 91. When the sheet member 63 is bonded to the case 61F, the recess 271 is closed off by the sheet member 63, thus constituting the storage section 68.

Figure 33:
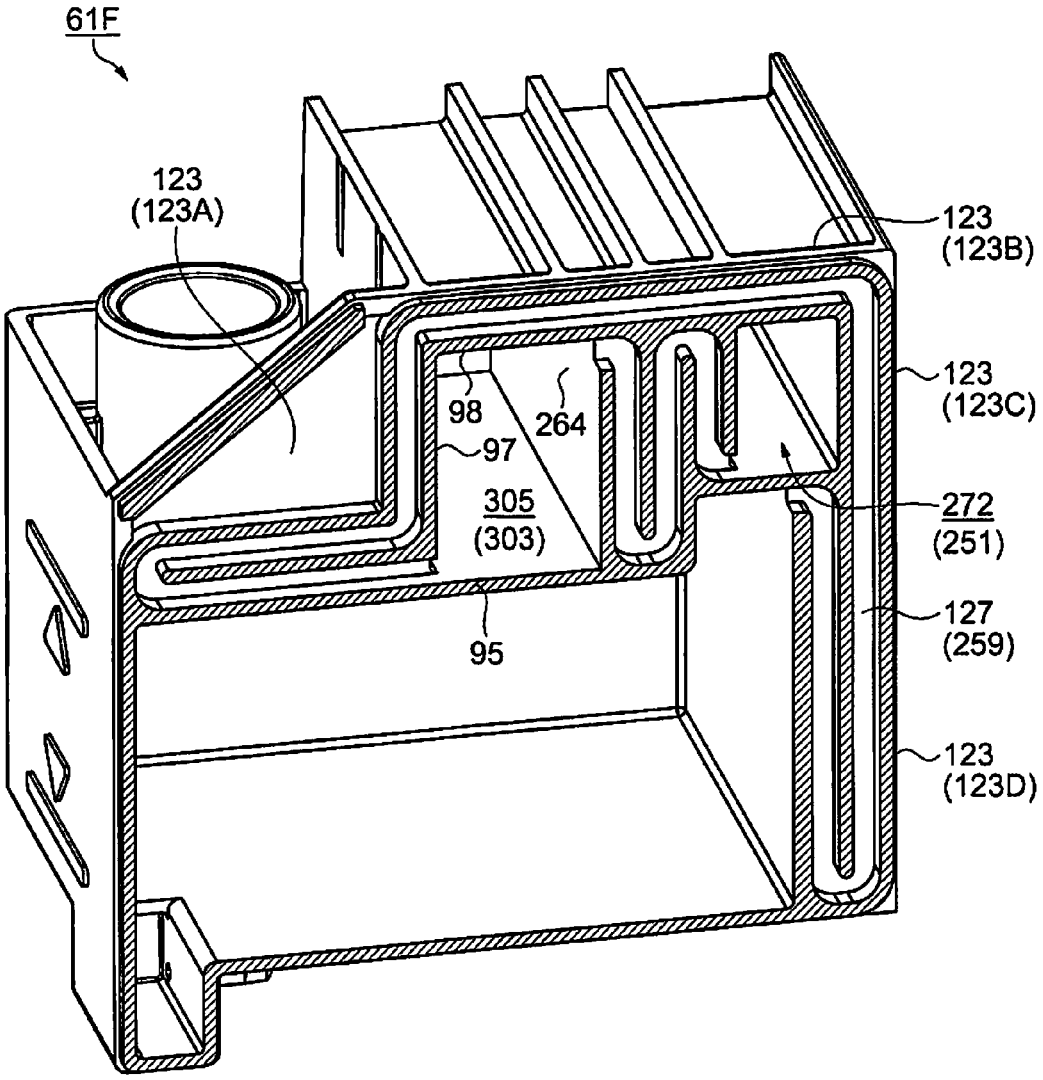
FIG. 33 is a perspective view illustrating a case in a working example 6.

The seventh wall 97, the eighth wall 98, and the twelfth wall 264 each project out in the −Y-axis direction from the first wall 91, as illustrated in FIG. 33. The fifth wall 95, the seventh wall 97, the eighth wall 98, and the twelfth wall 264 extending in the −Y-axis direction from the first wall 91 together constitute a recess 305. The recess 305 forms an opening going toward the −Y-axis direction side, i.e., the sheet member 63 (FIG. 31) side. When the sheet member 63 is bonded to the case 61F, the recess 305 is closed off by the sheet member 63, thus constituting the second air chamber 303.

A through hole 307 is formed on the first wall 91 in the second air chamber 303 (the recess 305), as illustrated in FIG. 32. A through hole 309 is formed on the first wall 91 in the first air chamber 251 (the recess 272). The through hole 307 and the through hole 309 each perforate through the first wall 91. For this reason, the inside of the second air chamber 303 and the exterior of the tank 9F are in communication via the through hole 307. Similarly, the inside of the first air chamber 251 and the exterior of the tank 9F are in communication via the through hole 309.

The first communicating passage 253 is provided between the eleventh wall 263 and the twelfth wall 264, and forms communication between the first air chamber 251 and the second air chamber 303. The configurations and arrangements of the second communicating passage 259, the communication port 141, the communication port 143, the extended section 123, and the groove 127 are similar to the working example 4, as illustrated in FIG. 33, and therefore a more detailed description is omitted here. In the tank 9F, as well, similarly to the working example 1 through working example 5, the second communicating passage 259 can be demarcated into the first passage 201, the second passage 202, the third passage 203, the fourth passage 204, the fifth passage 205, and the sixth passage 206, as illustrated in FIG. 32. Also, in the tank 9F, as well, similarly to the working example 1 through working example 5, the orientation of the flow path is reversed at each of the reversal section 211 and reversal section 215. The orientation of the flow path is bent at each of the bend section 212, the bend section 213, and the bend section 214.

A shaft section 311 is provided to a region of the first wall 91 that overlaps with the second air chamber 303, as illustrated in FIG. 32. The shaft section 311 is provided to inside the second air chamber 303, and projects out from the first wall 91 in the −Y-axis direction, i.e., from the first wall 91 toward the sheet member 63 (FIG. 31) side. The through hole 307 is provided to the periphery of the shaft section 311. The through hole 159 (FIG. 31) of the air introduction valve 65 is inserted onto the shaft section 311. The air introduction valve 65 has a size that covers the through hole 307. For this reason, when the through hole 159 of the air introduction valve 65 is inserted onto the shaft section 311, the through hole 307 is closed off by the air introduction valve 65.

Figure 34:
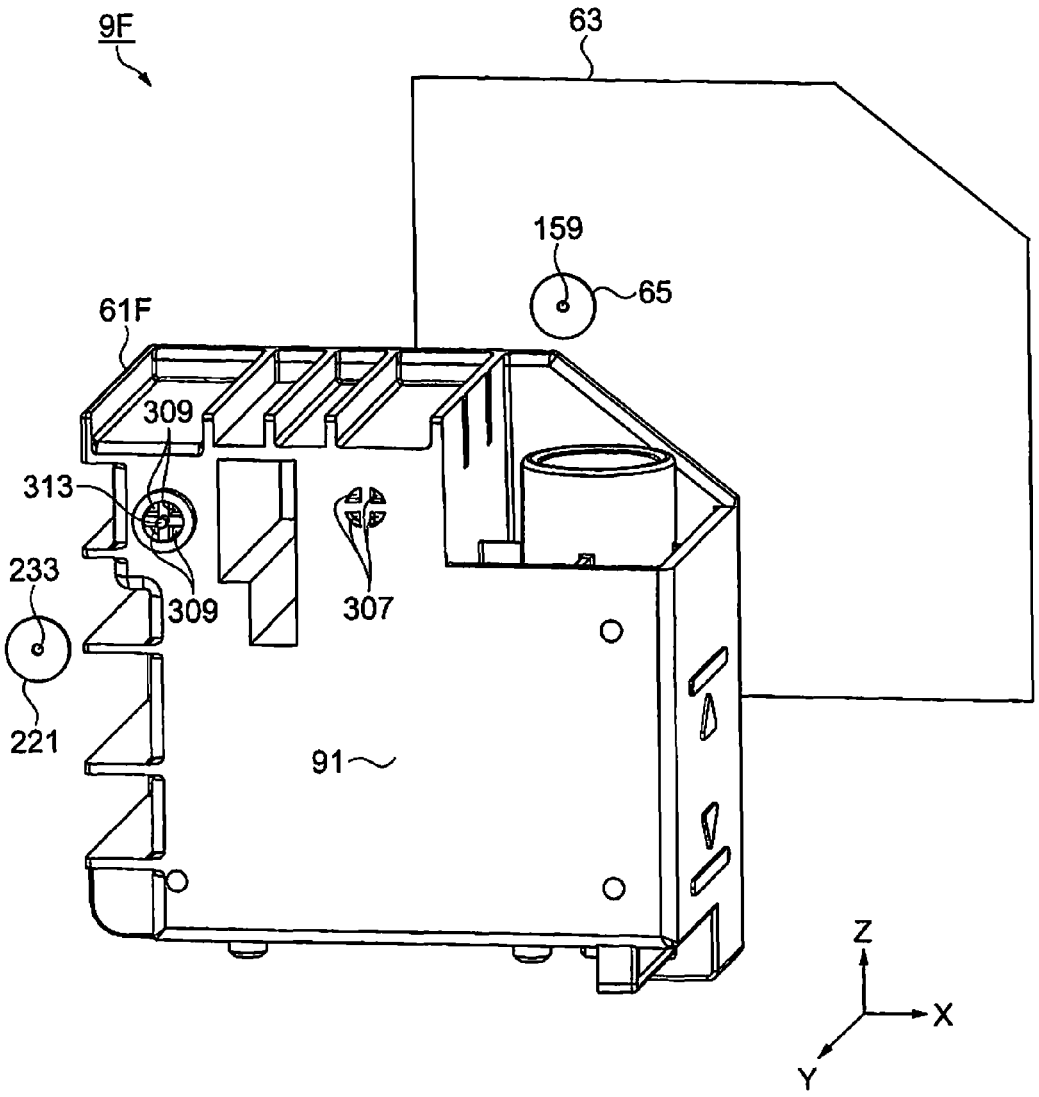
FIG. 34 is an exploded perspective view illustrating a tank in a working example 6.

On the opposite side to the first air chamber 251 side of the first wall 91, a shaft section 313 is provided to a region of the first wall 91 that overlaps with the first air chamber 251, as illustrated in FIG. 34. The shaft section 313 projects out from the first wall 91 toward the Y-axis direction, i.e., from the first wall 91 toward the opposite side to the sheet member 63 side. The through hole 309 is provided to the periphery of the shaft section 311. The through hole 233 of the air release valve 221 is inserted onto the shaft section 313. The air release valve 221 has a size that covers the through hole 309. For this reason, when the through hole 233 of the air release valve 221 is inserted onto the shaft section 313, the through hole 309 is closed off by the air release valve 221. The air release valve 221 and the air introduction valve 65 interrupt the communicating state between the exterior of the tank 9F and the air chamber 291 (FIG. 32). The first wall 91 is a wall that faces the sheet member 63, which seals off the recess 271, the recess 272, and the recess 305. For this reason, the air release valve 221 and the air introduction valve 65 are provided to the first wall 91, which faces the sheet member 63.

The air introduction valve 65 is provided within the second air chamber 303. For this reason, the area between the exterior of the tank 9F and the second air chamber 303 is closed from the second air chamber 303 side by the air introduction valve 65. The air release valve 221 is provided to the outside of the tank 9F. For this reason, the area between the exterior of the tank 9F and the first air chamber 251 is closed from the outside of the tank 9F by the air release valve 221. The operations of the air introduction valve 65 and the air release valve 221 are similar to those in the working example 1 through working example 5, and therefore a description thereof is omitted here.

When the pressure inside the storage section 68 becomes lower than the atmospheric pressure, then the air introduction valve 65 is opened and the air of the exterior of the tank 9F flows into the second air chamber 303 from the through hole 307. The air that has flowed into the second air chamber 303 then flows into the storage section 68 via the second communicating passage 259. This makes it easy to maintain the pressure inside the storage section 68 at the atmospheric pressure. When the pressure inside the storage section 68 becomes higher than the atmospheric pressure, then the air release valve 221 is opened and the air inside the storage section 68 is discharged to the exterior of the tank 9F from the through hole 309 by way of the communicating section 69. This makes it easy to maintain the pressure inside the storage section 68 at the atmospheric pressure.

In the working example 6, the case 61F corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Effects similar to those of the working example 1 through working example 5 are also obtained in the working example 6.

Furthermore, in the working example 5, the air release valve 221 and the air introduction valve 65 are provided to the first wall 91, which faces the sheet member 63. Herein, in a case where, for example, the case 61F is formed by injection molding of a resin, then the recess 293 and the recess 271 can be formed by moving the mold along the Y-axis in a manner relative to the case 61F. For this reason, the direction of extension of the through hole 307 and the through hole 309 preferably runs along the direction of movement of the mold, in terms of the ease of molding. In the working example 6, the direction of extension of the through hole 307 and the through hole 309 runs along the direction of movement of the mold, and therefore the case 61F can be made easier to mold.

Working Example 7

Figure 35:
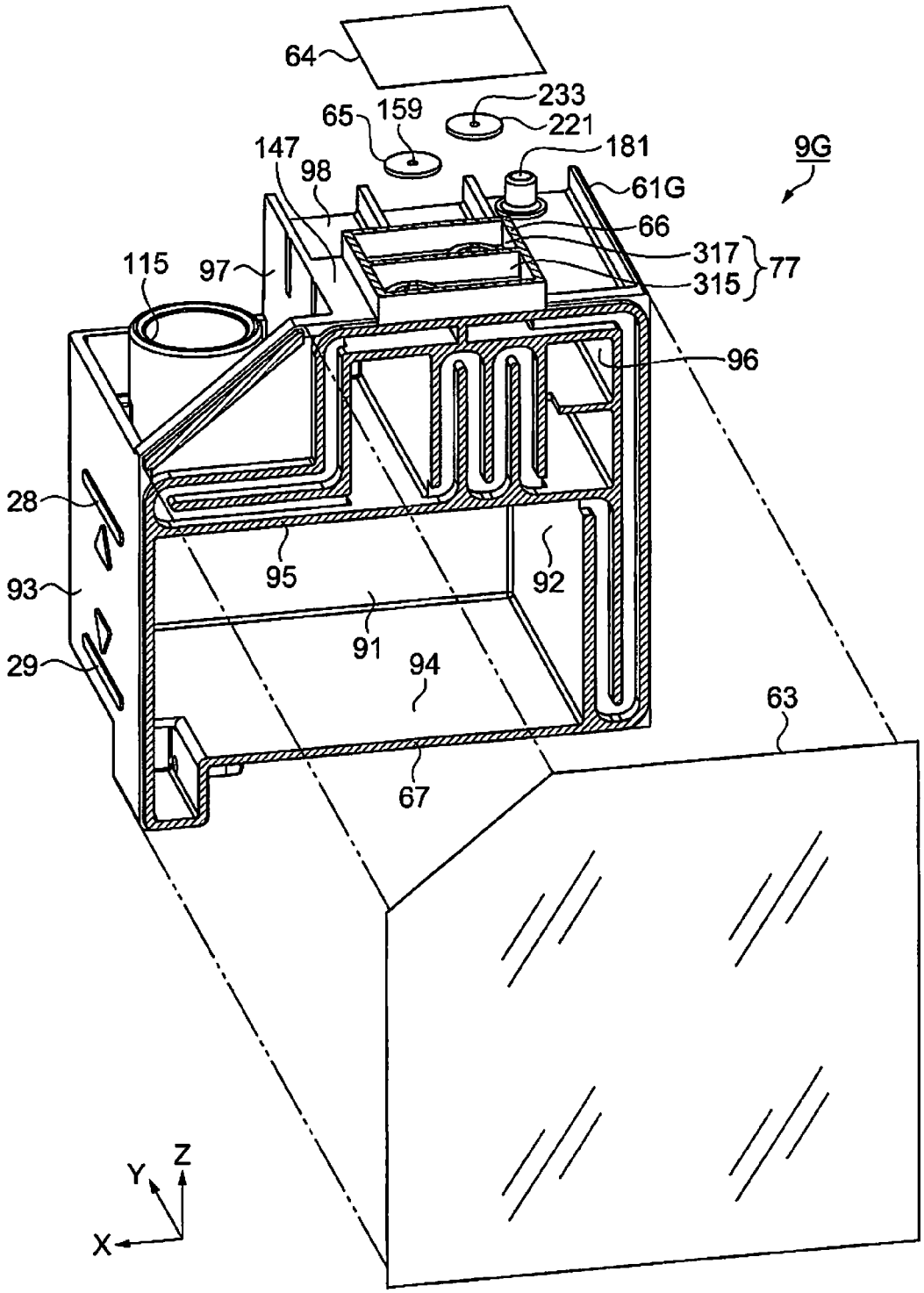
FIG. 35 is an exploded perspective view illustrating a tank in a working example 7.

A tank 9G in a working example 7 shall now be described. The working example 7 omits a detailed description of configurations that are identical to the working example 1 through working example 6, and assigns thereto the same reference signs as in the working example 1 through working example 6. The tank 9G, as illustrated in FIG. 35, has a case 61G that is one example of a tank main body, as well as the sheet member 63, the sheet member 64, the air introduction valve 65, and the air release valve 221. The case 61G is constituted of, for example, a synthetic resin such as nylon or polypropylene. The tank 9G has the same configuration as the tank 9A in the working example 1 except in that the communicating chamber 77 is partitioned into a first communicating chamber 315 and a second communicating chamber 317, and the air release valve 221 is provided inside the second communicating chamber 317.

Similarly to the working example 1, the bonded section 67 and the bonded section 66 are provided to the case 61G. The sheet member 63 is bonded to the bonded section 67 and the sheet member 64 is bonded to the bonded section 66. The tank 9G possesses a configuration where the case 61G and the sheet member 63 are bonded together and the case 61G and the sheet member 64 are also bonded together. The first communicating chamber 315 and the second communicating chamber 317 are partitioned from one another by the bonded section 66.

Figure 36:
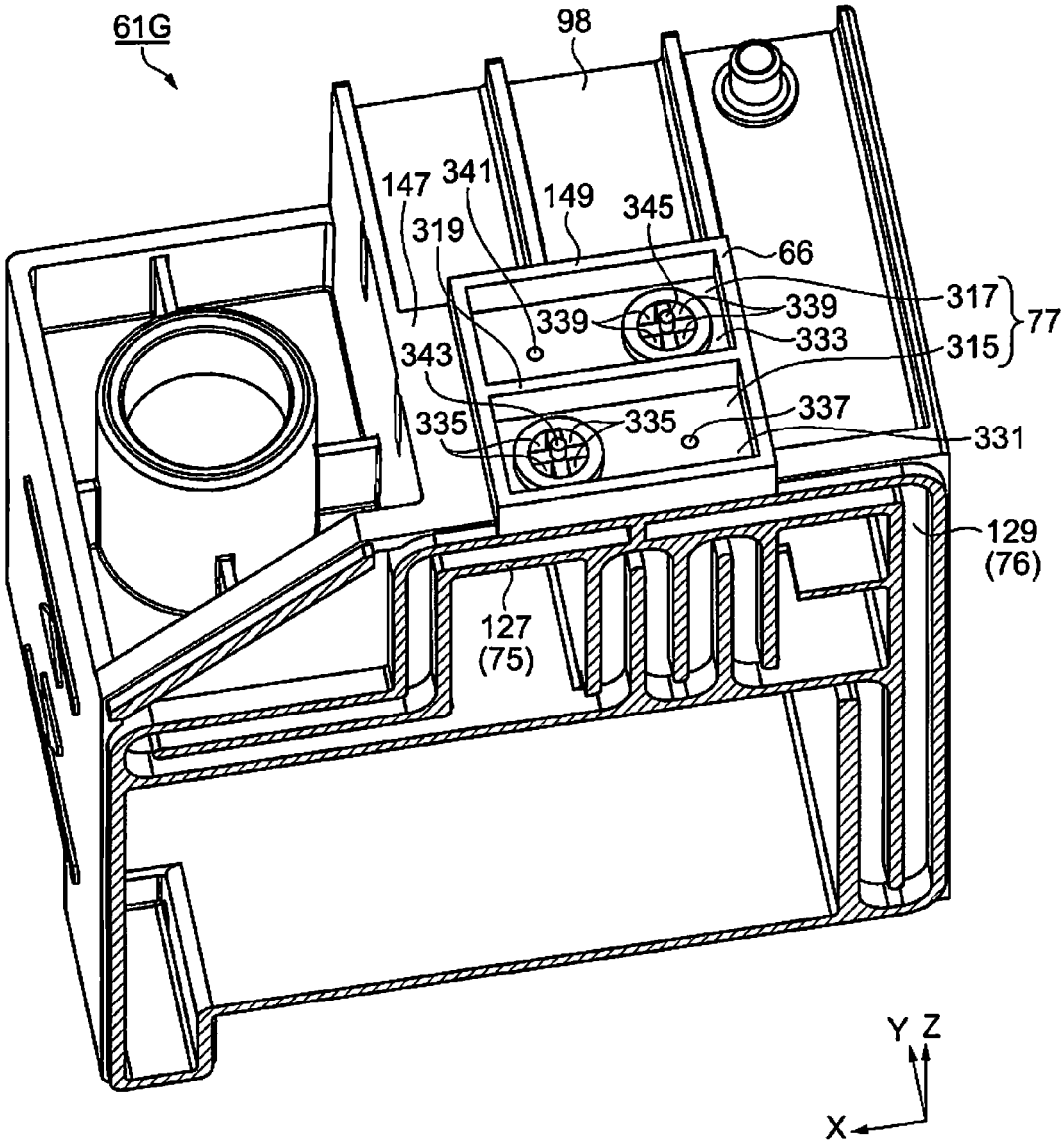
FIG. 36 is a perspective view illustrating a case in a working example 7.

The communicating chamber 77, as illustrated in FIG. 36, is provided to the eighth wall 98. The wall 147 that projects out more to the Z-axis direction than the eighth wall 98 is provided to the eighth wall 98. The surrounding wall 149 that surrounds the communicating chamber 77 is provided to the wall 147. The surrounding wall 149 projects out in the Z-axis direction from the wall 147. A partition wall 319 for partitioning the communicating chamber 77 into the first communicating chamber 315 and the second communicating chamber 317 is provided to the wall 147 inside the region surrounded by the surrounding wall 149. The partition wall 319 projects out in the Z-axis direction from the wall 147. A recess 331 and a recess 333 are formed by the surrounding wall 149, the wall 147, and the partition wall 319.

The recess 331 and the recess 333 are each opened toward the Z-axis direction. In other words, the recess 331 and the recess 333 are each formed at an orientation so as to be concave going toward the –Z-axis direction, i.e., toward the fifth wall 95 side. A Z-axis direction-side end of the surrounding wall 149 and the partition wall 319 is set so as to be the bonded section 66 described above. When the sheet member 64 (FIG. 35) is bonded to the bonded section 66 of the case 61F, the recess 331 and the recess 333 are closed off by the sheet member 64. This constitutes the first communicating chamber 315 and the second communicating chamber 317.

A through hole 335 and a through hole 337 that perforate through the wall 147 are provided inside the recess 331 (the first communicating chamber 315). A through hole 339 and a through hole 341 that perforate through the wall 147 are provided inside the recess 333 (the second communicating chamber 317). The through hole 335 and the through hole 341 are communicated to the groove 127 (the second communicating passage 75). The through hole 337 and the through hole 339 are communicated to the groove 129 (the third communicating passage 76). This causes the second communicating passage 75 and the third communicating passage 76 to be communicated to one another via each of the first communicating chamber 315 and the second communicating chamber 317. In other words, the second communicating passage 75 and the third communicating passage 76 are in communication with one another via the first communicating chamber 315. The second communicating passage 75 and the third communicating passage 76 are also in communication with one another via the second communicating chamber 317.

Figure 37:
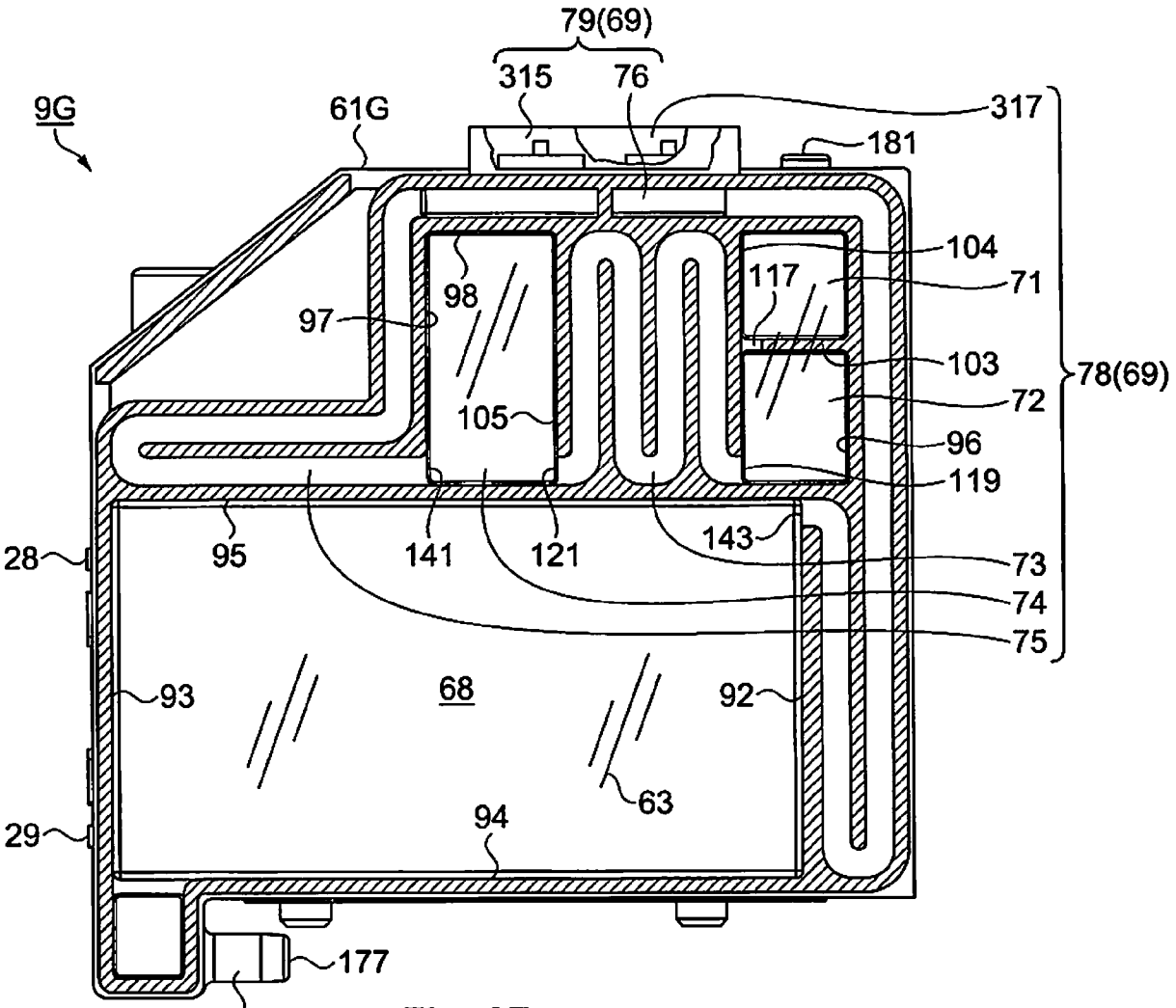
FIG. 37 is a side view of when a tank in a working example 7 is seen from a sheet member side.

Similarly to the working example 1, the tank 9G has the storage section 68, the first air chamber 71, the second air chamber 72, the first communicating passage 73, the third air chamber 74, the second communicating passage 75, and the third communicating passage 76, as illustrated in FIG. 37. In the tank 9G, the first communicating section 78 includes the first air chamber 71, the second air chamber 72, the first communicating passage 73, the third air chamber 74, the second communicating passage 75, and the second communicating chamber 317. The first communicating chamber 315 and the third communicating passage 76 are included in the second communicating section 79. The first communicating section 78 and the second communicating section 79 together constitute the communicating section 69.

A shaft section 343 is provided inside the first communicating chamber 315 (the recess 331), as illustrated in FIG. 36. The shaft section 343 projects out in the Z-axis direction from the wall 147. The amount by which the shaft section 343 projects out from the wall 147 is smaller than the amount by which the surrounding wall 149 and the partition wall 319 project out from the wall 147. For this reason, the shaft section 343 fits inside the recess 331. The through hole 335 is provided to the periphery of the shaft section 343. The through hole 159 (FIG. 35) of the air introduction valve 65 is inserted onto the shaft section 343. The air introduction valve 65 has a size that covers the through hole 335. For this reason, when the through hole 159 of the air introduction valve 65 is inserted onto the shaft section 343, the through hole 335 is closed off by the air introduction valve 65.

A shaft section 345 is provided inside the second communicating chamber 317 (the recess 333). The shaft section 345 projects out in the Z-axis direction from the wall 147. The amount by which the shaft section 345 projects out from the wall 147 is smaller than the amount by which the surrounding wall 149 and the partition wall 319 project out from the wall 147. For this reason, the shaft section 345 fits inside the recess 333. The through hole 339 is provided to the periphery of the shaft section 345. The through hole 233 (FIG. 35) of the air release valve 221 is inserted onto the shaft section 345. The air release valve 221 has a size that covers the through hole 339. For this reason, when the through hole 233 of the air release valve 221 is inserted onto the shaft section 345, the through hole 339 is closed off by the air release valve 221.

The air release valve 221 and the air introduction valve 65 interrupt the communicating state between the air communication port 181 and the storage section 68. In the tank 9G, the air introduction valve 65 is provided between the second communicating passage 75 and the first communicating chamber 315. For this reason, in the tank 9G, the communicating section 69 is closed between the first communicating section 78 (FIG. 37) and the second communicating section 79 by the air introduction valve 65. The air introduction valve 65 is provided inside the first communicating chamber 315. The first communicating chamber 315 is included in the second communicating section 79. For this reason, the area between the first communicating section 78 (FIG. 37) and the second communicating section 79 is closed from the first communicating section 78 side by the air introduction valve 65.

Also, in the tank 9G, the air release valve 221 is provided between the third communicating passage 76 and the second communicating chamber 317. For this reason, in the tank 9G, the communicating section 69 is closed between the first communicating section 78 (FIG. 37) and the second communicating section 79 by the air release valve 221. The air release valve 221 is provided inside the second communicating chamber 317. The second communicating chamber 317 is included in the first communicating section 78. For this reason, the area between the first communicating section 78 (FIG. 37) and the second communicating section 79 is closed from the second communicating section 79 side by the air release valve 221. The operations of the air introduction valve 65 and the air release valve 221 are similar to those in the working example 1 through working example 6, and therefore a description thereof is omitted here.

When the pressure inside the storage section 68 becomes lower than the atmospheric pressure, then the air introduction valve 65 is opened and the air inside the third air chamber 74 flows into the storage section 68 by way of the second communicating passage 75, the first communicating chamber 315, and the third communicating passage 76. This makes it easy to maintain the pressure inside the storage section 68 at the atmospheric pressure. When the pressure inside the storage section 68 becomes higher than the atmospheric pressure, then the air release valve 221 is opened and the air inside the storage section 68 is discharged to the exterior of the tank 9G by way of the first communicating section 78 from the third communicating passage 76. This makes it easy for the pressure inside the storage section 68 to be kept at atmospheric pressure.

Figure 38:
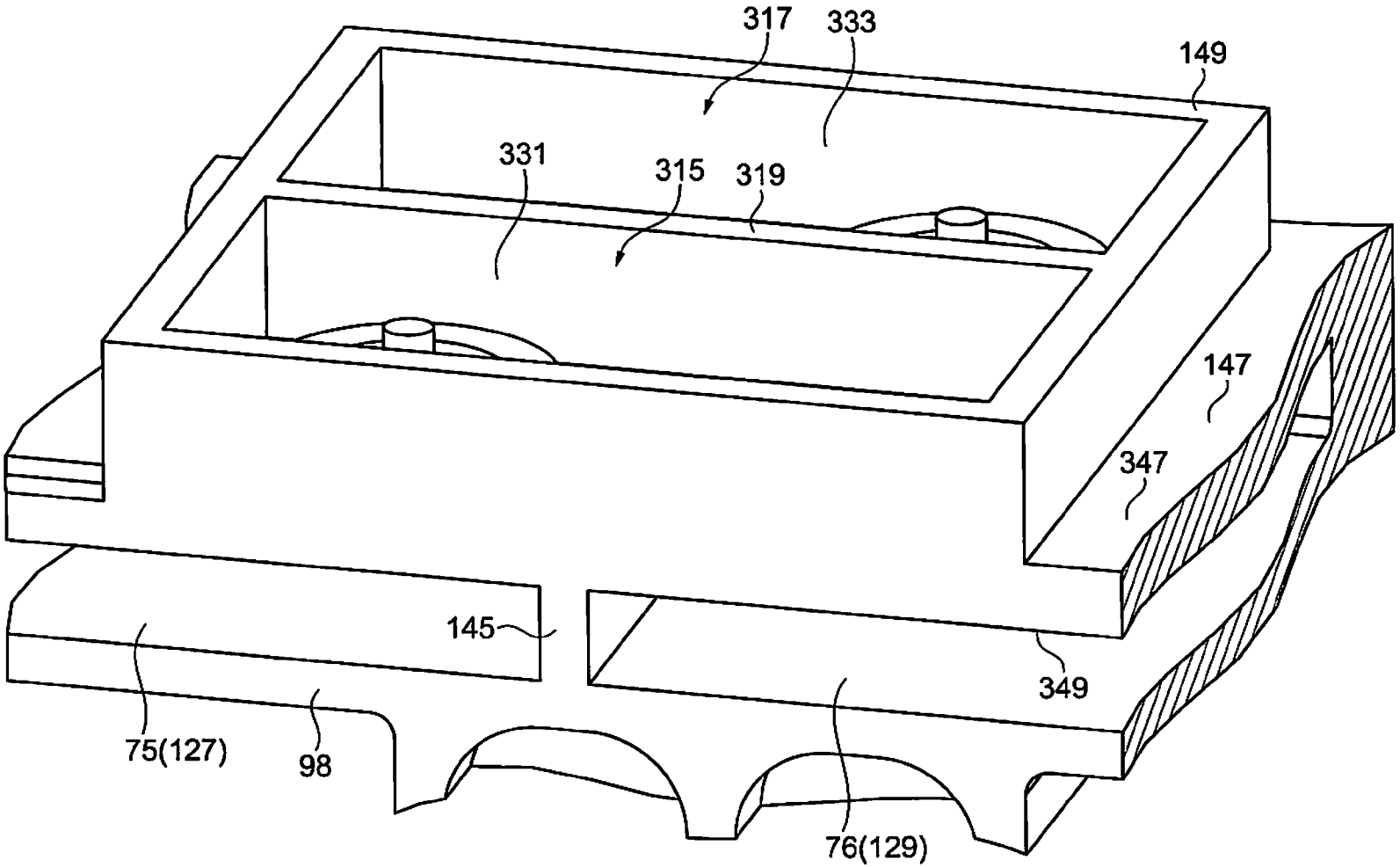
FIG. 38 is a perspective view enlarging a recess in a communicating chamber of a case in a working example 7.

Herein, the compartmentalization between the first communicating section 78 and the second communicating section 79 shall now be described. As stated above, the second communicating passage 75 and the second communicating chamber 317 are included in the first communicating section 78. The first communicating chamber 315 and the third communicating passage 76 are included in the second communicating section 79. The recess 331 constituting the first communicating chamber 315 and the recess 333 constituting the second communicating chamber 317 are compartmentalized each by the wall 147, the surrounding wall 149, and the partition wall 319, as illustrated in FIG. 38. The groove 127 of the second communicating passage 75 and the groove 129 of the third communicating passage 76 are compartmentalized each by the eighth wall 98, the compartmentalizing wall 145, and the wall 147. For this reason, the wall 147, the partition wall 319, and the compartmentalizing wall 145 can each be regarded as being a wall for compartmentalizing between the first communicating section 78 and the second communicating section 79.

The partition wall 319 is provided to a first surface 347 of the wall 147. The first surface 347 is a surface of the opposite side to the eighth wall 98 side of the wall 147. The compartmentalizing wall 145 is provided to a second surface 349 of the wall 147. The second surface 349 is a surface of the eighth wall 98 side of the wall 147, i.e., a surface of the opposite side to the first surface 347 side of the wall 147. The compartmentalizing wall 145 is provided spanning across the eighth wall 98 and the wall 147. For this reason, the groove 127 of the second communicating passage 75 and the groove 129 of the third communicating passage 76 are partitioned by the compartmentalizing wall 145.

The air introduction valve 65 and the air release valve 221 are each provided to the first surface 347 side of the wall 147, as illustrated in FIG. 36. The air introduction valve 65 and the air release valve 221 are provided so as to each be deformable in the Z-axis direction by a pressure difference between the first communicating section 78 (FIG. 37) and the second communicating section 79. For this reason, the orientation of air flowing into the first communicating chamber 315 from the second communicating passage 75 and the orientation of air flowing into the second communicating chamber 317 from the third communicating passage 76 can be oriented toward the first surface 347 side from the second surface 349 side. Also, according to this configuration, the weight of the air introduction valve 65 makes it easier to reliably close the air introduction valve 65 when the air introduction valve 65 is closed. Similarly, when the air release valve 221, the weight of the air release valve 221 makes it easier to reliably close the air release valve 221.

In the working example 7, the case 61G corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Also, the wall 147 corresponds to a first compartmentalizing wall, the partition wall 319 corresponds to a second compartmentalizing wall, and the compartmentalizing wall 145 corresponds to a third compartmentalizing wall. Effects similar to those of the working example 1 through working example 6 are also obtained in the working example 7.

Working Example 8

Figure 39:
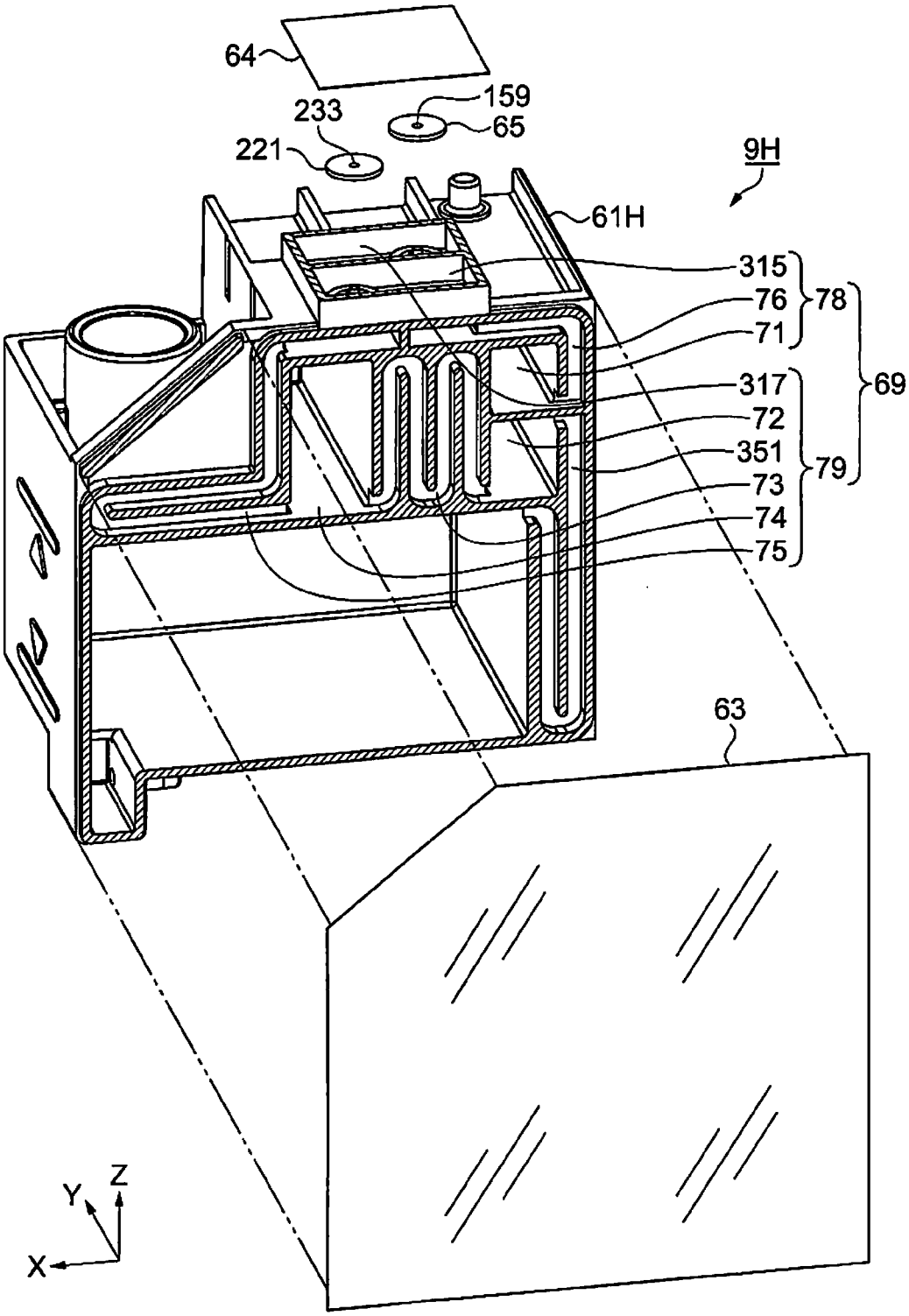
FIG. 39 is an exploded perspective view illustrating a tank in a working example 8.

A tank 9H in a working example 8 shall now be described. The working example 8 omits a detailed description of configurations that are identical to the working example 1 through working example 7, and assigns thereto the same reference signs as in the working example 1 through working example 7. The tank 9H, as illustrated in FIG. 39, has a case 61H that is one example of a tank main body, as well as the sheet member 63, the sheet member 64, the air introduction valve 65, and the air release valve 221. The case 61H is constituted of, for example, a synthetic resin such as nylon or polypropylene. The tank 9H differs from the working example 7 in that a fourth communicating passage 351 is added. The tank 9H also differs from the working example 7 in the route leading from the air communication port 181 to the storage section 68. The tank 9H further differs from the working example 7 in that the air introduction valve 65 is provided inside the second communicating chamber 317 and the air release valve 221 is provided inside the first communicating chamber 315. Except for these features, the tank 9H otherwise has the same configuration as the tank 9G in the working example 7.

The tank 9H has the storage section 68, the first air chamber 71, the second air chamber 72, the first communicating passage 73, the third air chamber 74, the third communicating passage 76, the third communicating passage 76, and the fourth communicating passage 351. In the tank 9H, the first communicating section 78 includes the first air chamber 71, the second communicating passage 75, and the first communicating chamber 315. The second air chamber 72, the first communicating passage 73, the third air chamber 74, the second communicating passage 75, and the second communicating chamber 317 are included in the second communicating section 79. The first communicating section 78 and the second communicating section 79 together constitute the communicating section 69.

Figure 40:
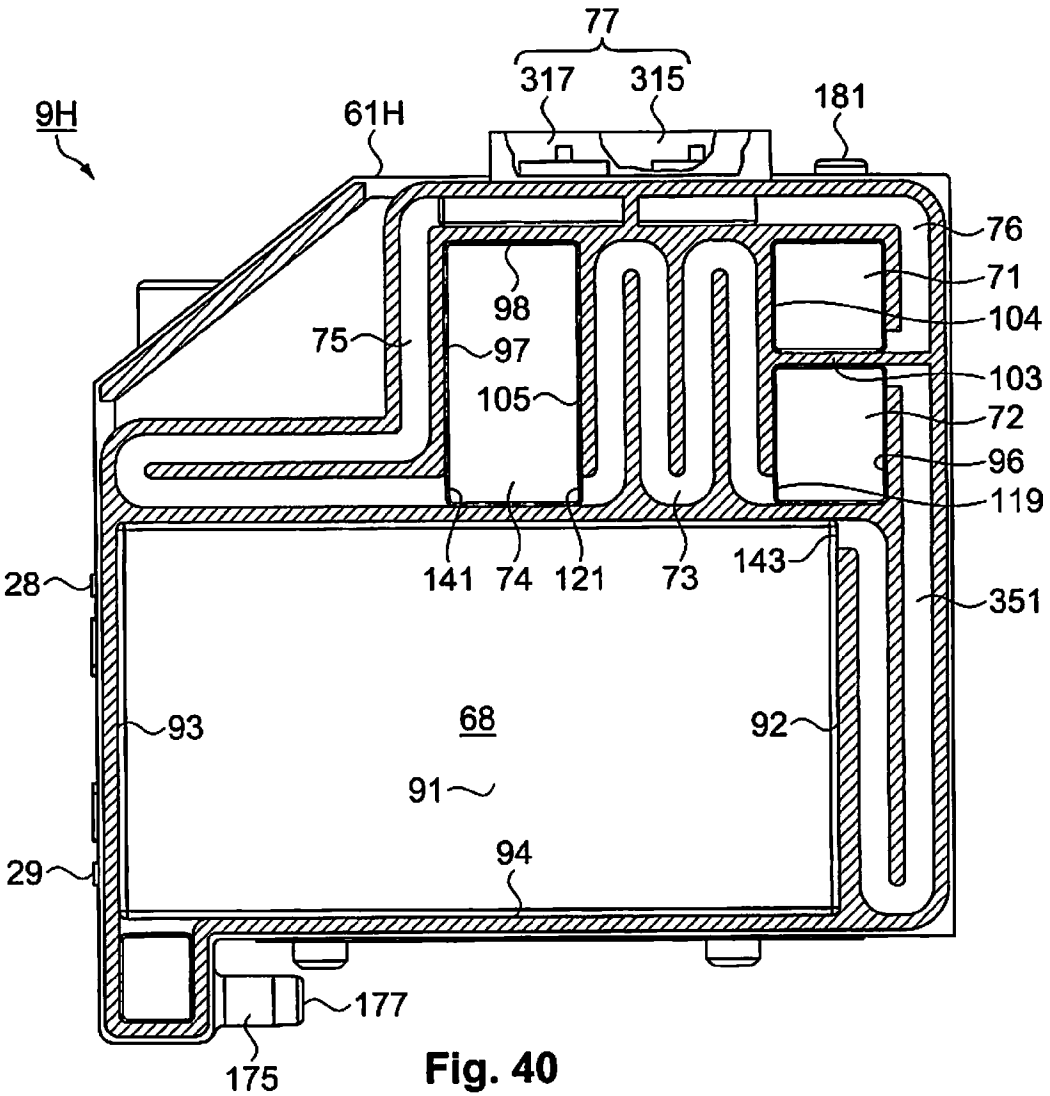
FIG. 40 is a side view of when a tank in a working example 8 is seen from a sheet member side.

In the tank 9H, the ninth wall 103 between the first air chamber 71 and the second air chamber 72 is provided spanning across the first air chamber 71 and the second air chamber 72, as illustrated in FIG. 40. For this reason, the first air chamber 71 and the second air chamber 72 are partitioned from one another by the ninth wall 103. The third communicating passage 76 forms communication between the first air chamber 71 and the communicating chamber 77. The fourth communicating passage 351 forms communication between the second air chamber 72 and the storage section 68.

Herein, the route of air leading from the air communication port 181 to the storage section 68 shall now be described. The air that has flowed into the tank 9H from the air communication port 181 then flows into the first air chamber 71. The air that has flowed into the first air chamber 71 then flows into the communicating chamber 77 by way of the third communicating passage 76. The air that has flowed into the communicating chamber 77 then flows into the third air chamber 74 by way of the second communicating passage 75. The air that has flowed into the third air chamber 74 then flows into the second air chamber 72 by way of the first communicating passage 73. The air that has flowed into the second air chamber 72 then reaches the storage section 68 by way of the fourth communicating passage 351.

Configurations other than the configuration described above are the same as the working example 7. For this reason, a more detailed description of the configurations other than the configuration described above has been omitted here. The operations of the air introduction valve 65 and the air release valve 221 are similar to those in the working example 1 through working example 7, and therefore a description thereof is omitted here.

When the pressure inside the storage section 68 becomes lower than the atmospheric pressure, the air introduction valve 65 opens. When the air introduction valve 65 opens, the air that has flowed into the first air chamber 71 from the air communication port 181 then flows into the storage section 68 by way of the second communicating chamber 317, the second communicating passage 75, the third air chamber 74, the first communicating passage 73, the second air chamber, and the fourth communicating passage 351, in the stated order. This makes it easy to maintain the pressure inside the storage section 68 at the atmospheric pressure. When the pressure inside the storage section 68 becomes higher than the atmospheric pressure, the air release valve 221 opens. When the air release valve 221 opens, then the air inside the storage section 68 is discharged to the exterior of the tank 9H from the air communication port 181 by way of the fourth communicating passage 351, the second air chamber 72, the first communicating passage 73, the third air chamber 74, the second communicating passage 75, the first communicating chamber 315, and the first air chamber 71, in the stated order. This makes it easy for the pressure inside the storage section 68 to be kept at atmospheric pressure.

In the working example 8, the case 61H corresponds to a housing, the sheet member 63 corresponds to a sealing member, the storage section 68 corresponds to a liquid storage section, the opening 191 of the ink injection section 115 corresponds to an injection port, the air communication port 181 corresponds to an air introduction opening, the communicating section 69 corresponds to an air communication section, the first communicating section 78 corresponds to a first air communication section, and the second communicating section 79 corresponds to a second air communication section. Also, the wall 147 corresponds to a first compartmentalizing wall, the partition wall 319 corresponds to a second compartmentalizing wall, and the compartmentalizing wall 145 corresponds to a third compartmentalizing wall. Effects similar to those of the working example 7 are also obtained in the working example 8.

Moreover, in the working example 8, the route leading to the communicating chamber 77 from the storage section 68 is longer than the route leading from the storage section 68 to the communicating chamber 77 in the working example 7. For this reason, in the working example 8, ink flowing back through the communicating section 69 from the storage section 68 will less readily reach the communicating chamber 77 than in the working example 7. This makes it easy to prevent the ink inside the storage section 68 from reaching the air communication port 181 in the working example 8. Consequently, it is even easier to avoid an event where the ink inside the storage section 68 leaks out of the tank 9H from the air communication port 181.

Second Embodiment

In the first embodiment, the plurality of tanks 9 are not built into the first case 6 that covers the mechanism unit 10. In other words, the first embodiment employs a configuration where the plurality of tanks 9 are arranged on the outside of the first case 6. However, a configuration where the plurality of tanks 9 are built into the first case 6 could also be employed. A configuration where the plurality of tanks 9 are built into a case shall now be described below as a second embodiment, using the example of a multifunction peripheral, which is one example of a liquid jet system.

Figure 41:
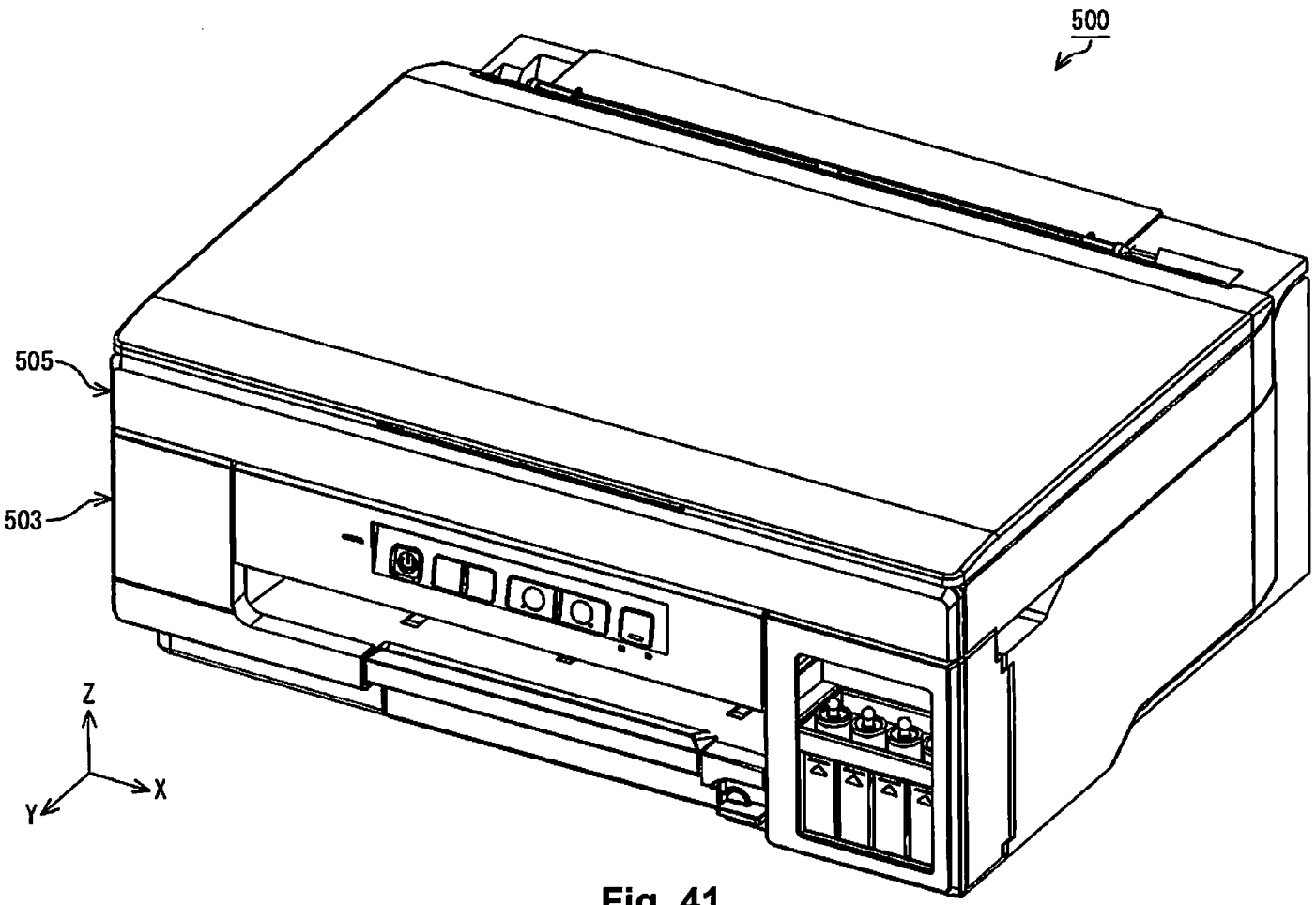
FIG. 41 is a perspective view illustrating a multifunction peripheral in a second embodiment.

A multifunction peripheral 500 in the present embodiment has a printer 503 and a scanner unit 505, as illustrated in FIG. 41. In the multifunction peripheral 500, the printer 503 and the scanner unit 505 are stacked onto one another. In the state where the printer 503 is used, the scanner unit 505 is located vertically above the printer 503. Here, in FIG. 41, XYZ axes have been assigned, which are coordinate axes that are orthogonal to one another. XYZ axes have been assigned where necessary in the subsequently illustrated drawings, as well. The XYZ axes in FIG. 41 confirm with the XYZ axes in FIG. 1, as do the XYZ axes in FIG. 41 and onward. A detailed description of configurations in the multifunction peripheral 500 that are similar to those of the liquid jet system 1 is omitted here, with the same reference signs being assigned thereto as the reference signs in the liquid jet system 1.

Figure 42:
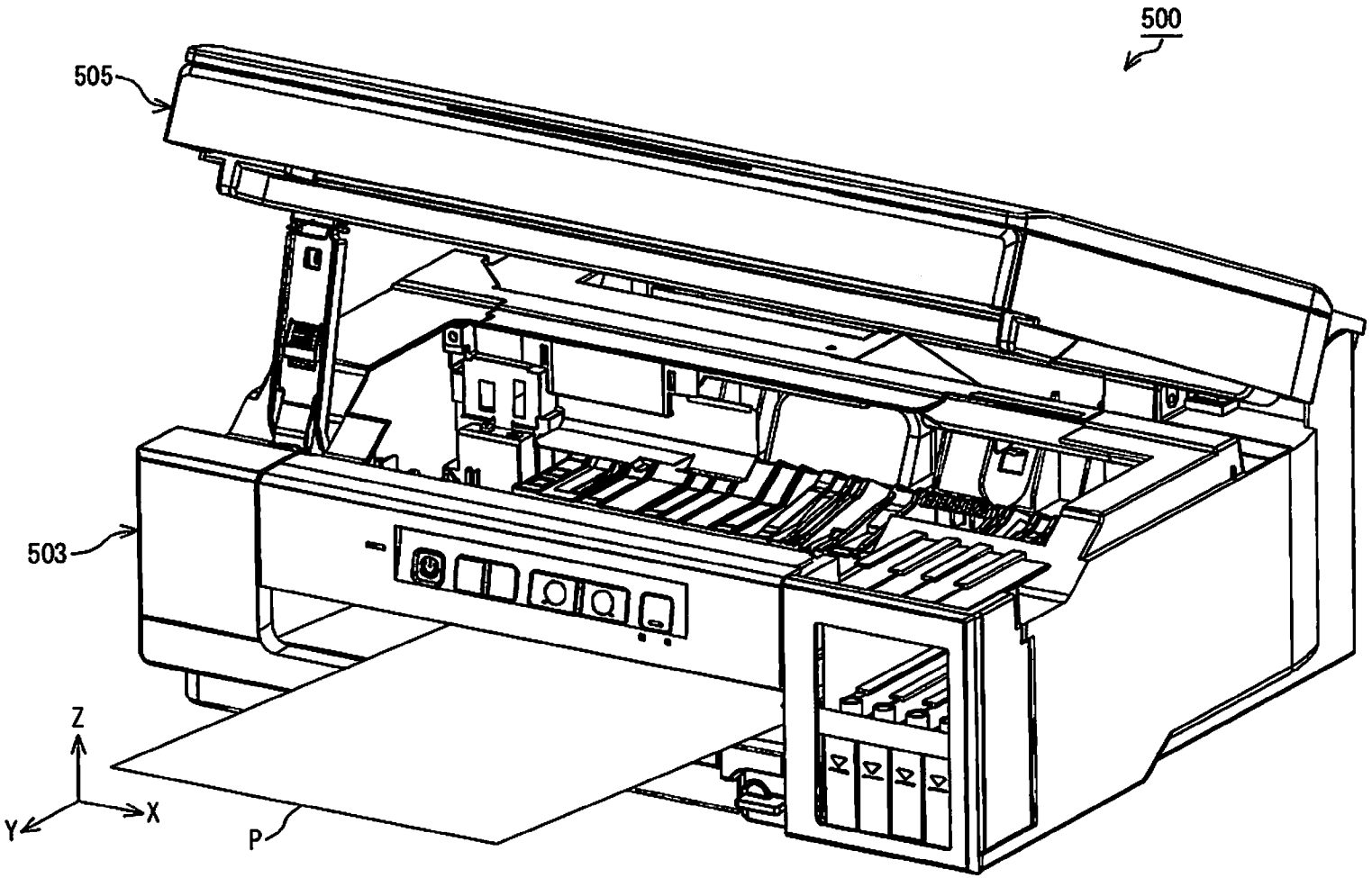
FIG. 42 is a perspective view illustrating a multifunction peripheral in a second embodiment.

The scanner unit 505 is of the flatbed-type, and has an imaging element (not shown) such as an image sensor, as well as a platen and a covering. Via the imaging element, the scanner unit 505 is able to read an image that has been recorded onto a medium such as paper, as image data. For this reason, the scanner unit 505 functions as an apparatus for reading images and the like. The scanner unit 505 is configured so as to be rotatable relative to a case 507 of the printer 503, as illustrated in FIG. 42. A surface on the printer 503 side of the platen of the scanner unit 505 covers the case 507 of the printer 503 and also has a function as a covering for the printer 503.

Figure 43:
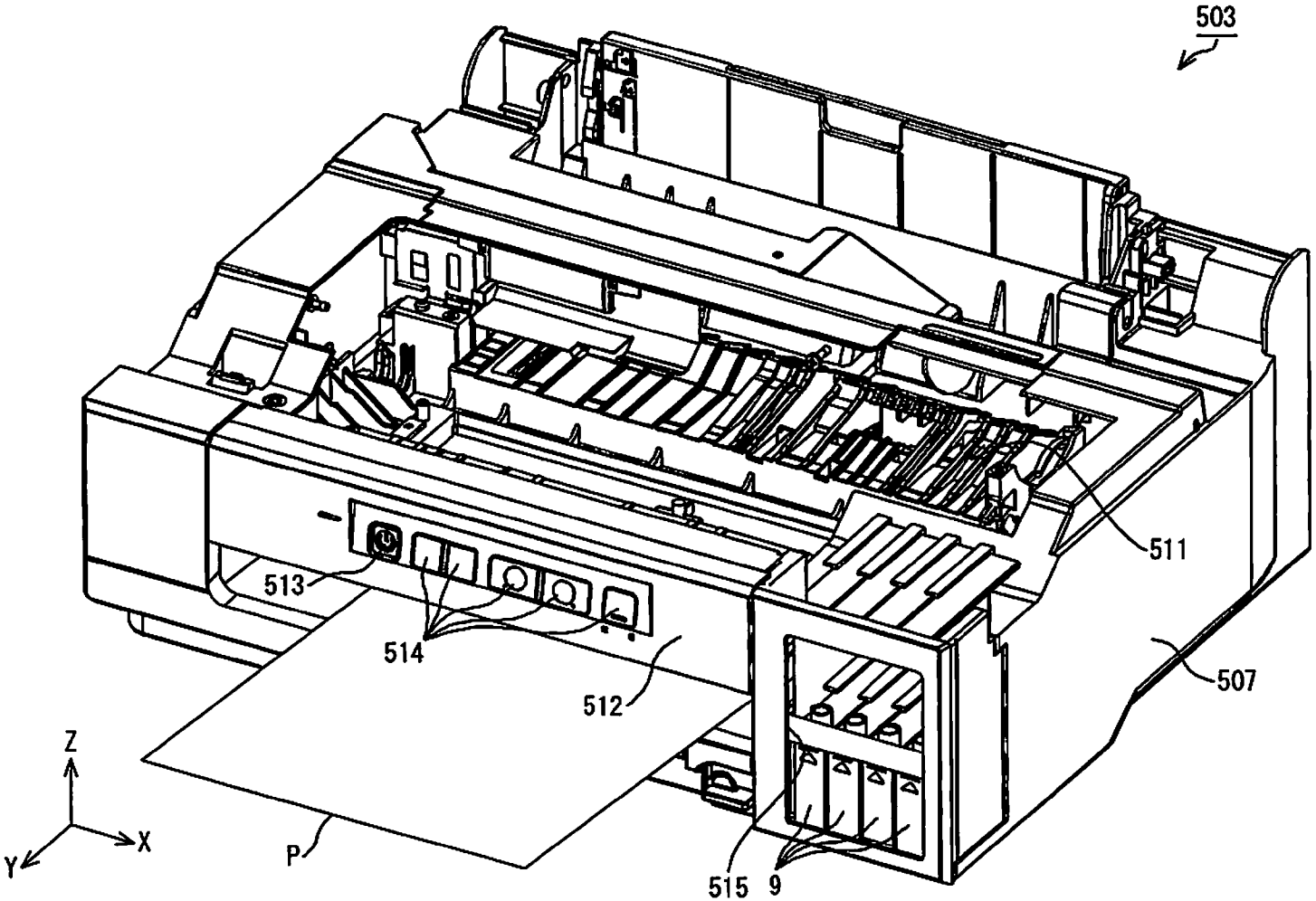
FIG. 43 is a perspective view illustrating a printer in a second embodiment.

The printer 503 is able to print onto the printing medium P of printing paper or the like using ink, which is one example of a liquid. The printer 503, as illustrated in FIG. 43, has the case 507 as well as the plurality of tanks 9, which are one example of a liquid storage container. The case 507 is an integrally formed article constituting an outer shell of the printer 503, and houses a mechanism unit 511 of the printer 503. The plurality of tanks 9 are stored inside the case 507, and each of the plurality of tanks 9 stores ink that is supplied for printing. In the printer 503, there are four of the tanks 9 provided. The four tanks 9 have different types of ink from one another. The four types of black, yellow, magenta, and cyan are employed as the types of ink in the printer 503. There is one tank 9 provided for each of the different kinds of ink.

The printer 503 also has an operation panel 512. Provided to the operation panel 512 are a power source button 513, another operation button 514, and the like. The worker who operates the printer 503 can face the operation panel 512 and in this state operate the power source button 513 or the operation button 514. In the printer 503, the surface to which the operation panel 512 is provided is understood to be the front surface. On the front surface of the printer 503, a window section 515 is provided to the case 507. The window section 515 is optically transparent. The four tanks 9 described above are provided to positions overlapping with the window section 515. For this reason, the worker is able to view the four tanks 9 through the window section 515.

In the printer 503, the sites of each of the tanks 9 that face the window section 515 are optically transparent. The inks inside the tanks 9 can be viewed from the optically transparent sites of each of the tanks 9. As such, viewing the four tanks 9 via the window section 515 allows the worker to view the amount of ink that is in each of the tanks 9. In the printer 503, because the window section 515 is provided to the front surface of the printer 503, the operator can face the operation panel 512 and in this state view each of the tanks 9 from the window section 515. For this reason, the worker can ascertain the amount of ink remaining in each of the tanks 9 while also operating the printer 503.

Figure 44:
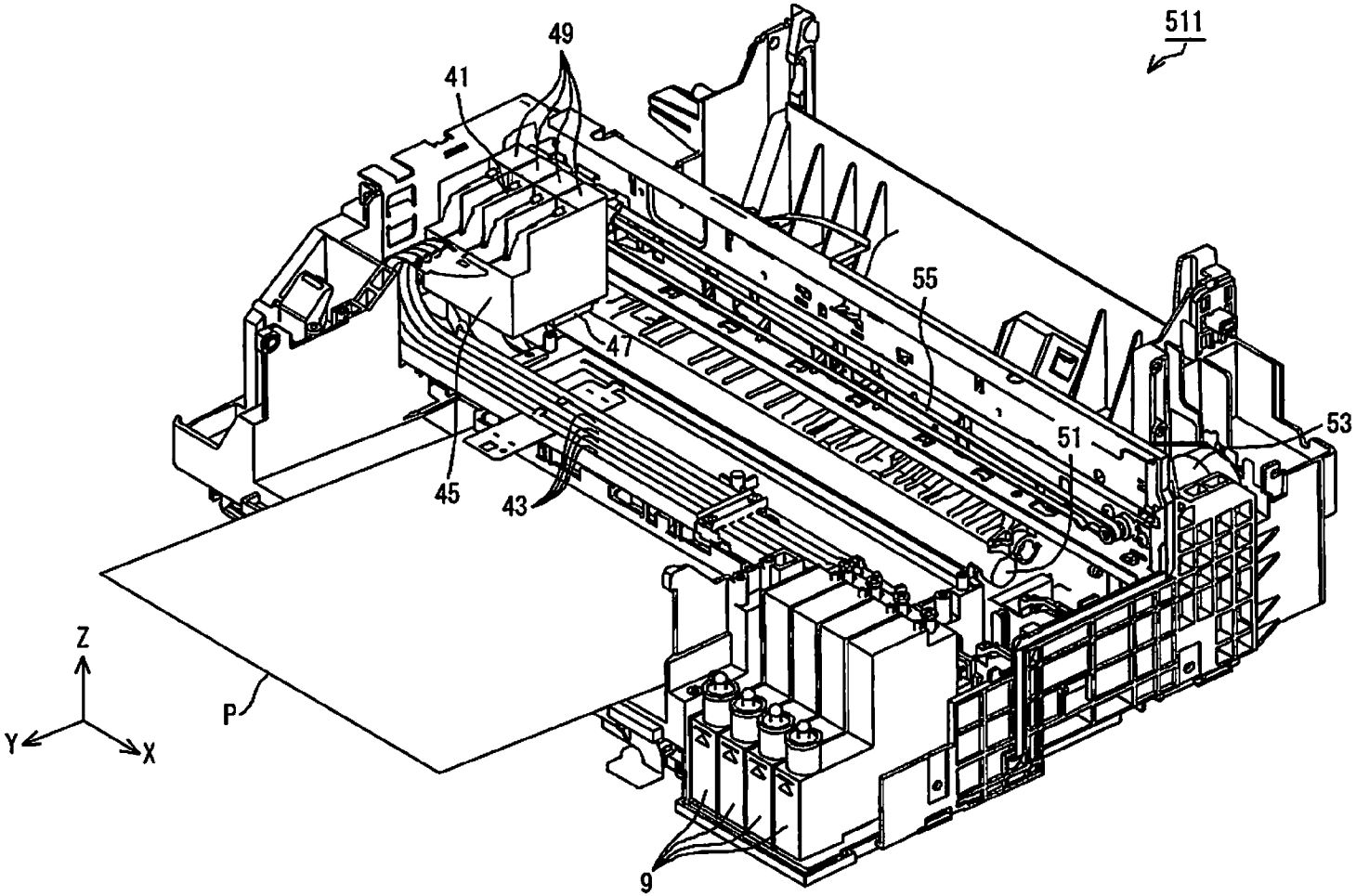
FIG. 44 is a perspective view illustrating a mechanism unit of a printer in a second embodiment.

The printer 503 has a print section 41 and supply tubes 43, as illustrated in FIG. 44, which is a perspective view illustrating the mechanism unit 511. The print section 41 and the supply tubes 43 each have similar configurations to the print section 41 and the supply tubes 43 in the liquid jet system 1. In the printer 503, as well, similarly to the liquid jet system 1, the medium conveyance mechanism conveys the printing medium P along the Y-axis direction by driving the conveyance roller 51 using power coming from a motor (not shown). Also in the printer 503, as well, similarly to the liquid jet system 1, the head conveyance mechanism conveys the carriage 45 along the X-axis direction by transmitting power coming from the motor 53 to the carriage 45 via the timing belt 55. The print head 47 is mounted onto the carriage 45. For this reason, the print head 47 can be conveyed in the X-axis direction via the carriage 45, by the head conveyance mechanism. The inks are discharged from the print head 47 while the relative position of the print head 47 with respect to the printing medium P is being changed by the medium conveyance mechanism and the head conveyance mechanism, whereby printing is performed on the printing medium P.

In each of the embodiments described above, the liquid jet apparatus may be a liquid jet apparatus that consumes a liquid other than an ink by ejecting, discharging, or coating with the liquid. A liquid that trails with particles, tears, or threads is also understood to be included as a state of a liquid that is made into minute liquid droplets and discharged from the liquid jet apparatus. It suffices for the liquid as referred to herein to be a such a material that can be consumed with a liquid jet apparatus. For example, it suffices for the liquid to be a substance when the substance is in the liquid phase, and high- or low-viscosity liquids, sols, gel waters, and other inorganic solvents, organic solvents, solutions, liquid resins, liquid metals (molten metals), and other liquid bodies are understood to be included. Not only liquids in the form of one state of a substance, but also solvents into which a functional material composed of a solid matter such as a pigment or metal particles has been dissolved or dispersed, or the like are also understood to be included. Representative examples of liquids include not only inks, such as were described in the first embodiment, but also liquid crystal and the like. Herein, the term "ink" encompasses a variety of compositions in the form of a liquid, such as general water-soluble inks and oil-soluble inks as well as gel inks, hot melt inks, and the like. Other specific examples of the liquid jet apparatus may include a liquid jet apparatus for ejecting a liquid containing, in the form of a dispersion or solution, a material such as an electrode material or color material that is used, inter alia, in the manufacture of liquid crystal displays, electroluminescence (EL) displays, surface emitting displays, or color filters. Other examples may include a liquid jet apparatus for ejecting a biological organic matter used to manufacture biochips; a liquid jet apparatus for ejecting a liquid serving as a sample, used as a precision pipette; or printing device, a micro-dispenser, or the like. Further examples include: a liquid jet apparatus for ejecting a lubricant at pin points for a precision machine such as a timepiece or camera; or a liquid jet apparatus for ejecting a transparent resin solution such as an ultraviolet curable resin onto a substrate in order to form, inter alia, a hemispherical micro lens (optical lens) used in an optical communication element or the like. Another example may be a liquid jet apparatus for ejecting an acid or alkali etching solution in order to etch a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid storage container comprising:

a liquid storage section configured to store a liquid;

an injection port open to the liquid storage section and configured and arranged to receive the liquid injected into the liquid storage section;

a cap configured to cover the injection port; and an air introduction valve configured and arranged to allow movement of air from an exterior of the liquid storage section to an interior of the liquid storage section and to prevent movement of air from the interior of the liquid storage section to the exterior of the liquid storage section, the air introduction valve including a through hole into which a shaft section is inserted, and the shaft section being formed at a communication chamber.

2. The liquid storage container as set forth in claim 1, further comprising an air release valve configured and arranged to allow the movement of air from the interior of the liquid storage section to the exterior of the liquid storage section and to prevent the movement of air from the exterior of the liquid storage section to the interior of the liquid storage section.

3. The liquid storage container as set forth in claim 2, further comprising an air introduction opening, a first air communication section configured and arranged to allow movement of air between the air introduction opening and the liquid storage section, and a second air communication section configured and arranged to introduce air to the liquid storage section from the first air communication section, the air introduction valve being located between the first air communication section and the second air communication section, and the air release valve being located between the first air communication section and the second air communication section.

4. The liquid storage container as set forth in claim 3, further comprising a first compartmentalizing wall compartmentalizing the first air communication section and the second air communication section from one another, a second compartmentalizing wall formed on a first surface of the first compartmentalizing wall and compartmentalizing the first air communication section and the second air communication section from one another, and a third compartmentalizing wall formed on a second surface of the first compartmentalizing wall opposite to the first surface and compartmentalizing the first air communication section and the second air communication section from one another, the air introduction valve and the air release valve being provided to the first compartmentalizing wall to move air from the second surface side toward the first surface side.

5. The liquid storage container as set forth in claim 2, further comprising an air communication section configured and arranged to allow movement of air between the exterior of the liquid storage section and the interior of the liquid storage section, the air introduction valve being provided to move air to the air communication section from the exterior of the liquid storage section, and the air release valve being provided to move air from the air communication section to the exterior of the liquid storage section.

6. The liquid storage container as set forth in claim 5, further comprising a housing having a recess in which the air communication section and the liquid storage section are formed, and a sealing member sealing off the recess, the air introduction valve and the air release valve being provided to a wall that faces the sealing member out of walls inside the recess.

7. The liquid storage container as set forth in claim 1, further comprising an air introduction opening, a first air communication section including an air chamber and a first communication passage, the first air communication section being configured and arranged to allow movement of air between the air introduction opening and the liquid storage section, and a second air communication section including the communication chamber and a second communication passage, the second air communication section being configured and arranged to introduce air to the liquid storage section from the first air communication section, the air introduction valve being located between the first air communication section and the second air communication section.

8. A liquid jet system comprising:

a first case;

a mechanism unit including a mechanism portion that is covered by the first case and is configured to execute a print operation;

a second case coupled to the first case; and a plurality of liquid storage containers as set forth in claim 1, the plurality of liquid storage containers being covered by the second case and being configured and arranged to supply a liquid to a print section of the mechanism unit via a supply tube.

9. A liquid jet apparatus comprising:

a case;

a mechanism unit including a mechanism portion that is covered by the case and is configured to execute a print operation; and a plurality of liquid storage containers as set forth in claim 1, the plurality of liquid storage containers being covered by the case and being configured and arranged to supply a liquid to a print section of the mechanism unit via a supply tube.

* * * * *